US012692609B2

(12) United States Patent
Sun et al.

(10) Patent No.: US 12,692,609 B2
(45) Date of Patent: Jul. 28, 2026

(54) NANOMATERIAL WITH NOBLE METAL ATOMS ON NON-NOBLE METAL SUBSTRATE, AND METHODS OF PREPARATION AND USE THEREOF

(71) Applicant: Shenzhen Hingear Energy Co., Ltd., Shenzhen (CN)

(72) Inventors: Xiaoming Sun, Qingdao (CN); Xinxuan Duan, Qingdao (CN); Guotao Yang, Qingdao (CN); Wei Liu, Qingdao (CN); Qihao Sha, Qingdao (CN); Tianshui Li, Qingdao (CN); Yun Kuang, Qingdao (CN)

(73) Assignee: Shenzhen Hingear Energy Co., Ltd., Shenzhen (CN)

( * ) Notice: Subject to any disclaimer, the term of this patent is extended or adjusted under 35 U.S.C. 154(b) by 1 day.

(21) Appl. No.: 18/900,883

(22) Filed: Sep. 29, 2024

(65) Prior Publication Data

US 2025/0019840 A1 Jan. 16, 2025

Related U.S. Application Data

(63) Continuation of application No. PCT/CN2023/078137, filed on Feb. 24, 2023.

(51) Int. Cl.

| | |
|---|---|
| ***C25B 11/052*** | (2021.01) |
| ***C23C 18/08*** | (2006.01) |
| ***C23C 18/12*** | (2006.01) |
| ***C23C 28/00*** | (2006.01) |
| ***C25B 1/04*** | (2021.01) |
| ***C25B 11/031*** | (2021.01) |
| ***C25B 11/054*** | (2021.01) |
| ***C25B 11/061*** | (2021.01) |
| ***C25B 11/065*** | (2021.01) |
| ***C25B 11/067*** | (2021.01) |
| ***C25B 11/081*** | (2021.01) |
| ***C25D 3/48*** | (2006.01) |
| ***C25D 3/50*** | (2006.01) |
| ***C25D 5/54*** | (2006.01) |

(52) U.S. Cl.

CPC ..... *C25B 11/052* (2021.01); *C23C 18/08* (2013.01); *C23C 18/1204* (2013.01); *C23C 18/1241* (2013.01); *C23C 18/1291* (2013.01); *C23C 28/322* (2013.01); *C23C 28/34* (2013.01); *C25B 1/04* (2013.01); *C25B 11/031* (2021.01); *C25B 11/054* (2021.01); *C25B 11/061* (2021.01); *C25B 11/065* (2021.01); *C25B 11/067* (2021.01); *C25B 11/081* (2021.01); *C25D 3/48* (2013.01); *C25D 3/50* (2013.01); *C25D 5/54* (2013.01)

(58) Field of Classification Search

None

See application file for complete search history.

(56) References Cited

U.S. PATENT DOCUMENTS

2006/0075626 A1 4/2006 Hwang et al.
2023/0374679 A1* 11/2023 Ghielmi ..... H01M 8/00

FOREIGN PATENT DOCUMENTS

| | | | |
|---|---|---|---|
| CN | 109225257 | A | 1/2019 |
| CN | 109225301 | A | 1/2019 |
| CN | 109234756 | A | 1/2019 |
| CN | 111389416 | A | 7/2020 |
| CN | 112023922 | A | 12/2020 |
| CN | 112264047 | A | 1/2021 |
| CN | 113930802 | A | 1/2022 |
| CN | 113952985 | A | 1/2022 |
| CN | 114045509 | A | 2/2022 |
| CN | 114134533 | A | 3/2022 |
| CN | 114214668 | A | 3/2022 |
| CN | 114045524 | A | 5/2022 |

OTHER PUBLICATIONS

Testova et al. "Unusual 1,2-dichloroethane dehydrochlorination over ruthenium-oxychloride catalyst" Catalysis Communications 67 '2015' 95-97 (Year: 2015).*

Wang et al. "Oxide Passivated CoNi@NC-Supported Ru(OH)xCly Cluster as Highly Efficient Catalysts for the Oxygen and Hydrogen Evolution" ACS Sustainable Chem. Eng. 2019, 7, 17227-17236 (Year: 2019).*

International Search Report dated Jun. 20, 2023; International Application No. PCT/CN2023/078137; International Filing Date Feb. 24, 2023; 7 pages; China National Intellectual Property Administration (ISA/CN), Beijing, China.

Written Opinion dated Jun. 20, 2023; International Application No. PCT/CN2023/078137; International Filing Date Feb. 24, 2023; 5 pages; China National Intellectual Property Administration (ISA/CN), Beijing, China.

* cited by examiner

*Primary Examiner* — Wojciech Haske

(74) *Attorney, Agent, or Firm* — Central California IP Group, P.C.; Andrew D. Fortney

(57) ABSTRACT

Nanomaterials and methods of preparation and use thereof, are disclosed. The nanomaterials include a non-noble metal substrate and noble metal atoms on a surface of the non-noble metal substrate. The noble metal atoms simultaneously coordinate with a halogen and oxygen. The substrate has a large specific surface area and a large electrochemical active area, and the surface coordination environment of the noble metal affects the electronic structure and catalytic activity of a resulting catalyst. The noble metal surface coordination structure may be regulated and controlled by a synthesis temperature, an alkalinity, a reaction time, and an electrodeposition voltage range. A hydroxide ion and the halogen coordinate with the noble metal, exhibiting an unsaturated pentacoordinate state. Doping the substrate with reducing metal ions may increase the loading capacity, anchor the noble metal atoms, and improve anodic oxygen evolution and cathodic hydrogen evolution in seawater electrolysis.

19 Claims, 37 Drawing Sheets a

NANOMATERIAL WITH NOBLE METAL ATOMS ON NON-NOBLE METAL SUBSTRATE, AND METHODS OF PREPARATION AND USE THEREOF

CROSS-REFERENCE TO RELATED APPLICATIONS

This application is a continuation of International Pat. Appl. No. PCT/CN2023/078137, filed on Feb. 24, 2023, which claims the benefit of Chinese Pat. Appl. No. 202210369875.3, filed on Apr. 8, 2022, both of which are incorporated herein by reference as if fully set forth herein.

TECHNICAL FIELD

The present invention belongs to the technical field of inorganic advanced nanomaterials, and particularly relates to a nanomaterial with noble metal atoms on a surface of a non-noble metal substrate, and a preparation method and use thereof.

BACKGROUND

With the increase of human demand for energy, existing conventional energy resources in the world are seriously insufficient, and environmental problems caused by burning traditional fossil fuels are also becoming increasingly serious. Therefore, development of renewable new energy is extremely urgent. Currently, solar energy, wind energy, biomass energy, water energy, hydrogen energy, and the like are widely regarded as renewable clean energy. Among them, hydrogen energy has attracted much attention due to its characteristics of lightweight, non-toxic, high calorific value, large storage capacity, recyclability and the like. At present, electrolyzing water is an important way to prepare hydrogen. However, freshwater resources available to human are extremely limited, with a total storage capacity of less than 1% of the total water on earth. Therefore, simply using pure water to produce hydrogen is not enough to meet human needs for the hydrogen energy. Seawater resources on earth are extremely abundant, with 70.8% of a total surface area of the earth covered by seawater. If hydrogen can be produced by electrolyzing seawater, it can not only achieve effective utilization of seawater resources, but also solve increasingly severe energy problem and environmental problem.

A catalyst is the core of electrolysis and plays a decisive role in electrolysis voltage, efficiency, and the like. At present, an anodic reaction requires a large overvoltage, and in seawater electrolysis, catalyst selectivity and stability problems caused by the presence of a large number of chloride ions urgently need to be solved. The concentration of chloride ions in seawater is about 0.5 mol/L. A theoretical potential of a chloride ion oxidation reaction (1.36 V) is not significantly different from that of oxygen evolution (1.23 V), but a chlorine evolution reaction is a $2e^-$ reaction, which is more favorable in terms of kinetics and makes chlorine evolution more likely to occur, affecting reaction selectivity. Meanwhile, the chloride ions are prone to reacting with the catalyst, affecting the stability of the catalyst and shortening its service life. Accordingly, it is of great significance to develop a highly active, selective and stable seawater electrolysis catalyst. At present, a lot of work is focused on avoiding adsorption of chlorine ions to prevent or reduce the occurrence of a chlorine evolution reaction, which usually also reduces the oxygen evolution activity. This "shielding" phenomenon of chloride ion adsorption may fail at high voltage and cannot be applied in industrial electrolysis under working conditions that include a large current density.

The present invention is intended to solve the above problems.

SUMMARY

The present invention concerns a nanomaterial with noble metal atoms (e.g., single atoms) on a surface (e.g., dispersed on the surface) of a non-noble metal. A characteristic of high dispersions of noble metals enables the nanomaterial to be sensitive to the surrounding environment while reducing the amount of the noble metal, and surface adsorption of chloride ions may regulate and control a structure of the material and affect its performance.

The noble metal is on (e.g., loaded on) the surface of the non-noble metal. On the one hand, the noble metal is not prone to desorption (e.g., due to strong adsorption of chloride ions), so that the noble metal has high selectivity for oxygen evolution; and on the other hand, the noble metal protects the non-noble metal substrate from undesired reactions (e.g., from being corroded). The non-noble metal species in the substrate may have a strong interaction with noble metal atoms (e.g., single-atom noble metal), so that the noble metal is not prone to falling off and has a high stability.

A first aspect of the present invention provides a nanomaterial with noble metal atoms on a surface of a non-noble metal substrate, and the nanomaterial includes the non-noble metal substrate and noble metal atoms (e.g., in single atom dispersion) on a surface of the non-noble metal substrate; and the atoms of the noble metal are simultaneously coordinated with a halogen such as chlorine and oxygen.

The oxygen coordinated to the noble metal atoms exists in a form of an oxygen-containing functional group. The oxygen-containing functional group may be a hydroxide ion.

A single atom dispersion of the noble metal means that the noble metal is relatively evenly distributed on the surface of the non-noble metal substrate, there are substantially no metal-metal bonds or metal-oxygen-metal bonds between the noble metal atoms (e.g., such bonds are beyond the limits of detectability using the techniques disclosed herein), and the noble metal is connected with the non-noble metal substrate through chemical bonds.

Preferably, the halogen is selected from one or more of chlorine, bromine, fluorine, and iodine.

Preferably, the noble metal is selected from one or more of iridium, ruthenium, gold, platinum, rhodium, palladium, silver, and osmium. For example, the noble metal is selected from one, two, three, four, five or more of iridium, ruthenium, gold, platinum, rhodium, palladium, silver, and osmium.

Preferably, the non-noble metal substrate is selected from one or more non-noble metal hydroxides, non-noble metal oxides, non-noble metal sulfides, non-noble metal phosphides, and non-noble metal selenides. When the non-noble metal substrate comprises a non-noble metal sulfide, phosphide, or selenide, the noble metal atoms coordinate with the sulfur, phosphorus, or selenium, while also coordinating with halogen or oxygen.

Preferably, the non-noble metal in the non-noble metal substrate is selected from one or more of iron, cobalt, nickel, aluminum, manganese, cerium, vanadium, zinc, copper, strontium, indium, and cadmium.

Preferably, the non-noble metal substrate is doped with one or more reducing metal ions, and the noble metal atoms may be selectively anchored with the reducing metal ions.

Preferably, the reducing metal ions are selected from one or more of iron ions, manganese ions, and cobalt ions, each of which may be divalent. Specifically, the noble metal atoms may be selectively anchored above the reducing metal ions.

Preferably, the nanomaterial further includes a conductive carrier, and the non-noble metal substrate may be loaded on the conductive carrier.

More preferably, the conductive carrier is selected from foam metal, carbon paper, a carbon cloth, etc. The foam metal may be selected from foam iron, foam nickel, etc.

A second aspect of the present invention concerns a method of preparing the nanomaterial with the noble metal atoms on the surface of the non-noble metal substrate as described in the first aspect. In one example, the preparation method is a chemical precipitation method, and includes dispersing the non-noble metal substrate in water, dropwise adding a dilute solution of a water-soluble noble metal precursor and a base thereto to obtain a mixed solution, reacting the mixed solution for 4-120 hours at 10-95° C. while stirring, performing solid-liquid separation, washing a resulting solid, and drying the resulting solid to obtain the nanomaterial.

The dilute solution of the water-soluble noble metal precursor and the base may have a concentration of the water-soluble noble metal precursor in a range from 0.001 mmol/L to 200 mmol/L, and a concentration of the base (e.g., a hydroxide ion) in a range from 0.5 mmol/L to 1000 mmol/L. The water-soluble noble metal precursor may contain one or more halogen elements. In chemical deposition, a key step is to control the concentrations of the water-soluble noble metal precursor and the hydroxide ion in the dilute solution so as to ensure simultaneous coordination of the hydroxide ion and the halogen. For example, the water-soluble noble metal precursor may be one or more noble metal chlorides, bromides, or fluorides. When the water-soluble noble metal precursor contains two or three different halides, two or three different halogen elements may coordinate simultaneously to the noble metal atoms.

Preferably, when the non-noble metal substrate is doped with reducing metal ions, the chemical precipitation method further includes eliminating oxygen dissolved in the water, (e.g., prior to adding the dilute solution of the water-soluble noble metal precursor and the base to the water).

Preferably, when the non-noble metal substrate is a non-noble metal hydroxide, the preparation method further comprises mixing an alkali liquor and a water-soluble non-noble metal precursor solution to co-precipitate a crude non-noble metal hydroxide, performing crystallization and solid-liquid separation on the crude non-noble metal hydroxide, and drying a separated solid to obtain the non-noble metal hydroxide.

When the non-noble metal substrate is a non-noble metal oxide, the preparation method may further comprise directly calcining a first corresponding non-noble metal hydroxide to obtain the non-noble metal oxide.

When the non-noble metal substrate is a non-noble metal sulfide, non-noble metal phosphide or non-noble metal selenide, the preparation method may be selected from one of the following two methods:

Method 1: mixing a second corresponding non-noble metal hydroxide with a solution containing a sulfur substance, a selenium substance, or a phosphorus substance, and hydrothermally reacting the second corresponding non-noble metal hydroxide and the solution to obtain the non-noble metal sulfide, the non-noble metal selenide or the non-noble metal phosphide; and Method 2: simultaneously placing a third corresponding non-noble metal hydroxide with a calcining substance containing sulphur, selenium or phosphorus in a tube furnace and calcining the third corresponding non-noble metal hydroxide and the calcining substance to obtain the non-noble metal sulfide, the non-noble metal selenide or the non-noble metal phosphide.

More preferably, the above alkali liquor comprises a mixed solution of sodium hydroxide and sodium carbonate, having a concentration of the sodium hydroxide in a range from 0.004 mol/L to 0.3 mol/L, and a concentration of the sodium carbonate in a range from 0.0001 mol/L to 0.1 mol/L. The water-soluble non-noble metal precursor solution may comprise a nitrate, sulfate, or chloride salt or compound (e.g., coordination compound) of the non-noble metal, with a concentration of the water-soluble non-noble metal precursor ranging from 0.002 mol/L to 0.3 mol/L. Reaction conditions for co-precipitation of the crude non-noble metal hydroxide (e.g., from the alkali liquor and the water-soluble non-noble metal precursor solution) may include a pH=8-12, a temperature in a range from 20° C. to 80° C., and a reaction time in a range from 6 hours to 48 hours.

Preferably, in the above method 1, the hydrothermal reaction conditions include a volume of the solution of 36 mL, a temperature in a range from 100° C. to 120° C., and a reaction time in a range from 3 hours to 6 hours. A concentration of the solution, which may contain a sulfide, a phosphide or a selenide salt or compound, is 3-10 mmol/36 mL. The conditions for calcining may include a temperature in a range from 300° C. to 500° C., and a time in a range from 2 hours to 5 hours.

Preferably, in the above method 2, the conditions for calcining include a temperature in a range from 300° C. to 500° C., and a time in a range from 2 hours to 5 hours.

A third aspect of the present invention concerns another method of preparing a nanomaterial with noble metal atoms on a surface of a non-noble metal substrate, where the nanomaterial further includes a conductive carrier, the non-noble metal substrate is on the conductive carrier, and the preparation method is an electrodeposition method that includes preparing an electrolyte solution containing a water-soluble noble metal precursor and a base, and electrochemically depositing the noble metal atoms on the non-noble metal substrate using the conductive carrier loaded with the non-noble metal substrate as a working electrode at an electrodeposition voltage in a range from −1.2 V to 1.2 V, and the electrolyte solution has a concentration of the water-soluble noble metal precursor in a range from 0.001 mmol/L to 1000 mmol/L, a concentration of the base (e.g., a hydroxide ion) in a range from 0.1 mol/L to 6 mol/L, and the water-soluble noble metal precursor contains the halogen.

Preferably, the water-soluble noble metal precursor and the base are mixed in the electrolyte solution;

Preferably, the electrochemical deposition uses a three-electrode system including the conductive carrier loaded with the non-noble metal substrate, a carbon rod, and a reference electrode.

Preferably, the electrolyte solution has a concentration of the water-soluble noble metal precursor in a range from 0.001 mmol/L to 10 mmol/L.

In the electrodeposition method, the concentrations of the water-soluble noble metal precursor and the base (e.g., hydroxide ion) in the electrolyte solution and the electrodeposition voltage range may be controlled so as to ensure simultaneous coordination of hydroxide ions and the halogen(s). For example, the water-soluble noble metal precursor may include one or more chloride, bromide, or fluoride salts of compounds of the water-soluble noble metal. When the water-soluble noble metal precursor contains two or three different halides, two or three different halogen elements may coordinate simultaneously to the noble metal atoms.

Preferably, when the non-noble metal substrate is doped with reducing metal ions, in the electrodeposition method, dissolved oxygen in the electrolyte solution is eliminated (e.g., in advance of the electrochemical deposition).

More preferably, eliminating the dissolved oxygen in the electrolyte solution may comprise heating the water (e.g., deionized water) or the electrolyte solution at 80° C., introducing nitrogen to the vessel or container containing the water or the electrolyte solution, and obtaining, after at least 1 hour, the water or the electrolyte solution from which the dissolved oxygen is removed.

Preferably, when the non-noble metal substrate is doped with reducing metal ions, the reducing metal ions participate in a reaction when preparing the non-noble metal substrate.

Preferably, the number of cycles for electrodeposition is in a range from 3 to 20.

More preferably, the method of preparing the conductive carrier loaded with the non-noble metal substrate depends on whether the non-noble metal substrate is a non-noble metal hydroxide, a non-noble metal oxide, a non-noble metal sulfide, a non-noble metal phosphide or a non-noble metal selenide. When the non-noble metal substrate is the non-noble metal hydroxide, the preparation method may comprise hydrothermally reacting the conductive carrier, urea and a water-soluble non-noble metal precursor solution, then crystallizing, washing and drying the conductive carrier loaded with the non-noble metal hydroxide; or using an electrodeposition method to prepare the conductive carrier loaded with the non-noble metal hydroxide. When the non-noble metal substrate is the non-noble metal oxide, the preparation method may comprise directly calcining the conductive carrier loaded with a first corresponding non-noble metal hydroxide to obtain a conductive carrier loaded with the non-noble metal oxide.

When the non-noble metal substrate is the non-noble metal sulfide, the non-noble metal phosphide or the non-noble metal selenide, the preparation method may comprise one of the following two methods:

Method 1: mixing the conductive carrier loaded with a second corresponding non-noble metal hydroxide with a solution containing a sulfur substance, a selenium substance or a phosphorus substance, hydrothermally reacting the second corresponding non-noble metal hydroxide and the solution, and then calcining a resulting solid to obtain the conductive carrier loaded with the non-noble metal sulfide, the non-noble metal selenide or the non-noble metal phosphide; or Method 2: simultaneously placing the conductive carrier loaded with a third corresponding non-noble metal hydroxide with a calcining substance containing sulphur, selenium or phosphorus in a tube furnace and calcining the third corresponding non-noble metal hydroxide and the calcining substance to obtain the conductive carrier loaded with the non-noble metal sulfide, the non-noble metal selenide or the non-noble metal phosphide.

The phosphorus-containing substance herein may optionally be selected from a suitable form, such as sodium hypophosphite, sodium phosphite, and elemental phosphorus.

The sulfur-containing substance herein may optionally be selected from a suitable form, such as thiourea and elemental sulfur.

The selenium-containing substance herein may optionally be selected from a suitable form, such as elemental selenium.

A method for preparing the conductive carrier loaded with the non-noble metal hydroxide may comprise electrochemical deposition in an electrochemical workstation using the conductive carrier as a working electrode, a carbon rod as a counter electrode, and a saturated calomel electrode as a reference electrode, wherein an electrolyte solution in the electrochemical deposition comprises an aqueous solution of the non-noble metal.

Preferably, during the hydrothermal reaction of the above conductive carrier, urea and water-soluble non-noble metal precursor solution, the solution has a concentration of the urea of 3-10 mmol/36 mL, the water-soluble non-noble metal precursor solution is a nitrate, a sulphate or a chloride salt or compound of the non-noble metal, and the concentration of the water-soluble non-noble metal precursor is 1 mmol/36 mL. The hydrothermal reaction conditions may include a temperature in a range from 100° C. to 120° C., and a reaction time in a range from 8 hours to 12 hours.

Preferably, in the above method 1, the hydrothermal reaction conditions include a volume of the solution of 36 mL, a temperature in a range from 100° C. to 120° C., a reaction time in a range from 3 hours to 6 hours, and a concentration of the sulfide solution, the phosphide solution or the selenide solution is 3-10 mmol/36 mL. The calcining conditions may comprise a temperature in a range from 300° C. to 550° C., and a time in a range from 2 hours to 5 hours.

In the present invention, by regulating and controlling the types of raw materials, any combination of four types of non-noble metal substrate, non-noble metal, noble metal, and halogen may be achieved or combined, and any combination of elements in the non-noble metal and in the noble metal may be achieved.

The chemical deposition method and the electrodeposition method are also both suitable for preparing any of the above materials.

A fourth aspect of the present invention concerns use of the nanomaterial according to the first aspect as an electrode for electrolyzing water, and a halide is added into an electrolyte solution for electrolyzing water to improve performance of the nanomaterial in electrolyzing the water.

The electrolyte solution for electrolyzing the water may contain a base.

Preferably, the improved performance includes at least one of improved activity, improved selectivity and improved stability.

Preferably, the nanomaterial is both an anode and a cathode for electrolyzing the water.

The nanomaterial may be both the anode and the cathode for electrolyzing water when the nanomaterial serves alone as the anode for electrolyzing the water, the nanomaterial serves alone as the cathode for electrolyzing the water, the same nanomaterial serves simultaneously as both the anode and the cathode for electrolyzing the water; or different nanomaterials serve separately as the anode and the cathode for electrolyzing the water.

Preferably, the halide is selected from one or more of chloride, bromide and fluoride. Halogens (fluorine, bromine, chlorine and iodine) or halides may further coordinate to the noble metal atoms, so as to regulate and control a coordination environment (e.g., of the noble metal atoms) and an electronic structure of the nanomaterial, thereby improving the stability of an electrode containing the nanomaterial.

The base herein may be selected from one or more of sodium hydroxide, potassium hydroxide, etc. The halide is selected from one or more of sodium chloride, potassium chloride, sodium fluoride, potassium fluoride, sodium bromide, potassium bromide, potassium iodide, sodium iodide, etc.

A fifth aspect of the present invention provides use of the nanomaterial according to the first aspect as an electrode for electrolyzing seawater.

Preferably, the nanomaterial may be both an anode and a cathode for electrolyzing the seawater.

The nanomaterial may be both the anode and the cathode for electrolyzing the seawater when the nanomaterial serves alone as the anode for electrolyzing the seawater, the nanomaterial serves alone as the cathode for electrolyzing the seawater, the same nanomaterial serves simultaneously as both the anode and the cathode for electrolyzing the seawater, or different nanomaterials serve separately as the anode and the cathode for electrolyzing the seawater.

The above technical solutions may be freely combined without contradiction.

Compared to the prior art, the present invention has the following beneficial effects.

(1) In the material of the present invention, a single atom dispersion of the noble metal may result in the material having characteristics of a large specific surface area and a large electrochemical active area, thereby having a higher catalytic activity. Similarly, the single atom dispersion of the noble metal influences the coordination environment, electronic structure, and catalytic activity of a catalyst containing the noble metal atoms. The noble metal surface coordination structure of the present invention may be regulated and controlled by the synthesis temperature, the potential of hydrogen (e.g., pH), the reaction time, and the electrodeposition voltage range (if the electrodeposition method is used). In the material of the present invention, the hydroxide ion and the halogens (chlorine, bromine, fluorine and iodine) simultaneously coordinate to the noble metal, and may have an unsaturated, pentacoordinate coordination state, which can improve activity of anodic oxygen evolution and cathodic hydrogen evolution of seawater (e.g., as an electrolytic material).

(2) The material of the present invention may be used for anodic oxygen evolution and cathodic hydrogen evolution when electrolyzing seawater. In the seawater electrolysis reaction process, the halogens (chlorine, bromine, fluorine and iodine) in the electrolyte solution are adsorbed on the noble metal atoms and are not prone to desorption, and thus metal-halogen bonds are formed, which further regulates and controls the noble metal coordination environment and the electronic structure, and improves the reaction activity, selectivity (inhibiting the occurrence of chlorine evolution side reactions) and material stability during anodic oxygen evolution and cathodic hydrogen evolution.

(3) The atoms of the noble metal of the catalyst of the present invention are tightly bonded to the non-noble metal substrate via chemical bonds. Thus, the catalytic activity of the material of the present invention is not a simple addition of a non-noble metal substrate catalyst and the noble metal. There is a strong interaction between the noble metal and the non-noble metal substrate, the noble metal is not prone to falling off, the stability is improved, electron clouds are redistributed, and the activity of the material of the present invention is further improved. In a preferable implementation, when the non-noble metal substrate is the non-noble metal sulfide, phosphide, or selenide, the noble metal atoms coordinate with the sulfur, phosphorus, or selenium in the non-noble metal substrate, while also coordinating with halogen and/or oxygen, so as to form a strong interaction with the non-noble metal substrate.

(4) The noble metal in the material may be in single atom dispersion, so that a content of the noble metal is greatly reduced, thereby reducing the cost of the catalyst and facilitating large-scale commercialization.

(5) In particular, according to the experiment of Comparative Example 1, it is found that the oxygen evolution performance of the material of the present invention when electrolyzing water or seawater is closely related to the local coordination structure of the noble metal atoms, and the noble metal has the best performance when coordinated with both the halogen and the oxygen-containing functional group.

(6) In a preferred solution, the introduction of the reducing metal ions (for example, ferrous iron, divalent manganese ions or divalent cobalt ions) into the non-noble metal substrate (e.g., a hydrotalcite laminate) of the present invention has the unexpected beneficial effect of, after final loading of the noble metal, not only can single atom dispersion of the noble metal be achieved, but also the single atom loading capacity of the noble metal is improved.

In an existing material, in order to achieve single atom dispersion of the noble metal on the substrate, the concentration of the noble metal can only be reduced. In the final material, a mass content of the noble metal is generally less than 0.5%. Therefore, the single atom dispersion and high loading capacity of the noble metal are a dilemma.

The present invention solves the above dilemma by introducing the reducing metal ions into the hydrotalcite laminate, which can protect the single atom dispersion of the noble metal and increase the loading capacity of the noble metal.

The reason may be that the reducing metal ions can maintain the characteristic of single atom dispersion in the laminate, and can selectively anchor noble metal ions. Therefore, even if the addition amount of the noble metal is increased, there is no need to worry about aggregation of the noble metal to form particles, and the noble metal atoms can still be anchored to the substrate by the reducing metal ions to maintain a single atom dispersion state.

In addition, ferrous iron, divalent manganese ions, or divalent cobalt ions can be introduced into the laminate to selectively reduce the noble metal. The strong reducibility enhances the interaction between the single atom noble metal and the hydrotalcite substrate, making the noble metal more firmly anchored and less prone to falling off, thereby improving the stability of the single atom catalyst.

The reducing ferrous iron, divalent manganese ions, or divalent cobalt ions in the laminate can reduce a valence state of the noble metal, making the noble metal have higher activity and stability when being used for electrolyzing water and seawater.

The specific reason is that the interaction between the noble metal and the reducing metal ions is enhanced, the noble metal is anchored more tightly and is not prone to falling off, and the stability is improved; and the reducing metal ions may cause the noble metal to have a lower initial valence state and better activity. However, in an existing noble metal loading material, since the noble metal is fixed to the surface of the substrate by one or more metal-chalcogen-metal (M-O-M) bonds, the valence state of the noble metal is high, and the stability is poor.

Taking Ru as an example, if the laminate has ferrous ions, Ru and $Fe^{2+}$ can interact, and $Fe^{2+}$ can give an electron to Ru in a redox reaction (e.g., an electron gain and an electron loss between the different metals), and therefore such acting force is stronger. If there are no ferrous ions in the laminate, but only ferric ions, there is no redox interaction between Ru and $Fe^{3+}$, which are connected through Ru—O-M bonds (where M represents $Fe^{3+}$ and/or another laminate metal ion), resulting in a much weaker interacting force.

The noble metal single atoms may be dispersed in a ferrous iron-/manganese-doped hydrotalcite to form an M-$Fe^{2+}$ or M-$Mn^{2+}$ catalytic pair. At the same time, the interaction between the noble metal and $Fe^{2+}$ enables the electron cloud density around Fe to change, and the performance becomes better. The activity of the hydrotalcite laminate is thus activated.

DETAILED DESCRIPTION OF THE EMBODIMENTS

The present invention will be further illustrated below through embodiments, but is not limited by any particular embodiment. Experimental methods that do not specify specific conditions in the embodiments may be obtained through commercial channels usually according to conventional conditions and conditions described in a manual, or according to general equipment, materials, reagents, etc. used in conditions recommended by the manufacturer, unless otherwise specified. The raw materials in the following embodiments and comparative examples are all commercially available.

Embodiment 1—Chemical Deposition Method

A preparation method of a nanomaterial (iridium/cobalt iron hydroxide) with noble metal single atoms dispersed on a surface of a non-noble metal substrate adopts a chemical deposition method described in the second aspect of the present invention, which is specifically as follows:

Step (1): a non-noble metal substrate-cobalt iron hydroxide material was prepared.

Preparation of 40 mL of an alkali liquor A: 40 mL of the alkali liquor A was prepared by mixing 0.48 g of sodium hydroxide and 0.106 g of sodium carbonate with an appropriate amount of deionized water.

Preparation of 40 mL of a salt solution B: 40 mL of the salt solution B was prepared by mixing 0.291 g of cobalt nitrate and 0.202 g of ferric nitrate with an appropriate amount of deionized water.

The solution A and the solution B were simultaneously added dropwise to 40 ml of water under high-speed stirring, and the pH was maintained at about 8.5 until the dropwise addition of the salt solution B was completed. Stirring was continued for 12 hours, centrifuging was performed to obtain precipitates, and the precipitates were washed with deionized water and ethyl alcohol three times each, and dried in vacuum at 60° C. to obtain the cobalt iron hydroxide material.

Step (2): a nanomaterial was prepared.

1 g of the cobalt iron hydroxide material obtained in step (1) was weighed, 30 mL of deionized water was added, and ultrasound was applied for 2-3 hours until the material was evenly distributed in the water. Preparation of 20 mL of an alkaline dilute solution of iridium chloride: 20 mL of an alkaline dilute solution of iridium chloride was prepared by mixing 0.6 mg (0.1 mmol/L) of iridium chloride, 0.4 mg (0.5 mmol/L) of sodium hydroxide, and deionized water. Then, under high-speed stirring (500 rev/min), the above alkaline dilute solution of the iridium chloride was added dropwise into the uniformly dispersed cobalt iron hydroxide material, at a drop rate of 5 drops/minute. After dropwise adding, stirring was continued under heating at 95° C. for 4 hours, centrifugation was performed to obtain precipitates, and the precipitates were washed with water and ethyl alcohol three times each, and dried in vacuum at 60° C. to obtain a nanosheet (iridium/cobalt iron hydroxide) with iridium single atoms loaded on a surface of cobalt iron bimetallic hydroxide.

Figure 1:
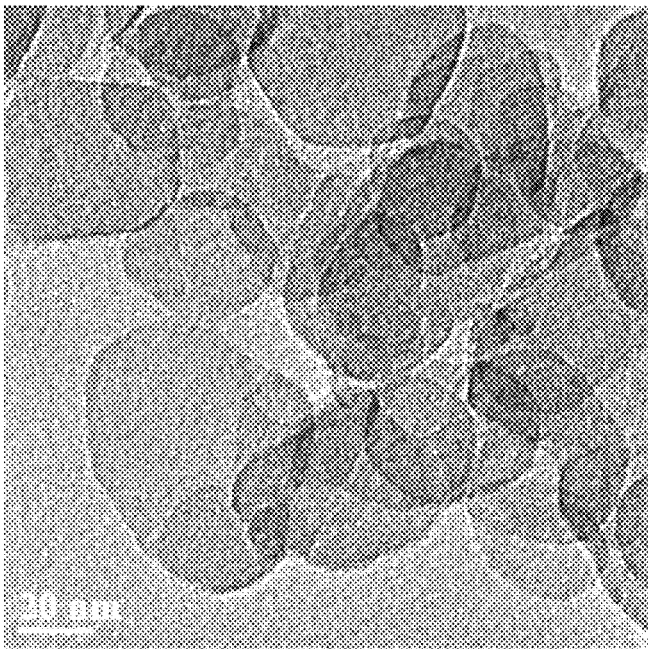
FIG. 1 is a transmission electron microscopy (TEM) image of an iridium/cobalt iron hydroxide material obtained in Embodiment 1.

Reference is made to FIG. 1 for a transmission electron microscopy image of the obtained iridium/cobalt iron hydroxide. It may be seen from FIG. 1 that the iridium/cobalt iron hydroxide is a hexagonal plate with a diameter of 50-100 nanometers and a thickness of 5-10 nanometers.

Figure 2:
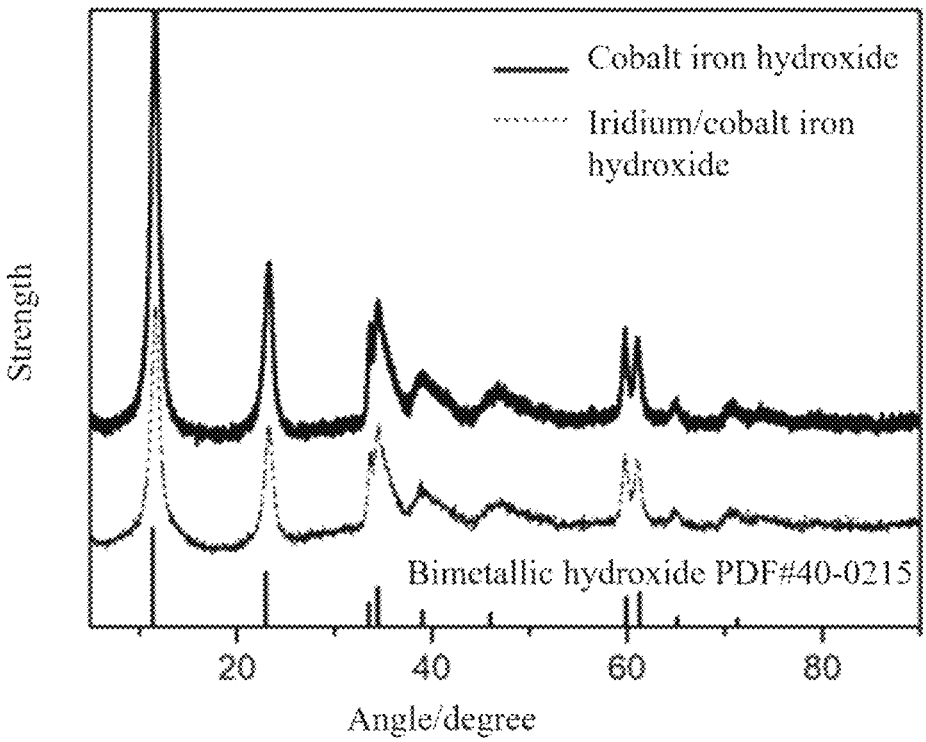
FIG. 2 is an X-ray diffraction (XRD) spectrum of an iridium/cobalt iron hydroxide material obtained in Embodiment 1.

Reference is made to FIG. 2 for an XRD spectrum of the obtained iridium/cobalt iron hydroxide. It may be seen that after single atom loading of iridium, a diffraction peak is consistent with that of the cobalt iron hydroxide, and if there is no diffraction peak of iridium or iridium oxide, it indicates that no iridium or iridium oxide particles are crystallized in the synthesis process.

Figure 3:
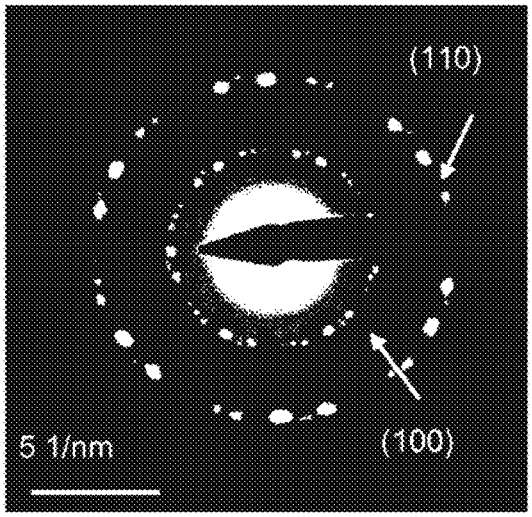
FIG. 3 is a selected area electron diffraction (SAED) diagram of an iridium/cobalt iron hydroxide material obtained in Embodiment 1.

Reference is made to FIG. 3 for a selected area of the electron diffraction diagram of the obtained iridium/cobalt iron hydroxide. It may be seen from FIG. 3 that diffraction rings of the material are 100 and 110 crystal planes of the bimetallic hydroxide, and there is no diffraction ring of iridium and iridium oxide, which is consistent with the XRD spectrum, and also indicates that there is no Ir or iridium oxide particles.

Figure 4:
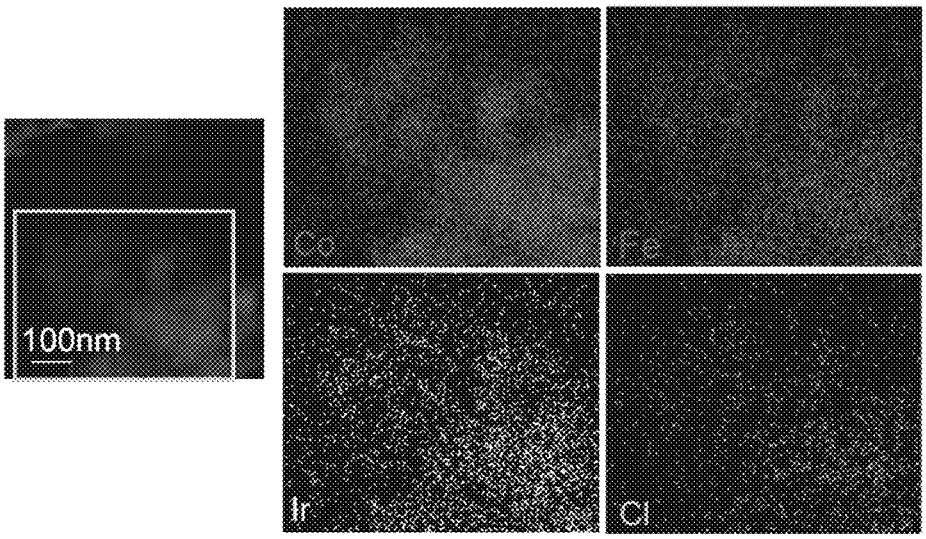
FIG. 4 is an element distribution map of an iridium/cobalt iron hydroxide material obtained in Embodiment 1.
Figure 5:
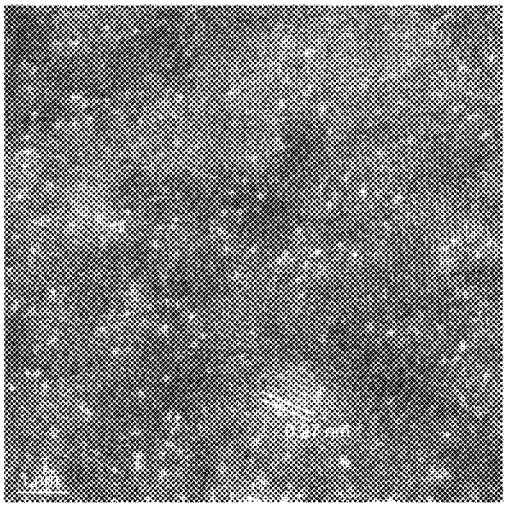
FIG. 5 is a scanning transmission electron microscopy (STEM) image of an iridium/cobalt iron hydroxide material obtained in Embodiment 1.

Reference is made to FIG. 4 for the elemental distribution of the obtained iridium/cobalt iron hydroxide, and reference is made to FIG. 5 for its scanning transmission electron microscopy image. It may be seen from FIG. 4 that the elements of iridium, cobalt, iron and chlorine in the material are uniformly distributed, and it may be seen in conjunction with the scanning transmission electron microscopy image in FIG. 5 that the iridium single atoms of noble metal are distributed on the surface of the cobalt iron hydroxide.

Figure 6:
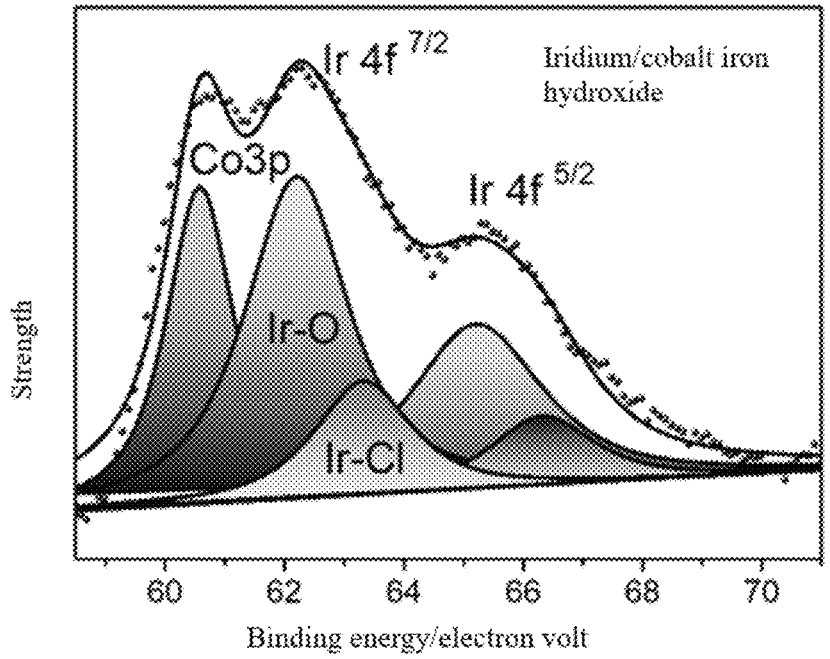
FIG. 6 is a graph obtained by X-ray photoelectron spectroscopy (XPS) of an iridium/cobalt iron hydroxide material obtained in Embodiment 1.

Reference is made to FIG. 6 for a graph obtained by X-ray photoelectron spectroscopy of the obtained iridium/cobalt iron hydroxide, and from the binding energy of iridium in FIG. 6, it may be seen that iridium is simultaneously coordinated to oxygen and chlorine (e.g., it contains Ir—O and Ir—Cl bonds).

Figure 7:
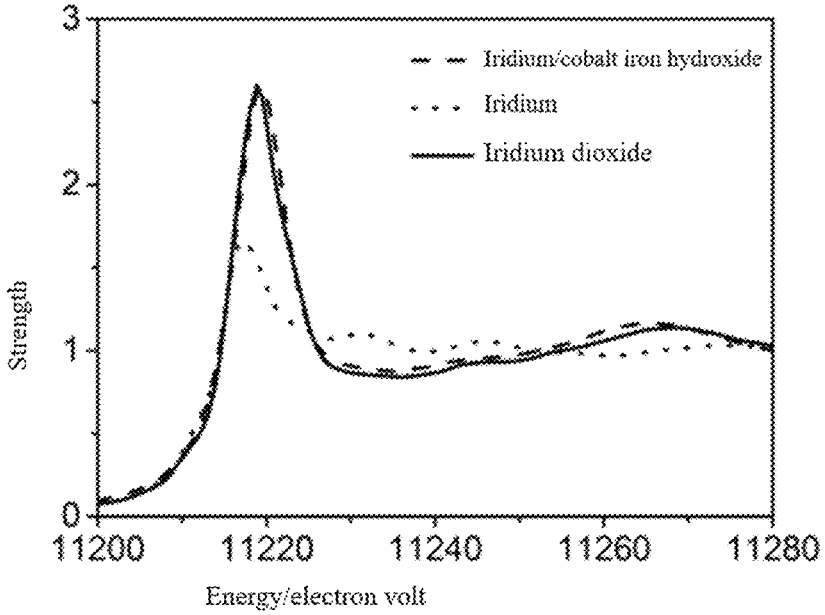
FIG. 7 is an X-ray absorption near-edge spectrum of an iridium/cobalt iron hydroxide material obtained in Embodiment 1.
Figure 8:
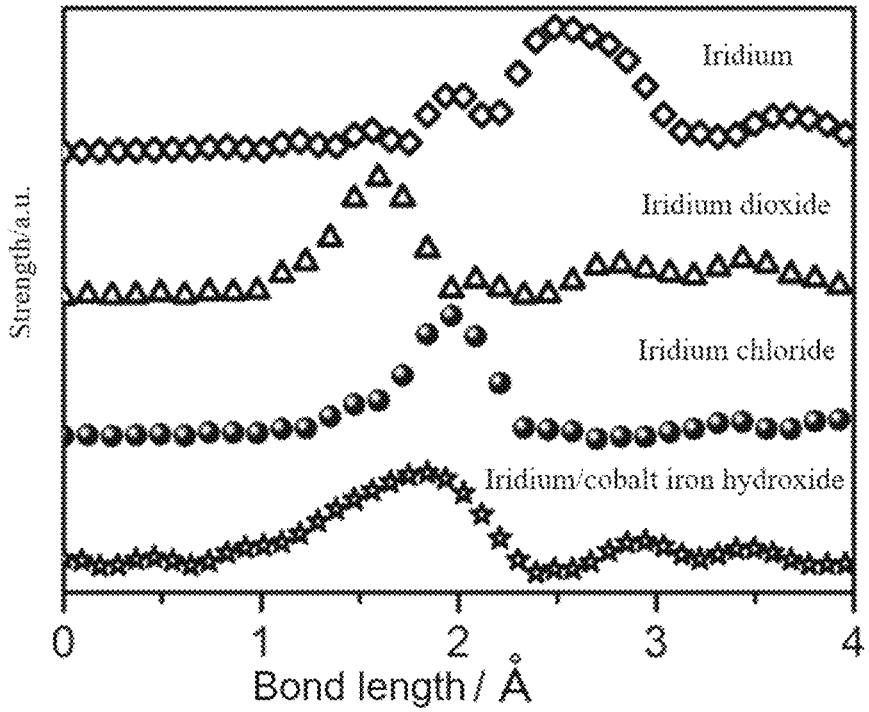
FIG. 8 is an X-ray absorption fine structure spectrum of an iridium/cobalt iron hydroxide material obtained in Embodiment 1.
Figure 9:
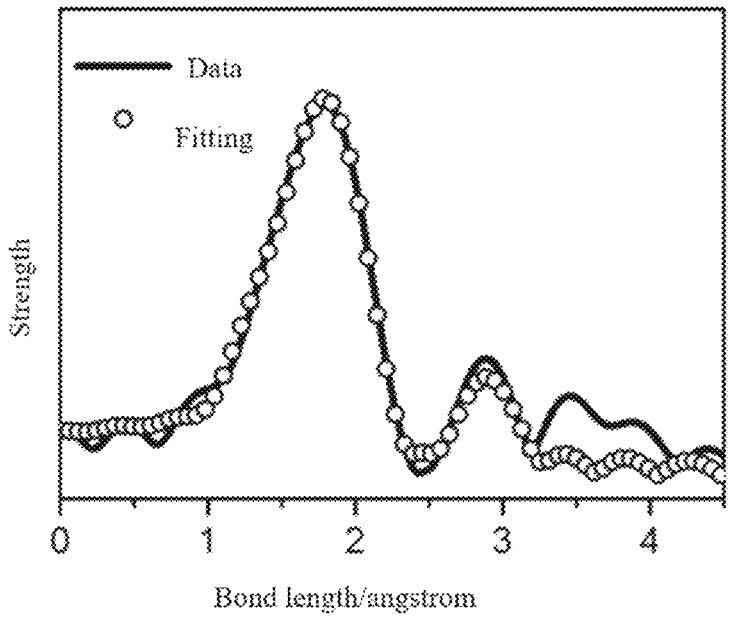
FIG. 9 is fitting of an X-ray absorption fine structure spectrum of an iridium/cobalt iron hydroxide material obtained in Embodiment 1 and a schematic structural diagram of single atom iridium.

An X-ray near-edge absorption spectrum of the obtained iridium/cobalt-iron hydroxide is shown in FIG. 7. Reference is made to FIG. 8 for an X-ray absorption fine structure spectrum of the iridium/cobalt iron hydroxide. Reference is made to FIG. 9 for fitting of an X-ray absorption fine structure of the iridium/cobalt iron hydroxide. It may be seen from FIG. 7 that the single atom Ir is dispersed on a cobalt iron bimetallic nanosheet, has a valence state close to that of iridium oxide, and has a valence of +4. It may be seen from FIG. 8 and FIG. 9 that the single atom Ir is connected with the cobalt iron bimetallic hydroxide via Ir—O-M bonds, with co-coordination of Ir—O and Ir—Cl on the surface.

Application Example 1

First, Electrolyzed Water Performance Testing

Figure 10:
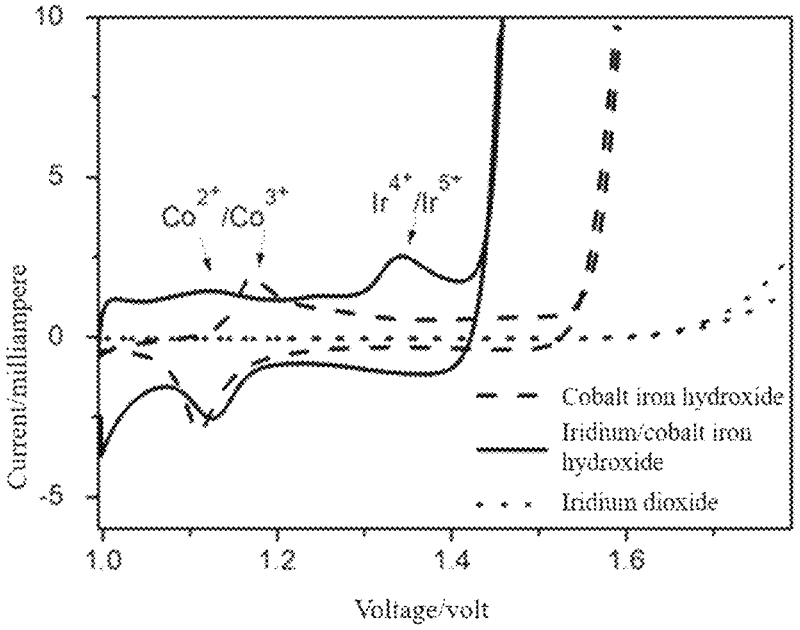
FIG. 10 is an oxygen evolution polarization curve diagram of an iridium/cobalt iron hydroxide material, a cobalt iron hydroxide material, or commercial iridium dioxide in Application Example 1 in a 6 mol/L NaOH solution.

Electrolyzed water oxygen evolution performance of the iridium/cobalt iron hydroxide of the present invention was tested using a three-electrode system: a reference electrode was a saturated calomel electrode, a counter electrode was a platinum electrode, a working electrode was the iridium/cobalt iron hydroxide material obtained in Embodiment 1, the cobalt iron hydroxide material obtained in step (1) of Embodiment 1, or commercial iridium dioxide, and testing was performed in a 6.0 M sodium hydroxide solution to obtain polarization curves as shown in FIG. 10. It may be seen from FIG. 10 that the iridium/cobalt iron hydroxide material obtained in Embodiment 1 had good electrolyzed water oxygen evolution performance (the solid line[s] in FIG. 10, with a peak potential of 1.428 V), its electrolyzed water oxygen evolution performance was better than that of the cobalt-iron bimetallic hydroxide sheet material (obtained in step (1) of Embodiment 1; the dashed line[s] in FIG. 10, with a peak potential of 1.554 V). Thus, the peak potential was decreased by 126 mV for the iridium/cobalt iron hydroxide material obtained in Embodiment 1. Moreover, the electrolyzed water oxygen evolution performance of the nanosheet material of the iridium/cobalt iron hydroxide was far superior to that of commercial iridium dioxide (the dotted line[s] in FIG. 10, with a peak potential of 1.65 V).

Figure 11:
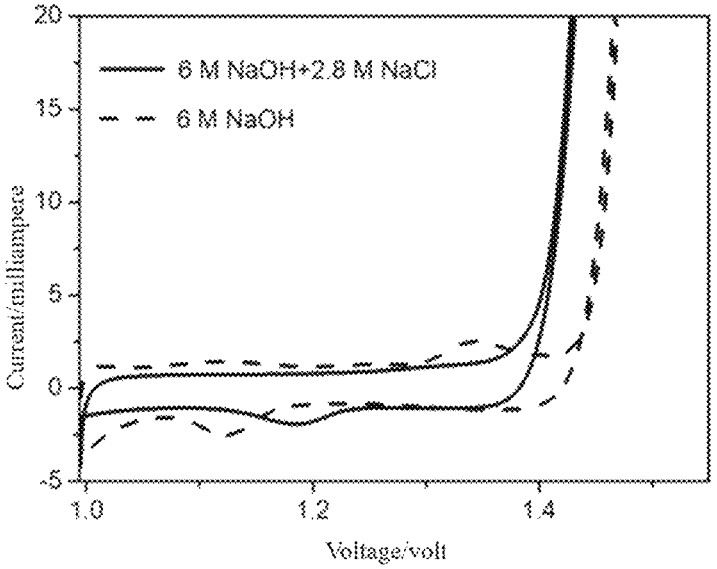
FIG. 11 is a polarization curve diagram of an iridium/cobalt iron hydroxide material in Application Example 1 in a 6 mol/L NaOH+2.8 mol/L NaCl solution and an oxygen evolution polarization curve thereof in a 6 mol/L NaOH solution.

Second, Performance Testing of Electrolytic Sodium Hydroxide+Sodium Chloride Solution Referring to the first aspect of Application Example 1, under the same three-electrode testing system, sodium chloride was added to the electrolyte solution, that is, the electrolyte solution was changed to 6.0 M sodium hydroxide and 2.8 M sodium chloride, the working electrode was the iridium/cobalt iron hydroxide material obtained in Embodiment 1, and the polarization curves obtained were as shown in FIG. 11. It may be seen from FIG. 11 that for the cobalt iron hydroxide material, the oxygen evolution performance after adding chloride ions was better than that when testing in aqueous sodium hydroxide without added chloride, and the peak potential was decreased by about 50 mV (when testing in sodium hydroxide, the peak potential was 1.428 V; and when testing in sodium hydroxide and sodium chloride, the peak potential was 1.38 V).

Figure 12:
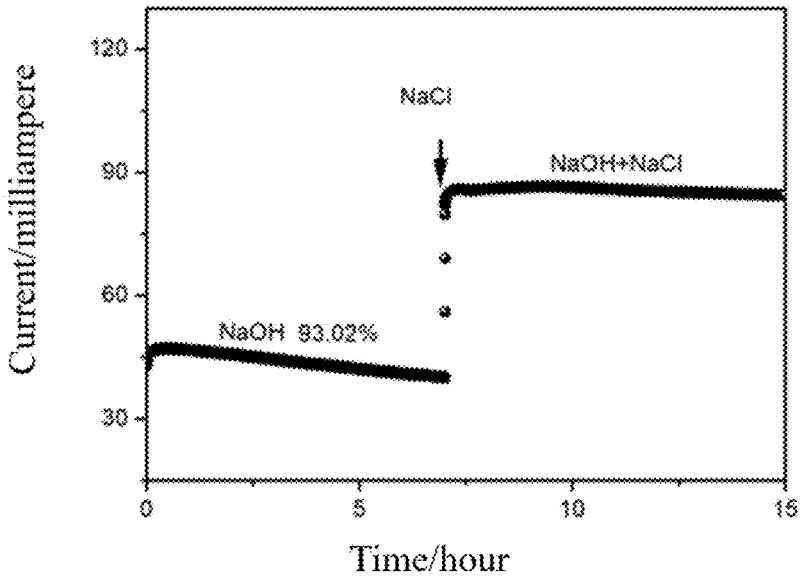
FIG. 12 is a constant voltage test curve of an iridium/cobalt iron hydroxide material in Application Example 1 with the addition of a 0.5 mol/L NaCl solution in a 1 mol/L NaOH solution neutralization test.

The iridium/cobalt iron hydroxide material obtained from Embodiment 1 was used for water electrolysis oxygen evolution stability testing. As shown in FIG. 12, it was found that the current density of the material slowly decayed (decayed to 93.02% of the initial current density within 7 hours) when tested in 6.0 M sodium hydroxide for 7 hours. By adding 2.8 M sodium chloride to the electrolyte solution, the current increased and stabilized at about 80 mA, and OER Faraday efficiency was always greater than 99%.

In addition, after the testing was completed, the electrolyte solution reacted with a starch potassium iodide solution without discoloring, and therefore no chlorine oxidation reaction occurs. It indicates that the material has good activity, stability and OER selectivity when being tested in a solution containing chloride ions.

Third, Seawater Electrolysis Oxygen Evolution Performance Testing

Oxygen evolution performance of the iridium/cobalt iron hydroxide material in Embodiment 1 was tested during electrolysis of real seawater using a three-electrode system.

Figure 13:
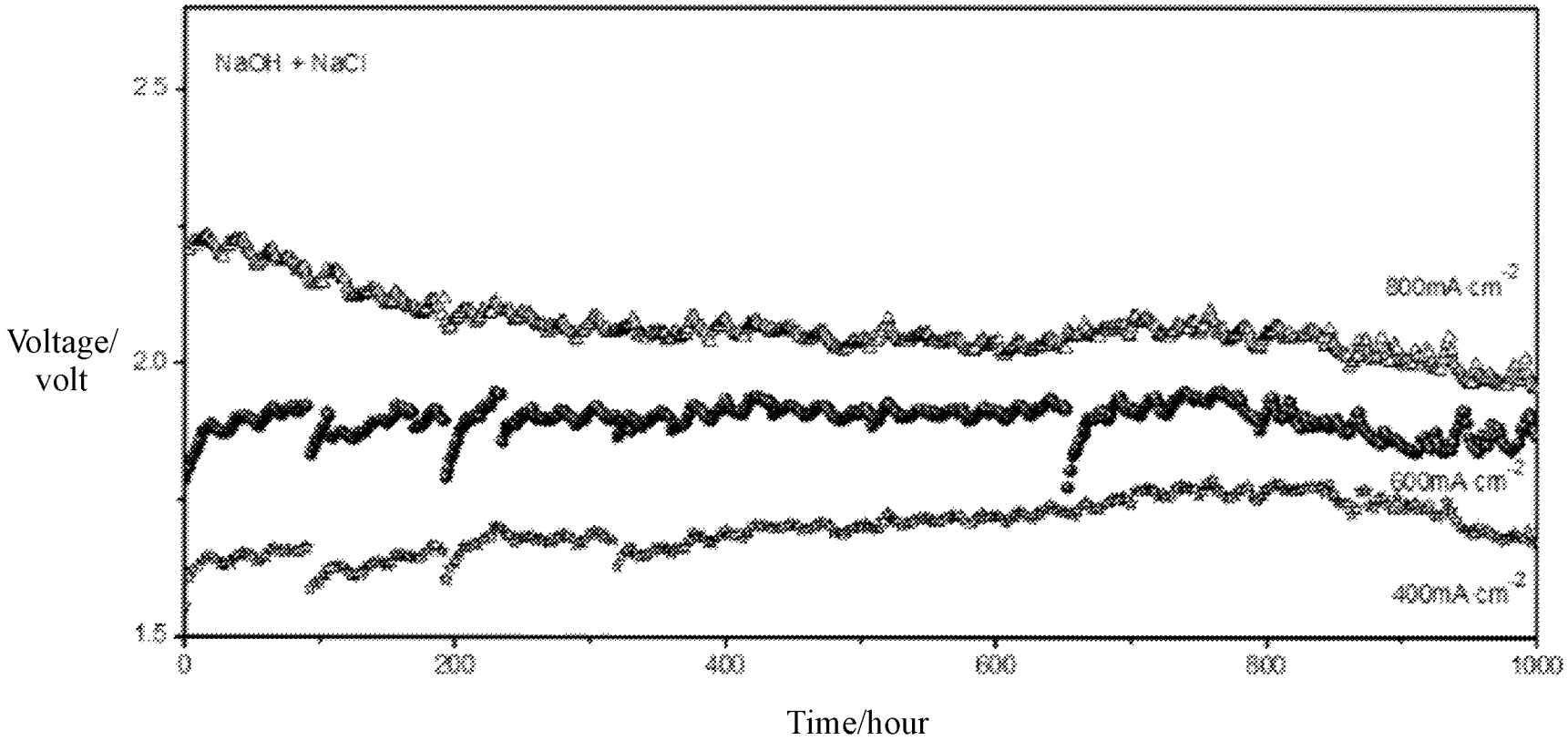
FIG. 13 is a high current stability test curve of an iridium/cobalt iron hydroxide material of Embodiment 1 in real seawater.

Referring to the first aspect of Application Example 1, the reference electrode was a saturated calomel electrode, the counter electrode was a platinum electrode, the working electrode was the iridium/cobalt iron hydroxide material obtained in Embodiment 1, and the electrolyte solution therein was changed to 100 mL of real seawater with 24 g of sodium hydroxide added thereto, filtered, and the supernatant taken as the electrolyte solution. The obtained stability curve of the material is as shown in FIG. 13. It may be seen from FIG. 13 that under a high current density condition at an industrial level (specifically 400 mA/square centimeter, 600 mA/square centimeter, or 800 mA/square centimeter), the material may remain stable for over 1000 hours, indicating that the material has industrial application prospects.

Figure 14:
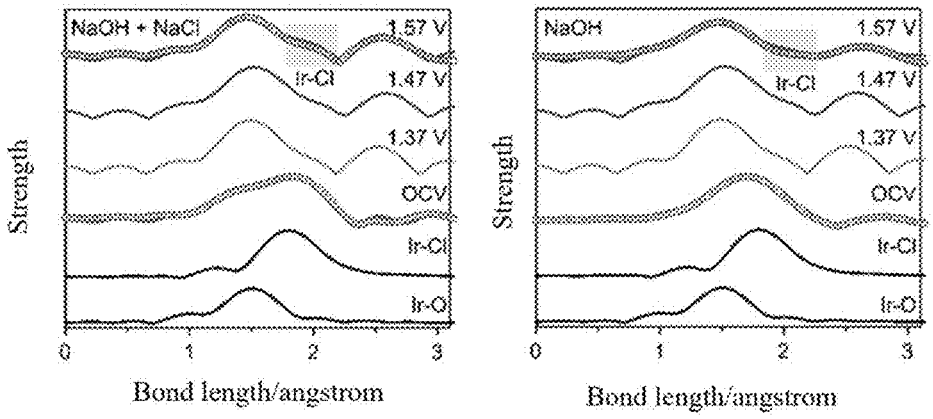
FIG. 14 is an in-situ synchrotron radiation characterization of an iridium/cobalt iron hydroxide material in Application Example 1.

Fourth, In Situ Characterization of Interaction Between the Material and Chloride Ions in an Oxygen Evolution Reaction Process A synchrotron radiation device at the Beijing Institute of High Energy Physics uses a beam line 1W1B and a fluorescence mode, and cooperates with an electrochemical workstation to collect X-ray absorption spectra of the iridium/cobalt iron hydroxide material at different voltages, as shown in FIG. 14. It may be concluded from FIG. 14 that in the oxygen evolution reaction process, chlorine in the solution was adsorbed on or coordinated to the iridium, thus regulating and controlling a local coordination structure of the single atom iridium and facilitating the oxygen evolution reaction.

Fifth, Other Halogens (Fluoride and Bromide) Also Improve the Oxygen Evolution Performance of the Noble Metal (e.g., Single Atom Dispersion)

Referring to the first aspect of Application Example 1, under the same three-electrode testing system, sodium fluoride or sodium bromide was added to the electrolyte solution. That is, the electrolyte solution was changed to 1.0 M sodium hydroxide, or 1.0 M sodium hydroxide and 0.5 M sodium fluoride, or 1.0 M sodium hydroxide and 0.5 M sodium bromide. The working electrode was the iridium/cobalt iron hydroxide material obtained in Embodiment 1, and the polarization curves obtained were as shown in FIG. 15.

Figure 15:
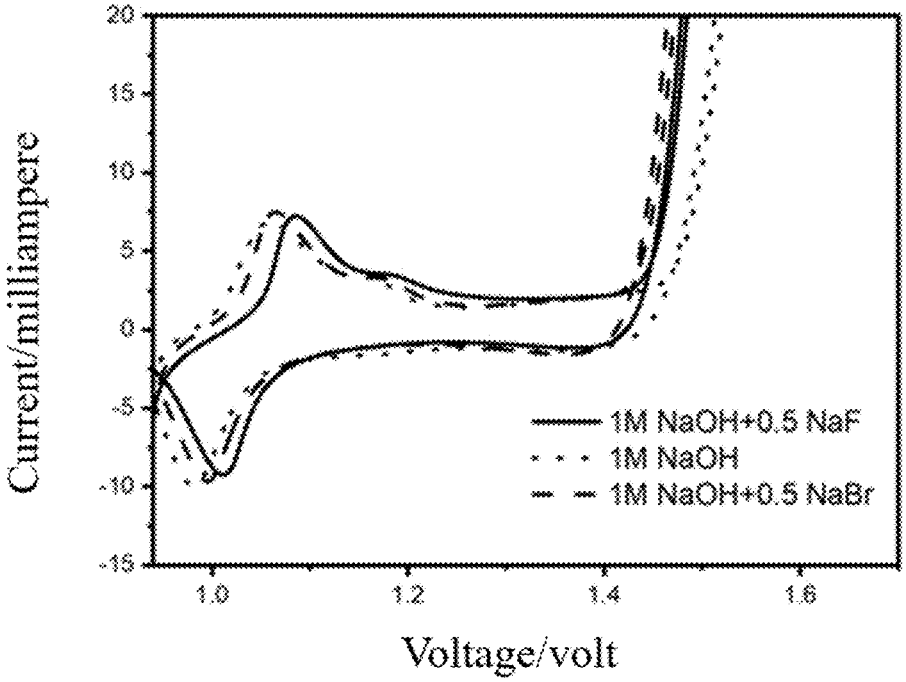
FIG. 15 is a graph of oxygen evolution polarization curves of an iridium/cobalt iron hydroxide material in Application Example 1 in NaOH+NaF, NaOH+NaBr and NaOH.

It may be concluded from FIG. 15 that adding fluoride ions to a testing solution may advance the peak potential (1.46 V) of the iridium/cobalt iron hydroxide material to 1.424 V, which is beneficial for the material to catalyze hydrolysis and oxygen evolution; and adding bromide ions to the testing solution may advance the peak potential of the iridium/cobalt iron hydroxide to 1.41 V, which is beneficial for the material to catalyze hydrolysis and oxygen evolution.

During electrolysis, fluoride or bromide ions in the electrolyte solution can coordinate to noble metal single atoms. In the material in the electrolysis process, iridium atoms simultaneously coordinate with oxygen, chlorine and fluorine; or with oxygen, chlorine and bromine.

Comparative Example 1—Chemical Deposition Method

Figure 16:
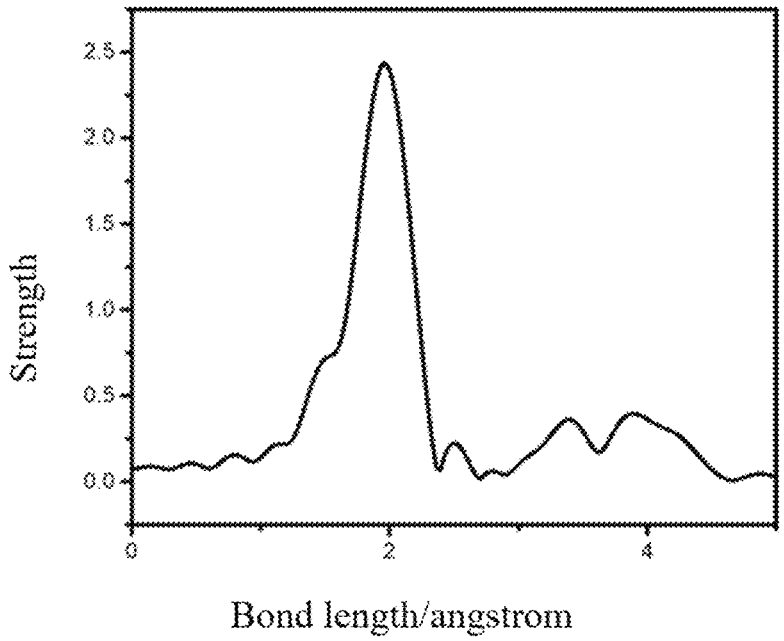
FIG. 16 is an X-ray absorption fine structure spectrum of an iridium chloride/cobalt iron hydroxide material in Comparative Example 1.

Referring to the method in Embodiment 1, in step (2), 0.16 mg of sodium hydroxide (0.2 mmol/L) and 5 mg of iridium chloride were added. Specifically, 20 mL of an iridium chloride solution was prepared from 5 mg of iridium chloride, 0.16 mg of sodium hydroxide, and deionized water. The material finally obtained is iridium chloride/cobalt iron hydroxide. Reference is made to FIG. 16 for an X-ray absorption fine structure spectrum of the obtained material. It may be concluded from FIG. 16 that the iridium in the material is coordinated to chlorine and is connected with a laminate of the cobalt iron hydroxide through Ir—O-M bonds, where M is an iron or cobalt atom.

Comparative Application Example 1

Referring to the seawater electrolysis testing method in Application Example 1, oxygen evolution performance of the iridium/cobalt iron hydroxide material in Embodiment 1 during real seawater electrolysis was tested using a three-electrode system.

Figure 17:
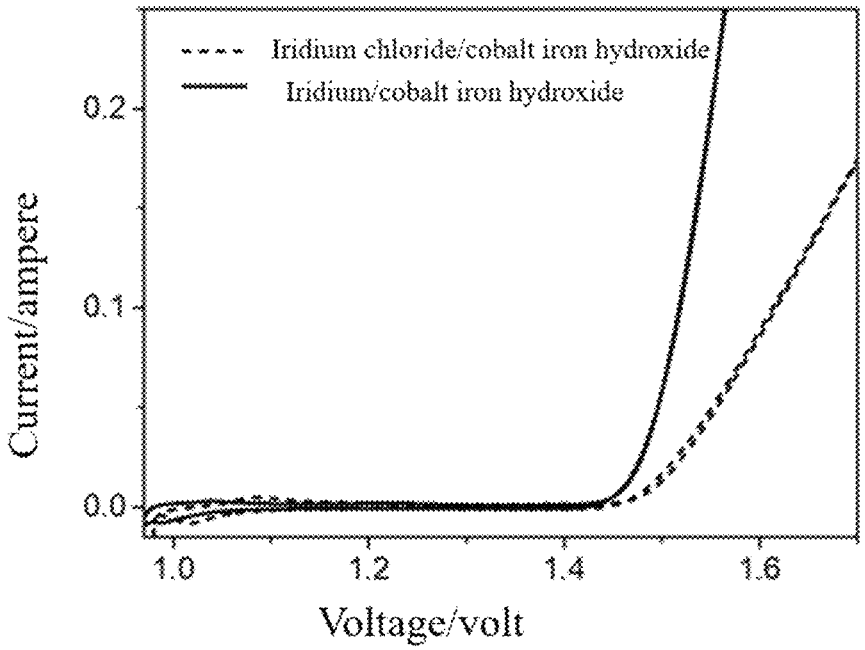
FIG. 17 is an oxygen evolution polarization curve diagram of an iridium chloride/cobalt iron hydroxide material in Comparative Example 1 in a 6 mol/L NaOH solution.

The reference electrode was a saturated calomel electrode, the counter electrode was a platinum electrode, and the working electrode was the iridium chloride/cobalt iron hydroxide (dashed line in FIG. 17) in Comparative Example 1. The electrolyte solution was 6.0 M sodium hydroxide and 2.8 M sodium chloride. Reference is made to FIG. 17 for obtained results, from which it may be concluded that when the current density reaches 10 mA/square centimeter, an overpotential of the iridium chloride/cobalt iron hydroxide is 1.441 V, which is about 15 mV higher than that of the iridium/cobalt iron hydroxide (solid line) in Embodiment 1. Therefore, when the iridium chloride/cobalt iron hydroxide in Comparative Example 1 is used for seawater electrolysis, its activity is lower than that of the iridium/cobalt iron hydroxide in Embodiment 1. The results show that the/oxygen evolution performance of the material when electrolyzing seawater is closely related to a local coordination structure of the single atoms of the noble metal, and the noble metal has the best performance when being with both a halogen and oxygen-containing functional groups.

Comparative Example 2—Chemical Deposition Method

Figure 18:
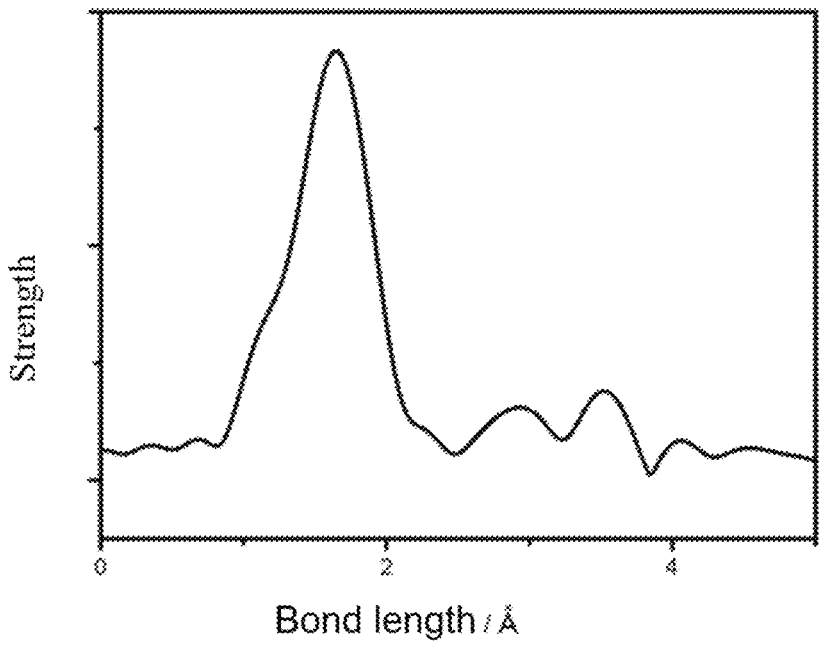
FIG. 18 is an X-ray absorption fine structure spectrum of an iridium oxygen/cobalt iron hydroxide material in Comparative Example 2.

Referring to the method in Embodiment 1, in step (2), 1000 mg of sodium hydroxide (1250 mmol/L) and 5 mg of iridium chloride were added. Specifically, 20 mL of an iridium chloride solution was prepared from 5 mg of iridium chloride, 1000 mg of sodium hydroxide, and deionized water. The material finally obtained is iridium (hydr)oxide/cobalt iron hydroxide. Reference is made to FIG. 18 for an X-ray absorption fine structure spectrum of the obtained material. It may be concluded from FIG. 18 that the iridium in the material is coordinated only to oxygen without Ir—O—Ir bonds or Ir—Ir bonds, to maintain a single atom state, and is connected with a laminate of the cobalt iron hydroxide through Ir—O-M bonds, where M is an iron or cobalt atom. The reason why the iridium coordinated only to oxygen and is free of coordination with chlorine is that excessive OH in the solution regulates and controls the coordination of the Ir precursor in a dilute solution, so that Cl is completely substituted by OH to form full oxygen coordination.

Comparative Application Example 2

Figure 19:
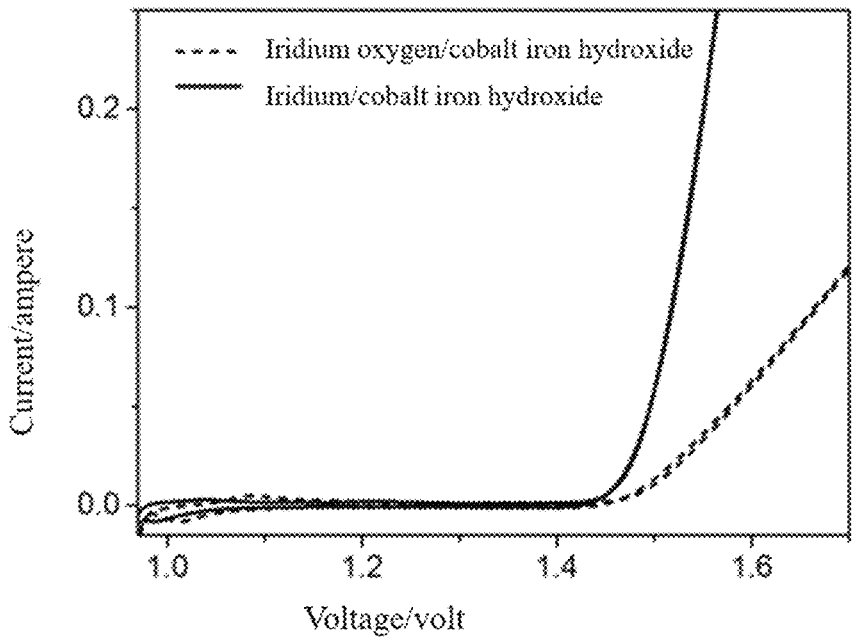
FIG. 19 is oxygen evolution polarization curve diagrams of an iridium oxygen/cobalt iron hydroxide material in Comparative Example 2 and an iridium/cobalt iron hydroxide material in Embodiment 1 in a 6 mol/L NaOH solution.

Referring to the seawater electrolysis testing method in Application Example 1, the working electrode was changed to the iridium (hydr)oxide/cobalt iron hydroxide (dashed line in FIG. 19) in Comparative Example 2. The reference electrode was a saturated calomel electrode, and the counter electrode was a platinum electrode. The electrolyte solution was changed to 6.0 M sodium hydroxide and 2.8 M sodium chloride. Reference is made to FIG. 19 for obtained results, from which it may be concluded that when the current density reaches 10 mA/square centimeter, an overpotential of the iridium oxygen/cobalt iron hydroxide is 1.455 V, which is about 15 mV higher than that of the iridium/cobalt iron hydroxide (solid line) in Embodiment 1. Therefore, when the iridium chloride/cobalt iron hydroxide in Comparative Example 1 is used for seawater electrolysis, its activity is lower than that of the iridium/cobalt iron hydroxide in Embodiment 1. The results show that the oxygen evolution performance of the material when electrolyzing seawater is closely related to a local coordination structure of the single atoms of the noble metal, and the noble metal has the best performance when coordinated with both a halogen and an oxygen-containing functional group.

Embodiment 2—Electrodeposition Method

A preparation method of a nanomaterial with noble metal single atoms dispersed on a surface of a non-noble metal substrate adopts an electrodeposition method described in the third aspect of the present invention, which is specifically as follows.

Step (1): A conductive carrier loaded with a non-noble metal substrate—foam nickel loaded with nickel iron hydroxide was prepared.

0.6 g of urea, 0.121 g of ferric nitrate, 0.174 g of nickel nitrate, 0.037 g of ammonium fluoride and deionized water were mixed to form 36 mL of a solution. The solution was poured into 40 mL of a reactor, washed foam nickel with a size of 3*4 square centimeters was placed into the solution, the solution was put into an oven, a reaction temperature was 100° C., and the hydrothermal reaction time was 12 hours. Crystallization, washing, and drying were performed to obtain the foam nickel loaded with the nickel iron hydroxide, namely, a nickel iron hydroxide array material.

Step (2): 50 mL of an electrolyte solution was prepared from 2.0 g of sodium hydroxide (1 mol/L) and 2.98 mg of iridium chloride (0.1 mmol/L) in an appropriate amount of deionized water.

Step (3): Electrodeposition was performed. A three-electrode system was used in the electrolyte solution obtained in step (2). The foam nickel loaded with the nickel iron hydroxide obtained in step (1) was the working electrode, a saturated calomel electrode was the reference electrode, a carbon rod was the counter electrode, linear voltammetry was used, and parameters included a voltage range from −1.2 V to −0.5 V, a reverse scanning direction, a scanning speed of 0.005 V/s, and the number of cycles was 10. The material was obtained after electrodeposition.

Step (4): The material obtained in step (3) was washed with deionized water and ethyl alcohol three times each, and dried in a vacuum drying oven at 60° C., so as to obtain an iridium/nickel iron hydroxide array material, that is, iridium single atoms were dispersed on the surface of the nickel iron hydroxide, and the foam nickel was used as a carrier.

Figure 20:
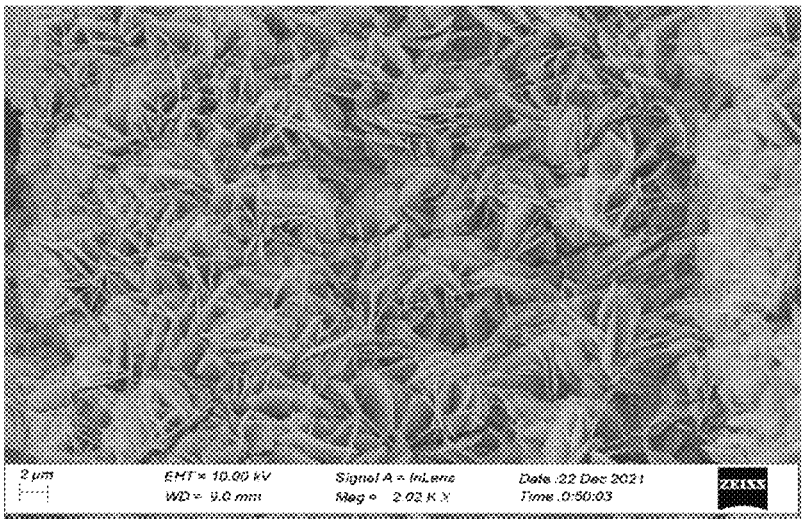
FIG. 20 is a scanning electron microscopy (SEM) image of an iridium/nickel iron hydroxide array material in Embodiment 2.

Reference is made to FIG. 20 for a scanning electron microscopy image of the obtained iridium/nickel iron hydroxide array material. It may be seen from the FIG. 20 that an iridium/nickel iron hydroxide array is composed of hexagonal nanosheets with a diameter of 50-100 nanometers and a thickness of 5-10 nanometers, without obvious particles.

Application Example 2

Figure 21:
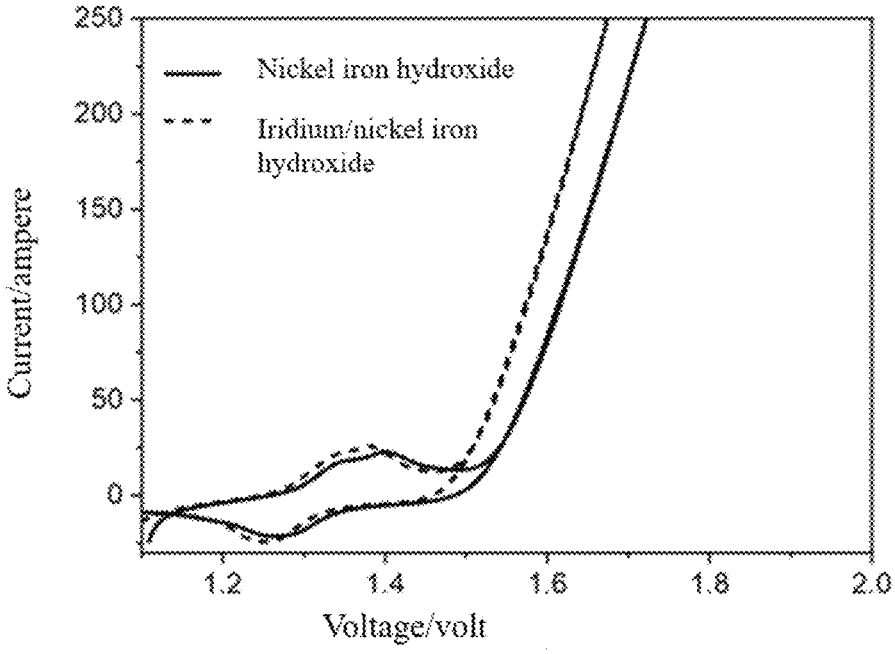
FIG. 21 is an oxygen evolution polarization curve diagram of an iridium/nickel iron hydroxide array material in Application Example 2 or a nickel iron hydroxide array material obtained in step (1) of Embodiment 2 in a 6 mol/L NaOH+2.8 mol/L NaCl solution.

Referring to the third aspect (oxygen evolution performance testing while electrolyzing seawater) of Application Example 1, testing was performed under the same three-electrode testing system: the reference electrode was a saturated calomel electrode, the counter electrode was a platinum electrode, the working electrode was the iridium/nickel iron hydroxide array material obtained in Embodiment 2 or the nickel iron hydroxide array material obtained from step (1) in Embodiment 2, and the electrolyte solution therein was changed to: 100 mL of real seawater was taken, 24 g of sodium hydroxide was added, filtering was performed, and the supernatant was taken as the electrolyte solution. Reference is made to FIG. 21 for anodic catalytic performance of the iridium/nickel iron hydroxide array material obtained in Embodiment 2 while electrolyzing seawater, and the overpotential at a current density of 100 mA/square centimeter was 1.564 V, which was 50 mV smaller than that of the nickel iron hydroxide array material. This indicates that the iridium/nickel iron hydroxide array material also has a promoting effect on seawater electrolysis.

Embodiment 3—Chemical Deposition Method

A preparation method of a nanomaterial (rhodium/cobalt hydroxide material) with noble metal single atoms dispersed on a surface of a non-noble metal substrate adopts a chemical deposition method described in the second aspect of the present invention, which is specifically as follows.

Referring to the method in Embodiment 1, when preparing 40 mL of the salt solution B in step (1), the mass of cobalt nitrate was changed to 0.436 g, without adding iron nitrate, and the alkali liquor was changed to 0.48 g of sodium hydroxide. Finally, a cobalt hydroxide material was obtained in step (1).

Preparation of 1 mL of the dilute iridium chloride solution in step (2) was changed to preparation of a dilute rhodium chloride solution using 41.2 mg of rhodium chloride (200 mmol/L) and 40 mg of sodium hydroxide (1000 mmol/L).

The reaction conditions included stirring at 10° C. for 120 hours. The other reaction conditions remain unchanged, referring to the method in Embodiment 1. Finally, a rhodium/cobalt hydroxide material was obtained in step (2).

Figure 22:
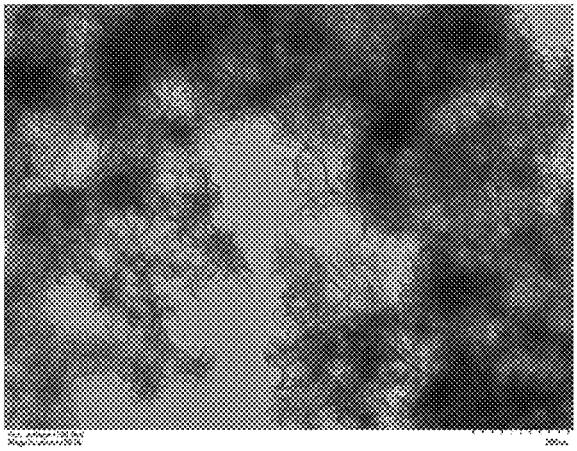
FIG. 22 is a transmission electron microscopy (TEM) image of a rhodium/cobalt hydroxide material in Embodiment 3.

Reference is made to FIG. 22 for a transmission electron microscopy image of the rhodium/cobalt hydroxide material, and it may be seen that the material morphology is a flower shape composed of nanosheets with a diameter of 100-200 nanometers, and the surface is smooth without particles.

Application Example 3

Testing was performed under a three-electrode testing system. The reference electrode was a saturated calomel electrode, the counter electrode was a platinum electrode, and the working electrode was the rhodium/cobalt hydroxide material obtained in Embodiment 3 or the cobalt hydroxide material obtained from step (1) in Embodiment 3.

Figure 23:
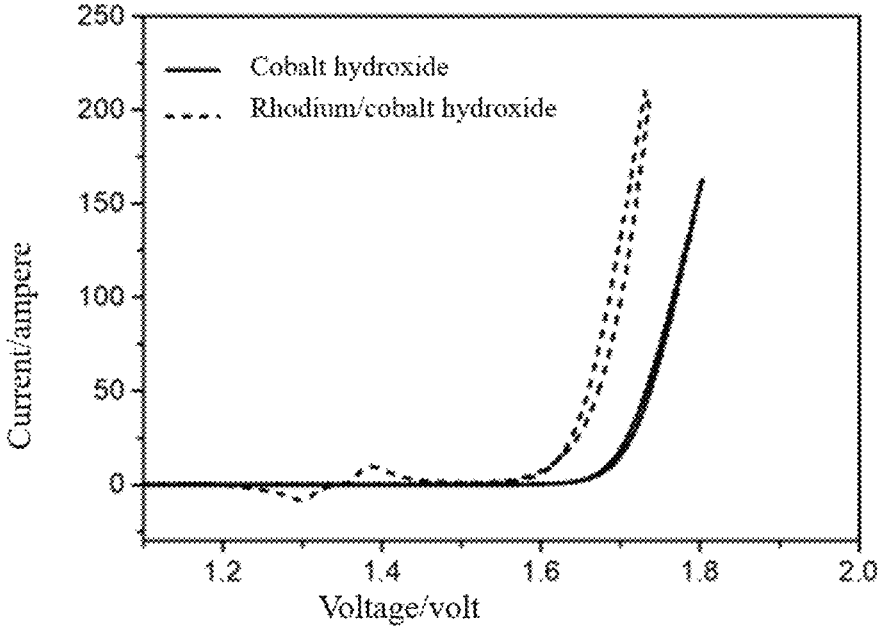
FIG. 23 is an oxygen evolution polarization curve diagram of a rhodium/cobalt hydroxide material or a cobalt hydroxide material in Application Example 3 in a 1 mol/L NaOH solution.

When the electrolyte solution was 1.0 M sodium hydroxide, reference is made to FIG. 23 for polarization curves of the above two materials. It may be seen from FIG. 23 that compared to the cobalt hydroxide material, the oxygen evolution performance of the rhodium/cobalt hydroxide material is improved after single atom loading of rhodium. Compared to the cobalt hydroxide material, the peak potential of the rhodium/cobalt hydroxide material is 1.575 V, and the peak potential is decreased by 95 mV compared to the cobalt hydroxide material alone.

Figure 24:
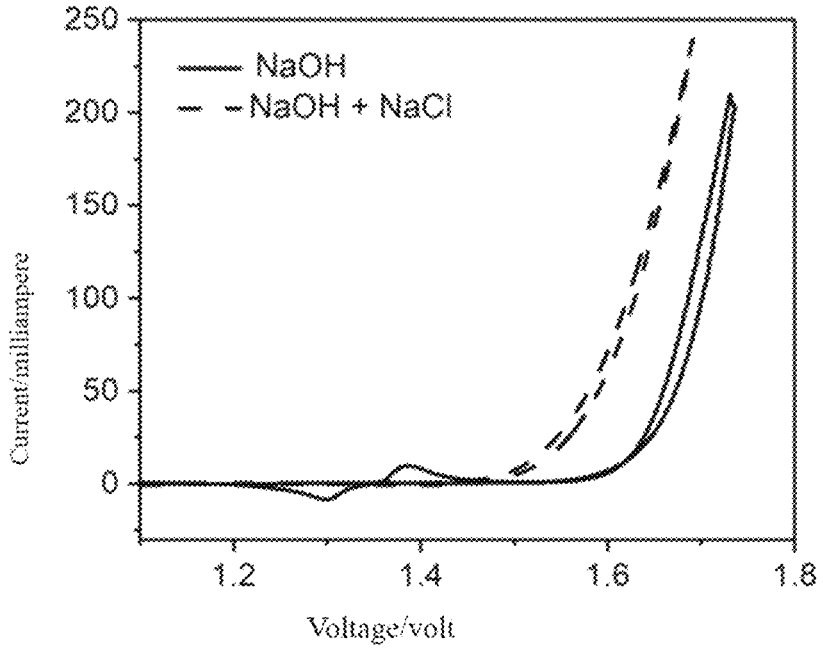
FIG. 24 is an oxygen evolution polarization curve diagram of a rhodium/cobalt hydroxide material in Application Example 3 in a 1 mol/L NaOH+0.5 mol/L NaCl solution or a 1 mol/L NaOH solution.

When the electrolyte solution was a solution of 1.0 M sodium hydroxide+0.5 M sodium chloride, the peak potential of the rhodium/cobalt hydroxide material was 1.473 V, which was 102 mV lower than that in aqueous sodium hydroxide, as shown in FIG. 24. This result indicates that chloride ions in the electrolyte solution (seawater) interact with rhodium atoms, enhancing the oxygen evolution activity of the rhodium, and facilitating the progress of the reaction.

Embodiment 4—Chemical Deposition Method

A preparation method of a nanomaterial (rhodium/nickel iron hydroxide) with noble metal single atoms dispersed on a surface of a non-noble metal substrate adopts a chemical deposition method described in the second aspect of the present invention, which is specifically as follows.

Referring to the method in Embodiment 1, when preparing 40 mL of the salt solution B in step (1), the mass of nickel nitrate was changed to 0.436 g, the mass of iron nitrate was changed to 0.202 g, and the alkali liquor was changed to 0.14 g of sodium hydroxide and 0.053 g of sodium carbonate.

Preparation of 100 mL of the dilute iridium chloride solution in step (2) was changed to preparation of a dilute rhodium chloride solution (0.001 mmol/L) using 0.03 mg of rhodium chloride (0.001 mmol/L) and 40 mg of sodium hydroxide.

The conditions were 10° C., and 120 hours.

Application Example 4

Testing was performed using a three-electrode testing system. The reference electrode was a saturated calomel electrode, the counter electrode was a platinum electrode, and the working electrode was the rhodium/nickel iron hydroxide material obtained in Embodiment 4.

Figure 25:
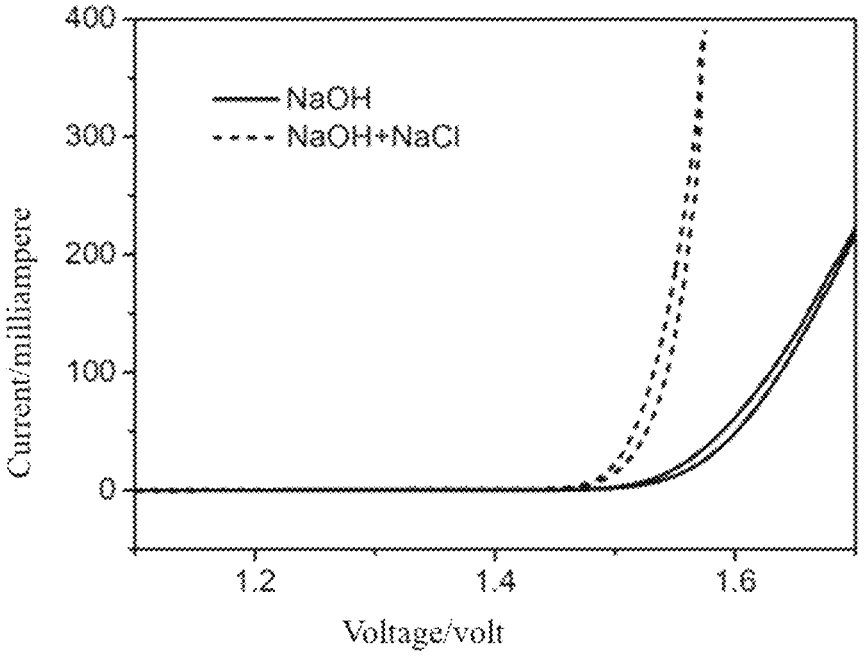
FIG. 25 is oxygen evolution polarization curve diagrams of a rhodium/nickel iron hydroxide material in Application Example 4 in a 1 mol/L NaOH+0.5 mol/L NaCl solution and a 1 mol/L NaOH solution.

When the electrolyte solution was a solution of 1.0 M sodium hydroxide+0.5 M sodium chloride, the peak potential of the rhodium/nickel iron hydroxide material was 1.464 V, which was 57 mV lower than that in aqueous sodium hydroxide, as shown in FIG. 25. This result indicates that chloride ions in the electrolyte solution (seawater) interact with the rhodium atoms, enhancing an oxygen evolution activity of the rhodium, and facilitating the progress of the reaction.

Embodiment 5—Electrodeposition Method

A preparation method of a nanomaterial with noble metal single atoms dispersed on a surface of a non-noble metal substrate adopts an electrodeposition method described in the third aspect of the present invention, which is specifically as follows.

Step (1): a nickel iron hydroxide array was prepared.

0.6 g of urea, 0.291 g of nickel nitrate, 0.133 g of ferric nitrate, 0.037 g of ammonium fluoride and deionized water were prepared into 36 mL of a solution, the solution was poured into 40 mL of a reactor, washed foam nickel iron with a size of 3*4 $cm^2$ was placed into the solution, the solution was put into an oven, a hydrothermal reaction temperature was 100° C., and the time was 12 hours. Crystallization was performed, and the obtained material was washed with water and ethyl alcohol three times each, and dried in vacuum at 60° C. for 10 hours to obtain foam nickel iron loaded with nickel iron hydroxide (the nickel iron hydroxide array).

Step (2): The obtained nickel iron hydroxide array was placed in a thiourea-benzyl alcohol solution (13.7 mg of thiourea, 36 mL) and heated at 120° C. for 5 hours to perform sulfuration. The obtained material was a nickel-iron sulfide material, which is used for electrodeposition of single atoms.

Step (3): 50 mL of an electrolyte solution was prepared by mixing 2.0 g of sodium hydroxide and 1.8 mg of chloroauric acid with an appropriate amount of water.

Step (4): Electrodeposition was performed. A three-electrode system was used in the electrolyte solution obtained in step (3), the nickel-iron sulfide material obtained in step (2) was the working electrode, a saturated calomel electrode was the reference electrode, a carbon rod was the counter electrode, linear voltammetry was used, and parameters included a voltage range from 0 V to 1.2 V, a reverse scanning direction, a scanning speed of 0.005 V/s, and the number of cycles was 10. The obtained material was washed with water and ethyl alcohol three times each, and dried in vacuum at 60° C. for 10 hours to obtain a gold/nickel-iron sulfide material.

Application Example 5

Oxygen evolution performance of the material obtained in the present invention was also tested during seawater electrolysis using a three-electrode system. The reference electrode was a saturated calomel electrode, the counter electrode was a platinum electrode, and the working electrode was the gold/nickel-iron sulfide material obtained in Embodiment 5, or the nickel-iron sulfide material obtained from step (2) in Embodiment 5. The electrolyte solution was a mixed solution of 6.0 M sodium hydroxide and 2.8 M sodium chloride, and the polarization curves obtained were as shown in FIG. 26.

Figure 26:
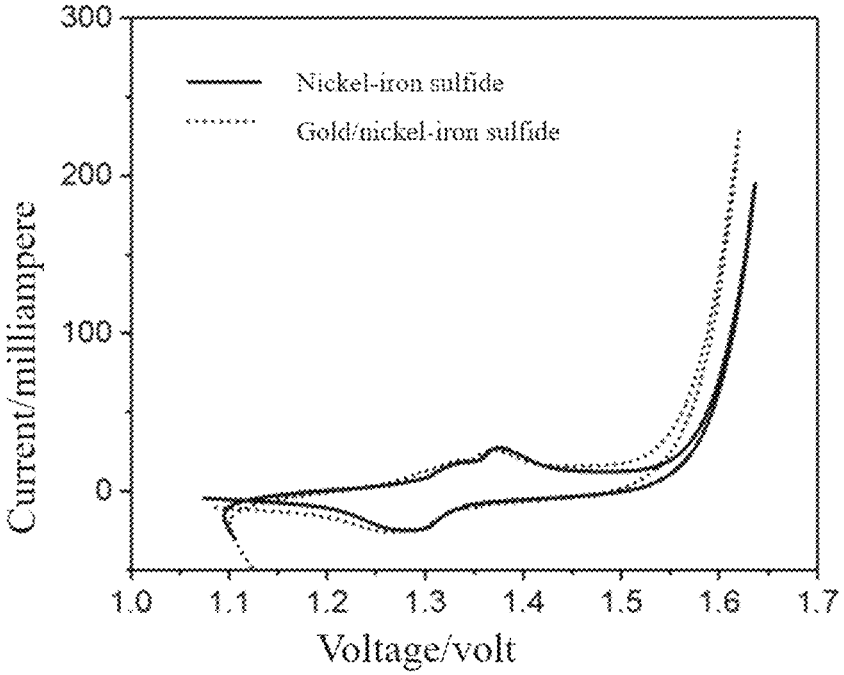
FIG. 26 is a graph of oxygen evolution polarization curve diagrams of a gold/nickel-iron sulfide material and a nickel iron sulfide material in Application Example 5 in a 6 mol/L NaOH+2.8 mol/L NaCl solution.

It may be seen from FIG. 25 that the obtained gold/nickel-iron sulfide material has good oxygen evolution performance (the dashed line curve[s] in FIG. 26). Its oxygen evolution performance is better than that of a nickel-iron sulfide sheet material (the solid curve[s] in FIG. 26), and a potential at a current density of 200 mA/square centimeter is 1.47 V, which is 30 mV smaller than that of a nickel-cobalt-iron sulfide electrode.

Comparative Example 3—Electrodeposition Method

Figure 27:
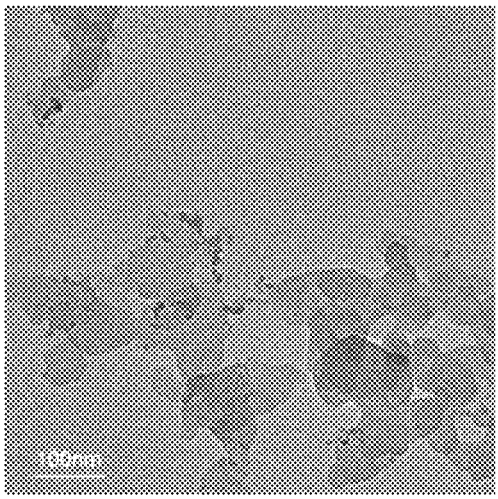
FIG. 27 is a transmission electron microscopy image of a gold particle/nickel-iron sulfide material in Comparative Example 3.

Referring to the method in Embodiment 5, the voltage range from 0 V to 1.2 V in step (4) was changed to −2.1 V to −0.2 V, and the obtained material is a gold particle/nickel-iron sulfide material. FIG. 27 is a transmission electron microscopy image of the material, and it may be seen from FIG. 27 that due to the excessive large voltage range, gold forms particles on the surface of the substrate without forming single atom distribution.

Comparative Application Example 3

Figure 28:
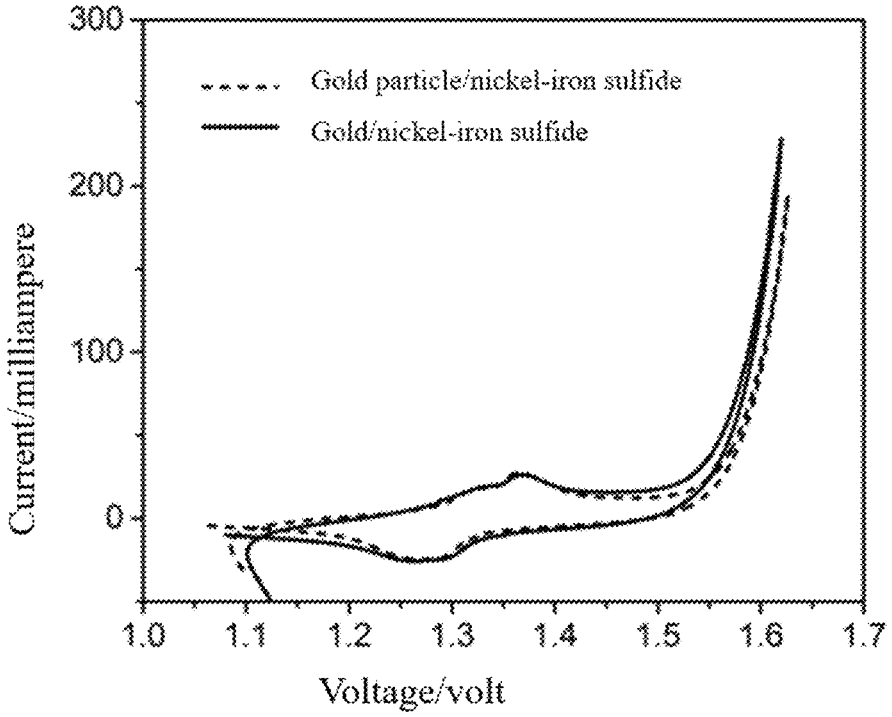
FIG. 28 is an oxygen evolution polarization curve diagram of a gold particle/nickel-iron sulfide material in Comparative Application Example 3 and a gold/nickel-iron sulfide material in Embodiment 5 in a 6 mol/L NaOH+2.8 mol/L NaCl solution.

Oxygen evolution performance of the material obtained in the present invention was also tested during seawater electrolysis using a three-electrode system: the reference electrode was a saturated calomel electrode, the counter electrode was a platinum electrode, an electrolyte solution was a mixed solution of 6.0 M sodium hydroxide and 2.8 M sodium chloride, and the working electrode was the gold particle/nickel-iron sulfide material (dashed line[s] in FIG. 28) in Comparative Example 3, or the gold/nickel-iron sulfide material in Embodiment 5. Reference is made to FIG. 28 for obtained results, from which it may be concluded that when the current density reaches 10 mA/square centimeter, the overpotential of the gold particle/nickel-iron sulfide material is 1.441 V, which is about 15 mV higher than that of the gold/nickel-iron sulfide material (solid line[s]) in Embodiment 5. Therefore, when the gold particle/nickel-iron sulfide material in Comparative Example 3 is used for seawater electrolysis, its activity is lower than that of the gold/nickel-iron sulfide material in Embodiment 5. The result shows that the performance during electrolysis of water and seawater is closely related to the catalyst structure, and a single atom catalyst has the best performance.

Embodiment 6—Electrodeposition Method

Referring to the method in Embodiment 5, 0.2 g of cobalt nitrate was added to the raw material in step (1), foam nickel was changed to carbon paper, and 1.8 mg of chloroauric acid in step (3) was changed to 1.3 mg of chloroplatinic acid to obtain a platinum/nickel-cobalt-iron sulfide material.

Figure 29:
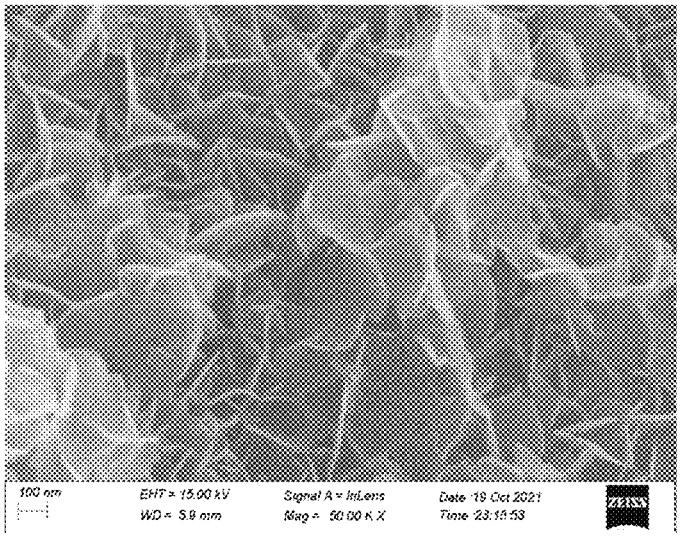
FIG. 29 is a scanning electron microscopy image of a platinum/nickel-cobalt-iron sulfide material in Embodiment 6.

Reference is made to FIG. 29 for a scanning electron microscopy (SEM) image of the obtained material, which has a morphology similar to that of the gold/nickel-iron sulfide material, with a smooth surface without obvious particles, preliminarily indicating a high dispersion of gold.

Application Example 6

Oxygen evolution performance of the material obtained in the present invention was also tested while electrolyzing seawater using a three-electrode system. The reference electrode was a saturated calomel electrode, the counter electrode was a platinum electrode, the working electrode was the platinum/nickel-cobalt-iron sulfide material obtained in Embodiment 6, and the electrolyte solution was respectively a 6.0 M sodium hydroxide solution or a mixed solution of 6.0 M sodium hydroxide and 2.8 M sodium chloride, so as to obtain polarization curves as shown in FIG. 30.

Figure 30:
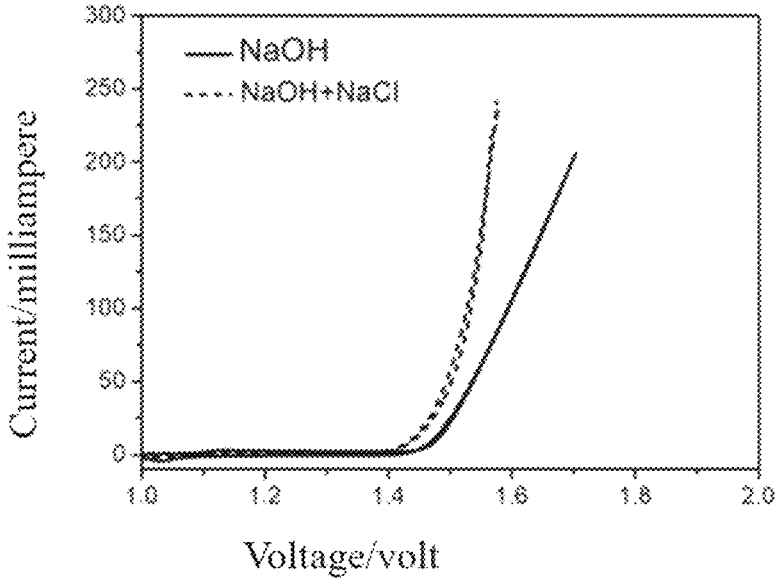
FIG. 30 is a graph of oxygen evolution polarization curves of a platinum/nickel-cobalt-iron sulfide material in Application Example 6 in 6 mol/L NaOH+2.8 mol/L NaCl (dashed line) and 6 mol/L NaOH (solid line) solutions.

It may be concluded from the polarization curves that the platinum/nickel-cobalt-iron sulfide material has a potential of 1.444 V at a current density of 100 mA/square centimeter in simulated seawater (the mixed solution of 6.0 M sodium hydroxide and 2.8 M sodium chloride, the dashed-line curve[s] in FIG. 30). Electrolysis was performed in alkaline deionized water (6.0 M sodium hydroxide, the solid-line curve[s] in FIG. 30), and the potential at a current density of 100 mA/square centimeter was 1.446 V.

Figure 31:
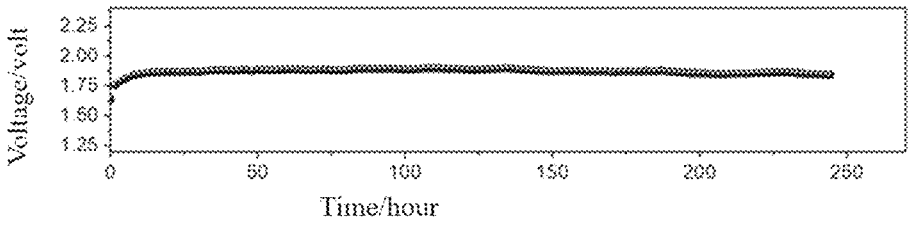
FIG. 31 is a stability curve of a platinum/nickel-cobalt-iron sulfide material in Application Example 6 at a current density of 100 milliamperes/square centimeter in 6 mol/L NaOH+2.8 mol/L NaCl.

This indicates that the single atom loading of platinum effectively improves the performance while electrolyzing seawater. Reference is made to FIG. 31 for a stability curve at a current density of 100 mA per square centimeter, a testing time of up to 250 hours, and voltage changes that were essentially negligible.

Embodiment 7—Electrodeposition Method

Referring to the method in Embodiment 5, 0.291 g of nickel nitrate and 0.133 g of ferric nitrate in step (1) was changed to 0.291 g of cobalt nitrate, 0.182 g of nickel nitrate, 0.202 g of ferric nitrate, 0.189 g of zinc nitrate and 0.115 g of aluminum nitrate, the foam nickel was changed to a carbon cloth, and 1.8 mg of chloroauric acid in step (3) was changed to 1.7 mg of palladium chloride, so as to finally obtain a palladium/nickel-cobalt-zinc-iron-aluminum sulfide material.

Application Example 7

Figure 32:
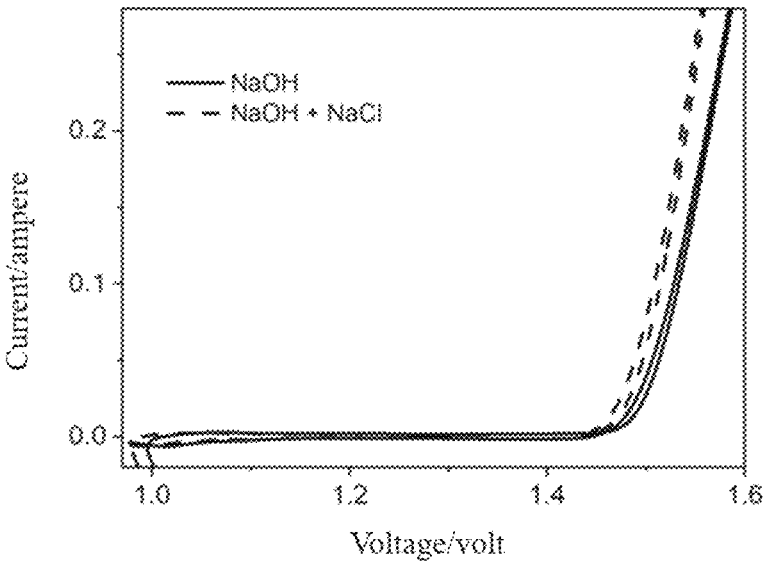
FIG. 32 is a graph of oxygen evolution polarization curves of a palladium/nickel-cobalt-zinc-iron-aluminum sulfide material in Application Example 7 in 6 mol/L NaOH+2.8 mol/L NaCl (dashed line) and 6 mol/L NaOH (solid line) solutions.

Oxygen evolution performance of the material obtained in the present invention was also tested while electrolyzing seawater using a three-electrode system. The reference electrode was a saturated calomel electrode, the counter electrode was a platinum electrode, the working electrode was the palladium/nickel-cobalt-zinc-iron-aluminum sulfide material obtained in Embodiment 7, and the electrolyte solution was respectively a 6.0 M sodium hydroxide solution and a mixed solution of 6.0 M sodium hydroxide and 2.8 M sodium chloride, so as to obtain polarization curves as shown in FIG. 32. It may be concluded from the polarization curves that the peak potential of the palladium/nickel-cobalt-zinc-iron-aluminum sulfide material is 1.472 V in alkaline deionized water (6.0 M sodium hydroxide), and the peak potential of the palladium/nickel-cobalt-zinc-iron-aluminum sulfide material is 1.45 V in simulated seawater (the mixed solution of 6.0 M sodium hydroxide and 2.8 M sodium chloride, the dashed-line curve[s] in FIG. 32). This indicates that in the simulated seawater, the peak potential of palladium/nickel-cobalt-zinc-iron-aluminum sulfide is earlier, and chlorine in the solution has a promoting effect on a catalytic activity of oxygen evolution while electrolyzing seawater.

Embodiment 8—Electrodeposition Method

A preparation method of a nanomaterial with noble metal single atoms dispersed on a surface of a non-noble metal substrate adopts an electrodeposition method described in the third aspect of the present invention, which is specifically as follows.

Step (1): A nickel iron vanadium hydroxide array was prepared. 0.6 g of urea, 0.291 g of cobalt nitrate, 0.404 g of nickel nitrate, 0.015 g of vanadium chloride and water were mixed to obtain 30 mL of a solution. The solution was poured into 50 mL of a reactor, washed foam nickel cobalt with a size of 3*4 $cm^2$ was placed into the solution, the reactor was put into an oven, the reaction temperature was 120° C., and the reaction time was 12 hours. The obtained material was washed with water and ethyl alcohol three times each, and dried in vacuum at 60° C. for 10 hours to obtain the nickel iron vanadium hydroxide array.

Step (2): The nickel iron vanadium hydroxide array obtained in step (1) and 500 mg of sodium hypophosphite were placed together in a tube furnace, heated up to 300° C., and subjected to heat preservation for 2 hours, to obtain a nickel-iron-vanadium phosphide (or phosphate) material. The obtained material was used for electrodeposition of single atoms.

Step (3): 50 mL of an electrolyte solution was prepared from 2.8 g of potassium hydroxide, 5.1 mg of ruthenium chloride, and water.

Step (4): Electrodeposition was performed using a three-electrode system in the electrolyte solution obtained in step (3). The array electrode obtained in step (2) was the working electrode, a saturated calomel electrode was the reference electrode, a carbon rod was the counter electrode, linear voltammetry was used, and parameters included a voltage range from 0 V to 1 V, a forward scanning direction, a scanning speed of 0.005 V/s, and the number of cycles was 20. The obtained material was washed with water and ethyl alcohol three times each, and dried in vacuum at 60° C. for 10 hours to obtain a ruthenium/nickel-iron-vanadium phosphide material.

Figure 33:
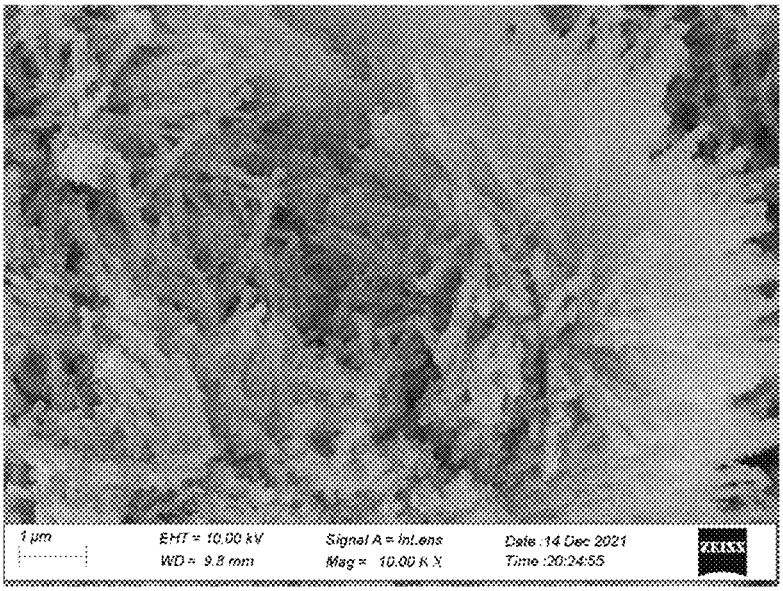
FIG. 33 is a scanning electron microscopy image of a ruthenium/nickel-iron-vanadium phosphide material in Embodiment 8.
Figure 34:
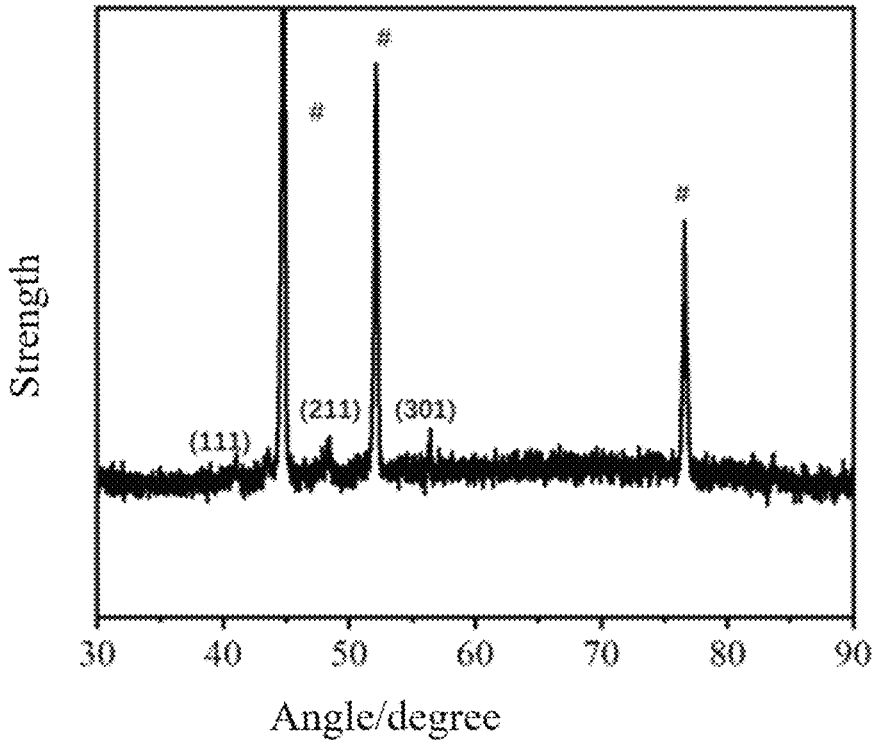
FIG. 34 is an X-ray diffraction spectrum of a ruthenium/nickel-iron-vanadium phosphide material in Embodiment 8.

Reference is made to FIG. 33 for a scanning electron microscopy (SEM) image of the obtained material. The ruthenium/nickel-iron-vanadium phosphide material was a nano array with a smooth surface grown on the foam nickel carrier, and the nano array was in a needle shape or in a flower shape composed of a plurality of nano needles. The scale of the nano needles was a width in a range from 50 nanometers to 100 nanometers, and a length in a range from 3 micrometers to 5 micrometers. Reference is made to FIG. 34 for an XRD spectrum of the obtained material, which is consistent with a diffraction peak of nickel-iron-vanadium phosphide, indicating that the noble metal ruthenium was not crystallized separately into metal or metal oxide particles, and ruthenium was in a single atom dispersion state.

Application Example 8

Figure 35:
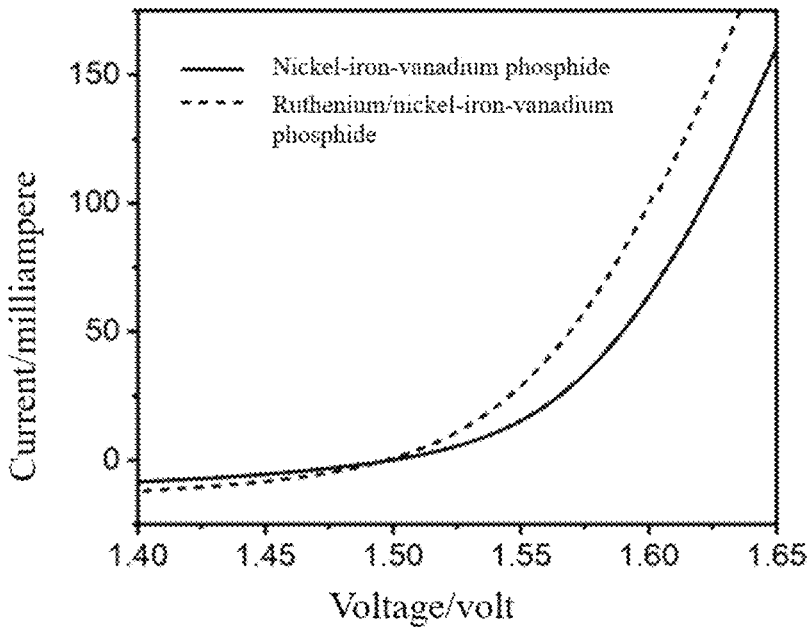
FIG. 35 is a graph of oxygen evolution polarization curve diagrams of a ruthenium/nickel-iron-vanadium phosphide material (dashed line) and a nickel-iron-vanadium phosphide material (solid line) in Embodiment 8 in a 1 mol/L NaOH+0.5 mol/L NaCl (dashed line) solution.

Oxygen evolution performance of the material in Embodiment 8 was tested while electrolyzing seawater using a three-electrode system. The reference electrode was a saturated calomel electrode, the counter electrode was a platinum electrode, the working electrode was the ruthenium/nickel-iron-vanadium phosphide material obtained in Embodiment 8 or the nickel-iron-vanadium phosphide material obtained in step (2), and testing was performed in a mixed solution of 1.0 M sodium hydroxide and 0.5 M sodium chloride, so as to obtain polarization curves as shown in FIG. 35. It may be seen from FIG. 35 that the potential of the ruthenium/nickel-iron-vanadium phosphide material at a current of 10 mA was 1.473 V, and the potential of the nickel-iron-vanadium phosphide material at a current of 10 mA was 1.535 V. Therefore, the obtained ruthenium/nickel-iron-vanadium phosphide material has good oxygen evolution performance (the dashed line in FIG. 35), and its oxygen evolution performance is better than that of the nickel-iron-vanadium phosphide material (the solid line in FIG. 35). This indicates that a ruthenium single atom dispersion effectively enhances the oxygen evolution performance while electrolyzing seawater.

Embodiment 9—Electrodeposition Method

Referring to the method in Embodiment 5, 0.291 g of nickel nitrate, and 0.133 g of ferric nitrate in step (1) were changed to 0.12 g of ferric nitrate, 0.108 g of nickel nitrate and 0.015 g of manganese sulfate, foam nickel iron was changed to foam nickel cobalt, and 1.8 mg of chloroauric acid in step (3) was changed to 3.4 mg of chloroauric acid, so as to obtain a gold/nickel-iron-manganese phosphide (or phosphate) material.

Application Example 9

Oxygen evolution performance of the material in Embodiment 9 was tested while electrolyzing seawater using a three-electrode system. The reference electrode was a saturated calomel electrode, the counter electrode was a platinum electrode, the working electrode was the gold/nickel-iron-manganese phosphide material prepared in Embodiment 9, and testing was respectively performed in a mixed solution of 1.0 M sodium hydroxide and 0.5 M sodium chloride, or a 1.0 M sodium hydroxide solution, so as to obtain polarization curves as shown in FIG. 36.

Figure 36:
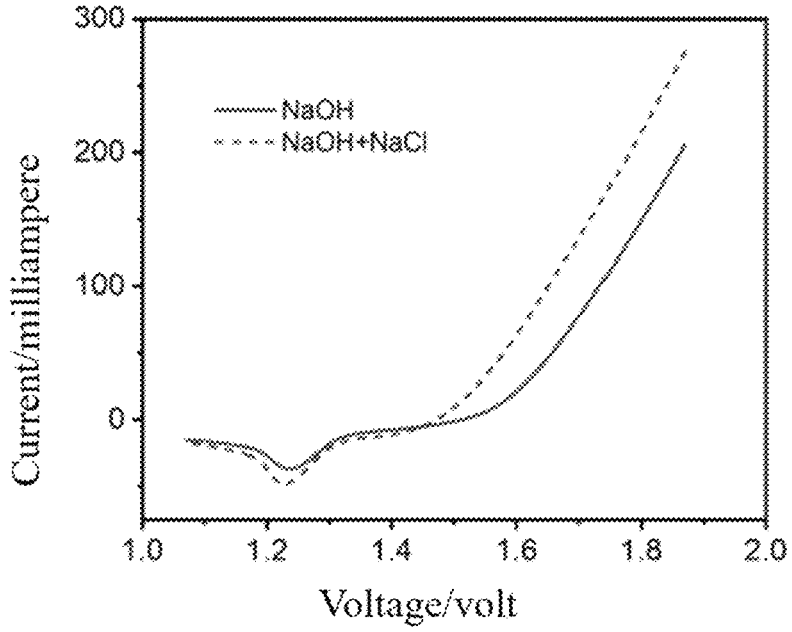
FIG. 36 is a graph of oxygen evolution polarization curves of a gold/nickel-iron-manganese phosphide material in Embodiment 9 in 1 mol/L NaOH+0.5 mol/L NaCl (dashed line) and 1 mol/L NaOH (solid line) solutions.

It may be seen from FIG. 36 that the gold/nickel-iron-manganese phosphide material has a potential of 1.46 V at a current of 10 mA in the mixed solution of 1.0 M sodium hydroxide and 0.5 M sodium chloride, and has a potential of 1.51 V at a current of 10 mA in the 1.0 M sodium hydroxide solution. Therefore, the obtained gold/nickel-iron-manganese phosphide material has good oxygen evolution performance (the dashed line in FIG. 36) while electrolyzing seawater, and its seawater oxygen evolution performance is better than the performance in alkaline water alone (the solid line in FIG. 36). This indicates that interaction between the noble metal and OH and Cl in the electrolyte solution significantly improves oxygen evolution performance of the electrode.

Embodiment 10—Electrodeposition Method

Referring to the method in Embodiment 5, the metal nitrate in step (1) was changed to 0.291 g of cobalt nitrate, and the chloroauric acid in step (3) was changed to 3.3 mg of platinum chloride so as to obtain a platinum/cobalt phosphide (or phosphate) material.

A cobalt phosphide (or phosphate) material obtained in step (2) was used for comparative experiments in Application Example 10.

Application Example 10

Figure 37:
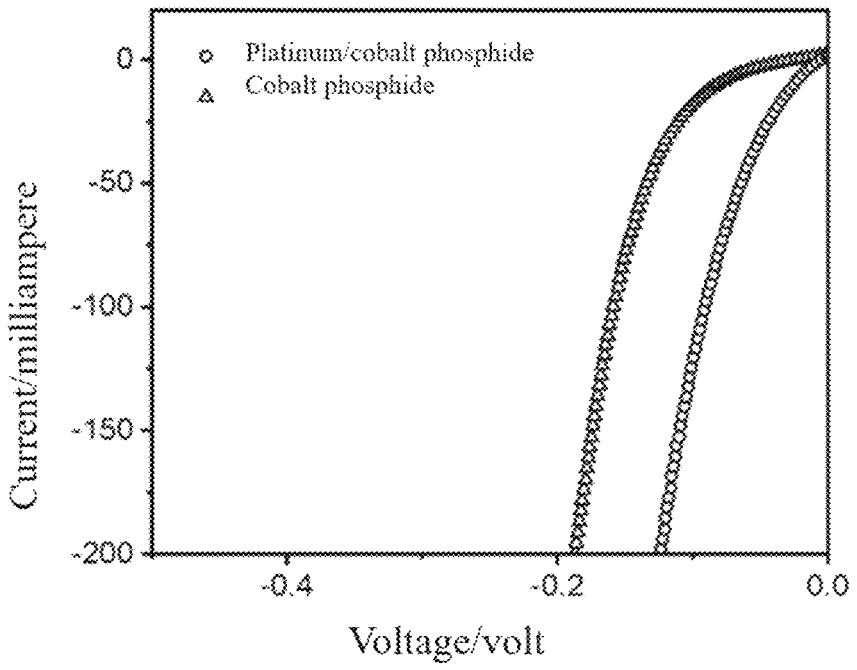
FIG. 37 is a graph of hydrogen evolution polarization curves of a platinum/cobalt phosphide material and a cobalt phosphide material in Embodiment 10 in 1 mol/L NaOH+0.5 mol/L NaCl (dashed line).

Hydrogen evolution performance of the material obtained in Embodiment 10 was tested while electrolyzing seawater using a three-electrode system. The reference electrode was a saturated calomel electrode, the counter electrode was a platinum electrode, the working electrode was the platinum/cobalt phosphide material or the cobalt phosphide material obtained in Embodiment 10, and testing was performed in a mixed solution of 1.0 M sodium hydroxide and 0.5 M sodium chloride, so as to obtain polarization curves as shown in FIG. 37. It may be seen from FIG. 37 that the potential of the platinum/cobalt phosphide material is −0.025 V at a current density of −10 mA/square centimeter, and the potential of the cobalt phosphide material alone is −0.081 V at a current density of −10 mA/square centimeter. Therefore, the platinum/cobalt phosphide material has good hydrogen evolution performance while electrolyzing seawater, and its hydrogen evolution performance is better than that of the cobalt phosphide material.

Embodiment 11—Electrodeposition Method

Referring to the method in Embodiment 5, the metal nitrate in step (1) was changed to 0.291 g of cobalt nitrate, 0.03 g of indium nitrate and 0.404 g of iron nitrate, and the chloroauric acid in step (3) was changed to 8.49 g of silver nitrate (1000 mmol/L) so as to obtain a silver/nickel-cobalt-indium phosphide (or phosphate) material.

A nickel-cobalt-indium phosphide (or phosphate) material obtained in step (2) was used for comparative experiments in Application Example 11.

Application Example 11

Figure 38:
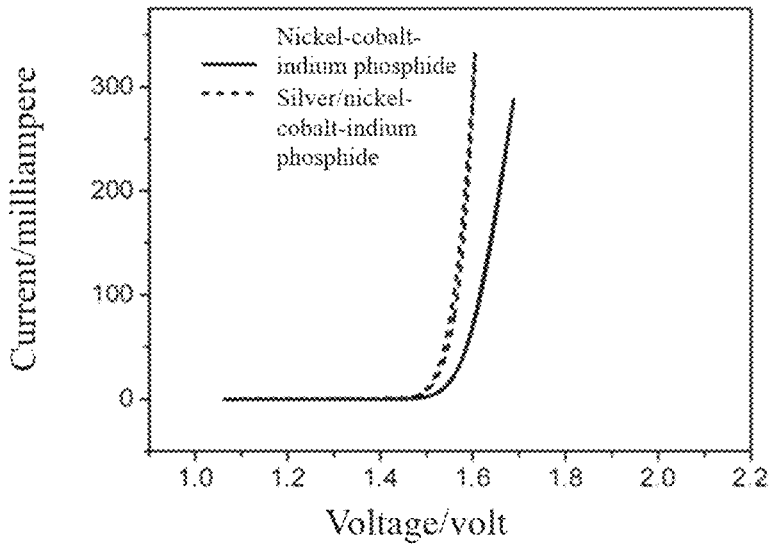
FIG. 38 is a graph of hydrogen evolution polarization curves of a silver/nickel-cobalt-indium phosphide material and a nickel-cobalt-indium phosphide material in Embodiment 11 in 1 mol/L NaOH+0.5 mol/L NaCl (dashed line).

Hydrogen evolution performance of the material obtained in Embodiment 11 was tested while electrolyzing seawater using a three-electrode system. The reference electrode was a saturated calomel electrode, the counter electrode was a platinum electrode, the working electrode was the silver/nickel-cobalt-indium phosphide material or the nickel-cobalt-indium phosphide material obtained in Embodiment 11, and testing was performed in a mixed solution of 1.0 M sodium hydroxide and 0.5 M sodium chloride, so as to obtain polarization curves as shown in FIG. 38. It may be seen from FIG. 38 that the potential of the silver/nickel-cobalt-indium phosphide material is 1.45 V at a current density of 10 mA/square centimeter, and the potential of the nickel-cobalt-indium phosphide material is 1.55 V at a current density of 10 mA/square centimeter. Therefore, the silver/nickel-cobalt-indium phosphide material has good hydrogen evolution performance while electrolyzing seawater, and its hydrogen evolution performance is better than that of the nickel-cobalt-indium phosphide material.

Embodiment 12—Electrodeposition Method

Step (1): 0.366 g of cobalt nitrate, 0.182 g of nickel nitrate, 0.033 g of cerium nitrate, and 90 mL of water were added into an electrolytic cell. A three-electrode system was applied, and electrochemical deposition preparation was performed in an electrochemical workstation by taking 3 cm*3 cm foam nickel as the working electrode, a carbon rod as the counter electrode, and a saturated calomel electrode as the reference electrode. The deposition potential was −1.2 V, and the deposition time was 3600 seconds. The obtained material was washed with water and ethyl alcohol three times each and dried in vacuum to obtain a nickel cobalt cerium hydroxide array material (nickel cobalt cerium metal hydroxide loaded on the foam nickel).

Step (2): The 3*3 $cm^2$ array nickel cobalt cerium array material prepared in step (1) was transferred to a magnetic boat, and the magnetic boat was placed downstream of a tube furnace. 0.3 g of selenium powder was placed on another magnetic boat, and the other magnetic boat was placed upstream of the tube furnace. Under $N_2$ atmosphere, calcination was performed at 400° C. for 2 hours at a heating rate of 5° C./min, and then cooling was performed until room temperature was reached. The final product was washed three times with ethyl alcohol to obtain a nickel-cobalt-cerium selenide material.

Step (3): 100 mL of an electrolyte solution was prepared by mixing chloroplatinic acid with NaOH, NaCl and water. In the electrolyte solution, the concentration of the chloroplatinic acid is 100 mM, the concentration of the NaOH is 6 mol/L, and the concentration of the NaCl is 2.8 mol/L.

Step (4): Electrodeposition was performed using a three-electrode system. The nickel-cobalt-cerium selenide material prepared in step (2) was directly used as the working electrode, electrodeposition was performed in the electrolyte solution in step (3), and noble metal single atoms were deposited on the working electrode. The deposition potential was in a range from 0.03 V to 0.73 V (VS SCE), the number of cycles was 3, and the scanning speed was 5 mv/s. The obtained material was washed with water and ethyl alcohol three times each, and dried in vacuum to obtain a platinum/nickel-cobalt-cerium selenide material.

The nickel-cobalt-cerium selenide material obtained in step (2) was used for comparative experiments in Application Example 12.

Application Example 12

Figure 39:
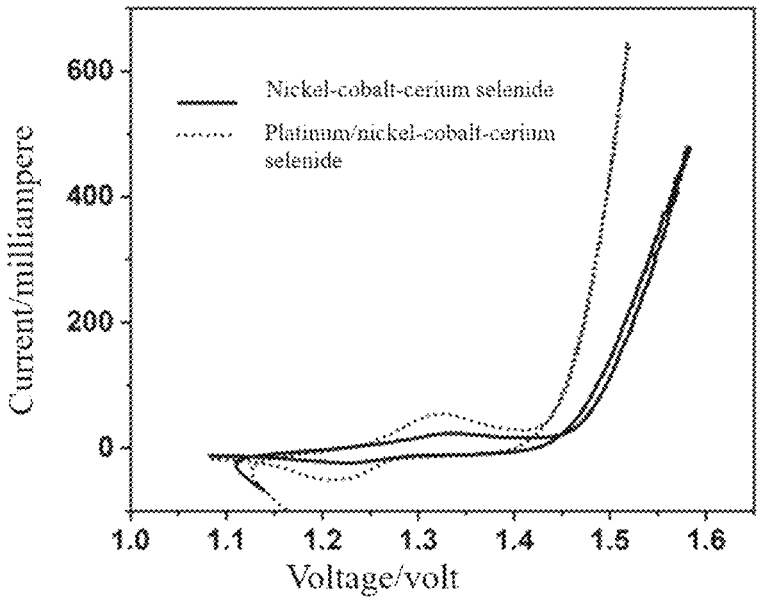
FIG. 39 is a graph of oxygen evolution polarization curves of a platinum/nickel-cobalt-cerium selenide material (dashed line) and a nickel-cobalt-cerium selenide material (solid line) in Embodiment 12 in 6 mol/L NaOH+2.8 mol/L NaCl (dashed line).

Hydrogen evolution performance of the material obtained in Embodiment 12 was tested while electrolyzing seawater using a three-electrode system. The working electrode was the platinum/nickel-cobalt-cerium selenide material or the nickel-cobalt-cerium selenide material, the reference electrode was a saturated calomel electrode, the counter electrode was a platinum electrode, and testing was performed in a mixed solution of 1.0 M sodium hydroxide and 0.5 M sodium chloride, so as to obtain polarization curves as shown in FIG. 39. It may be concluded from the polarization curves that as an anode for seawater electrolysis, the platinum/nickel-cobalt-cerium selenide material has better performance than the nickel-cobalt-cerium selenide material. The peak potential of the platinum/nickel-cobalt-cerium selenide material is only 1.44 V, which is about 50 mV smaller than that of the nickel-cobalt-cerium selenide material. This indicates that the dispersion of platinum single atoms on the surface of nickel-cobalt-cerium selenide has an excellent effect on improving the intrinsic activity of the material for hydrogen evolution while electrolyzing seawater.

Comparative Example 4—Electrodeposition Method

Referring to the method in Embodiment 12, the concentration of chloroplatinic acid of 100 mM, the concentration of NaOH of 6 mol/L, and the concentration of NaCl of 2.8 mol/L in step (3) were changed to the concentration of chloroplatinic acid being 100 mM, the concentration of NaOH being 6 mol/L, and the concentration of NaCl being 0.1 mol/L. The obtained material is platinum (hydr)oxide/nickel-cobalt-cerium selenide. The platinum is coordinated only to oxygen, and not with a halogen.

Comparative Application Example 4

Figure 40:
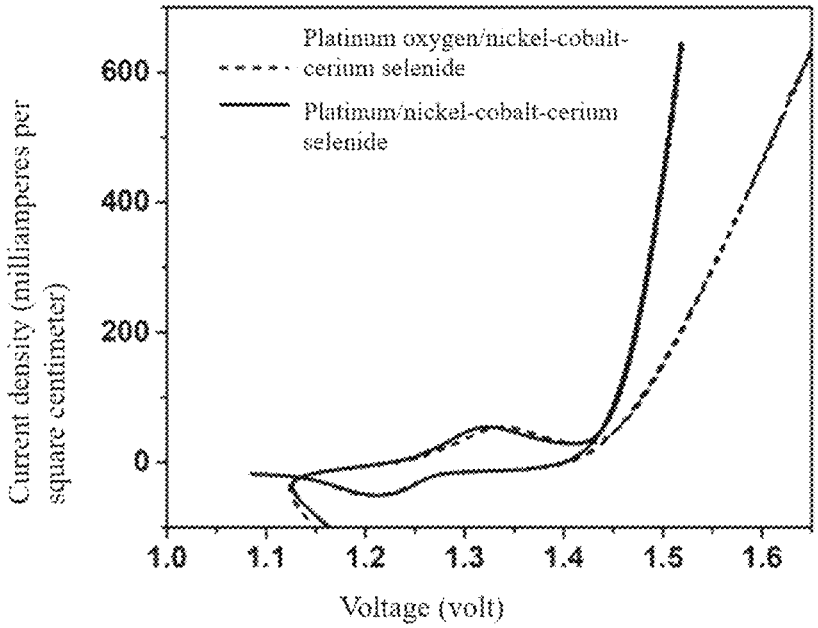
FIG. 40 is a graph of oxygen evolution polarization curve diagrams of a platinum oxygen/nickel-cobalt-cerium selenide material in Comparative Application Example 4 and a platinum/nickel-cobalt-cerium selenide material in Embodiment 12 in a 6 mol/L NaOH+2.8 mol/L NaCl solution.

Hydrogen evolution performance of the material obtained in Comparative Example 4 was tested while electrolyzing seawater using a three-electrode system. The working electrode was changed to the platinum (hydr)oxide/nickel-cobalt-cerium selenide in Comparative Example 4, the reference electrode was a saturated calomel electrode, the counter electrode was a platinum electrode, and testing was performed in a mixed solution of 1.0 M sodium hydroxide and 0.5 M sodium chloride, so as to obtain the results shown in FIG. 40. It may be concluded from FIG. 40 that when the current density reaches 10 mA/square centimeter, the peak potential of the platinum (hydr)oxide/nickel-cobalt-cerium selenide is 1.45 V (dashed line[s]), which is about 10 mV higher than that of the platinum/nickel-cobalt-cerium selenide (solid line[s]) in Embodiment 12. Therefore, when the platinum (hydr)oxide/nickel-cobalt-cerium selenide in Comparative Example 4 is used for seawater electrolysis, its activity is lower than that of the platinum/nickel-cobalt-cerium selenide in Embodiment 12. The results show that the hydrogen evolution performance of the material during water and seawater electrolysis is closely related to the local coordination structure of the noble metal atoms, and the noble metal has the best performance when coordinated to both a halogen and an oxygen-containing functional group. Moreover, it has been proven that the coordination structure during the preparation of the platinum/nickel-cobalt-cerium selenide material is related to the concentration of sodium chloride.

Embodiment 13—Electrodeposition Method

Referring to the method in Embodiment 12, the metal nitrate in step (1) was changed to 0.732 g of cobalt nitrate, and the soluble noble metal salt in step (3) was changed to potassium chlororuthenate, so as to obtain a nano array with ruthenium dispersed on a surface of cobalt selenide, namely, a ruthenium/cobalt selenide material. Compared to Embodiment 12, both were used to prepare a selenide substrate, and sodium chloride was not added in a preparation process of this material.

Figure 41:
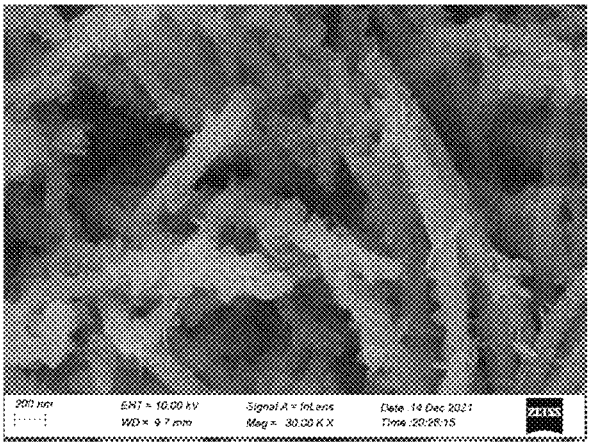
FIG. 41 is a scanning electron microscopy image of a ruthenium/cobalt selenide material in Embodiment 13.

Reference is made to FIG. 41 for a scanning electron microscopy (SEM) image of the obtained material, which is a "dandelion"-shaped array composed of nanowires grown on a foam nickel carrier. The nanowires have a diameter of about 10-50 nanometers, a length of about 1-2 microns, and a smooth surface without particles.

Application Example 13

Figure 42:
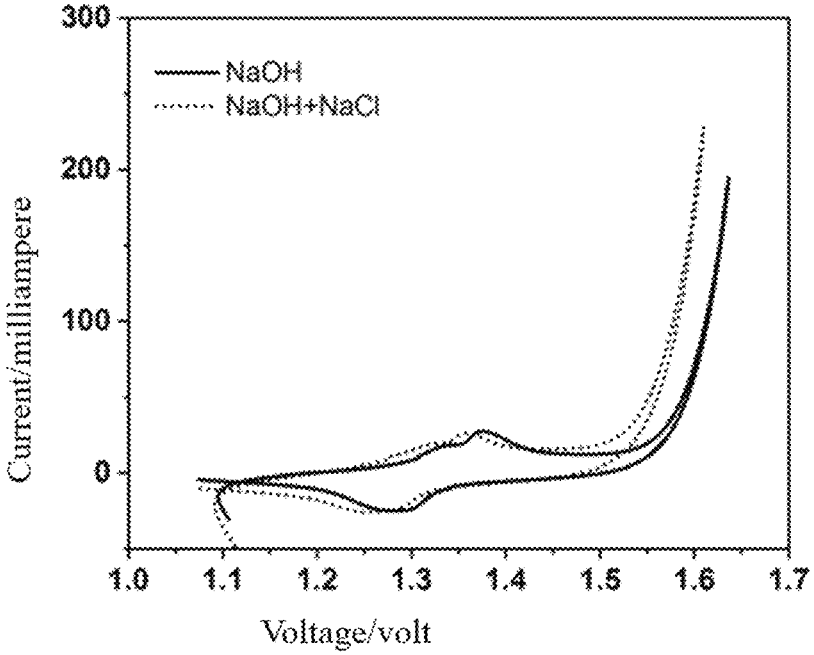
FIG. 42 is a graph of oxygen evolution polarization curves of a ruthenium/cobalt selenide material in Application Example 13 in 6 mol/L NaOH+2.8 mol/L NaCl (dashed line) and 6 mol/L NaOH (solid line) solutions.

The hydrogen evolution performance of the material obtained in Embodiment 13 during seawater electrolysis was tested using a three-electrode system. The working electrode was changed to the ruthenium/cobalt selenide material or a cobalt selenide material (i.e., without the ruthenium) in Embodiment 13, the reference electrode was a saturated calomel electrode, the counter electrode was a platinum electrode, and testing was performed in simulated seawater (a mixed solution of 6 M sodium hydroxide and 2.8 M sodium chloride) or alkaline deionized water (a 6 M sodium hydroxide solution), so as to obtain polarization curves as shown in FIG. 42. It may be seen from the polarization curves that the ruthenium/cobalt selenide electrode serves as an anode for electrolyzing seawater, and in the seawater (the solution of 6 M sodium hydroxide+2.8 M sodium chloride, the dashed line[s] in FIG. 42) and the alkaline deionized water (the 6 M sodium hydroxide solution, the solid line[s] in FIG. 42), potentials at a current density of 200 mA/square centimeter were 1.51 V and 1.56 V respectively, which indicates that single atom loading of ruthenium is used for electrolyzing the seawater, and chloride ions in the seawater interact with the ruthenium single atoms to regulate and control the active site structure, thereby effectively improving the performance during seawater electrolysis.

Embodiment 14—Electrodeposition Method

Referring to the method in Embodiment 12, the metal nitrate in step (1) was changed to 0.291 g of nickel nitrate and 0.404 g of ferric nitrate, and the soluble noble metal salt in step (3) was changed to iridium chloride, so as to obtain a nano array with iridium dispersed on a surface of nickel selenide, namely, an iridium/nickel-iron selenide material.

The nickel-iron selenide material obtained in step (2) was used for comparative experiments in Application Example 14.

Application Example 14

Figure 43:
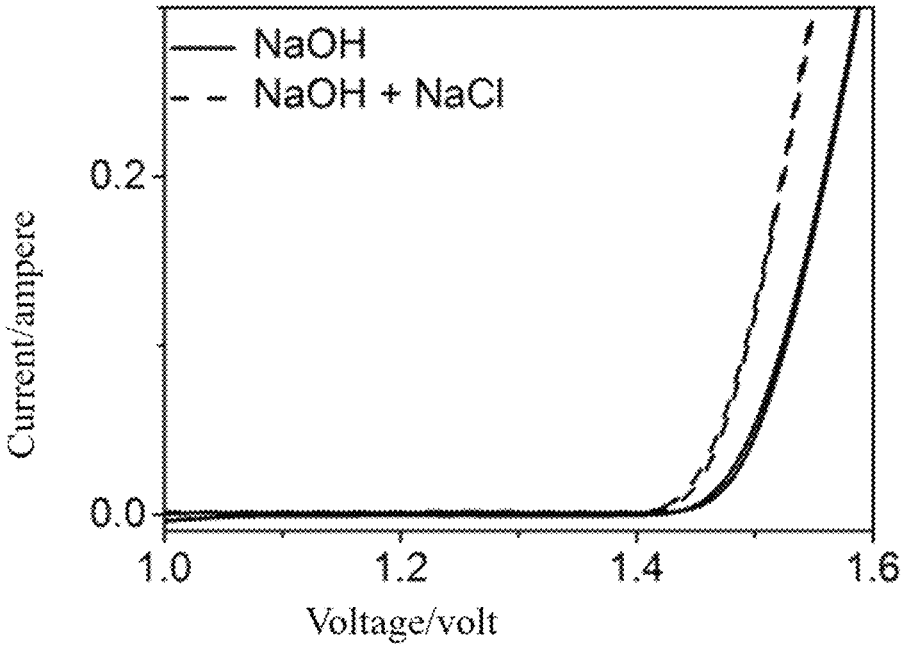
FIG. 43 is a graph of oxygen evolution polarization curves of iridium/nickel iron selenide in Application Example 14 in 6 mol/L NaOH+2.8 mol/L NaCl (dashed line) and 6 mol/L NaOH (solid line) solutions.

The hydrogen evolution performance of the material obtained in Embodiment 14 during seawater electrolysis was tested using a three-electrode system. The working electrode was changed to the iridium/nickel-iron selenide material or the nickel-iron selenide material in Embodiment 14, the reference electrode was a saturated calomel electrode, the counter electrode was a platinum electrode, and testing was performed in simulated seawater (a mixed solution of 6 M sodium hydroxide and 2.8 M sodium chloride) or alkaline deionized water (a 6 M sodium hydroxide solution), so as to obtain polarization curves as shown in FIG. 43. It may be seen from the polarization curves that the iridium/nickel-iron selenide material serves as an anode for seawater electrolysis, and in the seawater (the dashed line[s] in FIG. 43) and the alkaline deionized water (the solid line[s] in FIG. 43), potentials at a current density of 200 mA/square centimeter were 1.51 V and 1.56 V respectively, which indicates that single atom loading of iridium is used for electrolyzing seawater, and chloride ions in the seawater interact with the iridium single atoms to regulate and control the active site structure, thereby effectively improving the performance during seawater electrolysis.

Embodiment 15—Double Noble Metal Loading—Electrodeposition Method

Referring to the method in Embodiment 12, the metal nitrate in step (1) was changed to 0.174 g of nickel nitrate, 0.121 g of ferric nitrate and 0.037 g of vanadium nitrate, and the soluble noble metal salt in step (3) was changed to 2 mg of iridium chloride and 1 mg of platinum chloride, so as to obtain a nano array with iridium and platinum atoms dispersed on a surface of nickel-iron-vanadium selenide, namely, an iridium-platinum/nickel-iron-vanadium selenide material.

The nickel-iron-vanadium selenide material in step (2) was used for comparative experiments in Application Example 15.

Application Example 15

Figure 44:
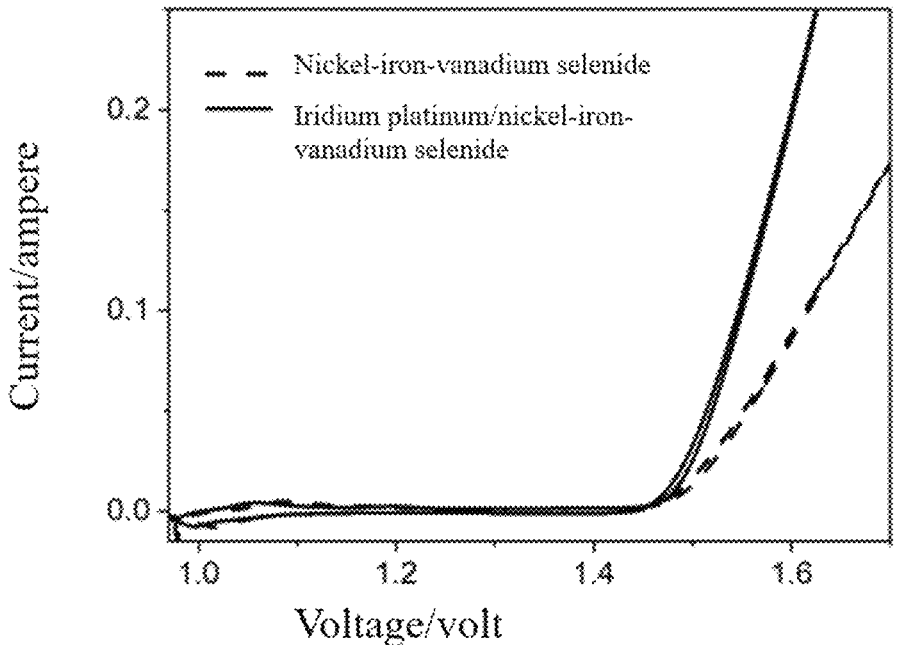
FIG. 44 is a graph of oxygen evolution polarization curve diagrams of an iridium-platinum/nickel-iron-vanadium selenide material and a nickel-iron-vanadium selenide material in Application Example 15 in a 6 mol/L NaOH+2.8 mol/L NaCl solution.

The oxygen evolution performance of the material obtained in Embodiment 15 during seawater electrolysis was tested using a three-electrode testing system. The reference electrode was a saturated calomel electrode, the counter electrode was a platinum electrode, the working electrode was changed to the iridium-platinum/nickel-iron-vanadium selenide material or the nickel-iron-vanadium selenide material in Embodiment 15, the voltage range was from 0 V to 1 V (relative to saturated calomel), and the electrolyte solution was changed to 6.0 M sodium hydroxide and 2.8 M saturated sodium chloride to characterize the oxygen evolution performance of the material. It may be seen from FIG. 44 that the obtained iridium-platinum/nickel-iron-vanadium selenide material has good oxygen evolution performance when electrolyzing seawater, and its oxygen evolution performance is better than that of the nickel-iron-vanadium selenide material.

Figure 45:
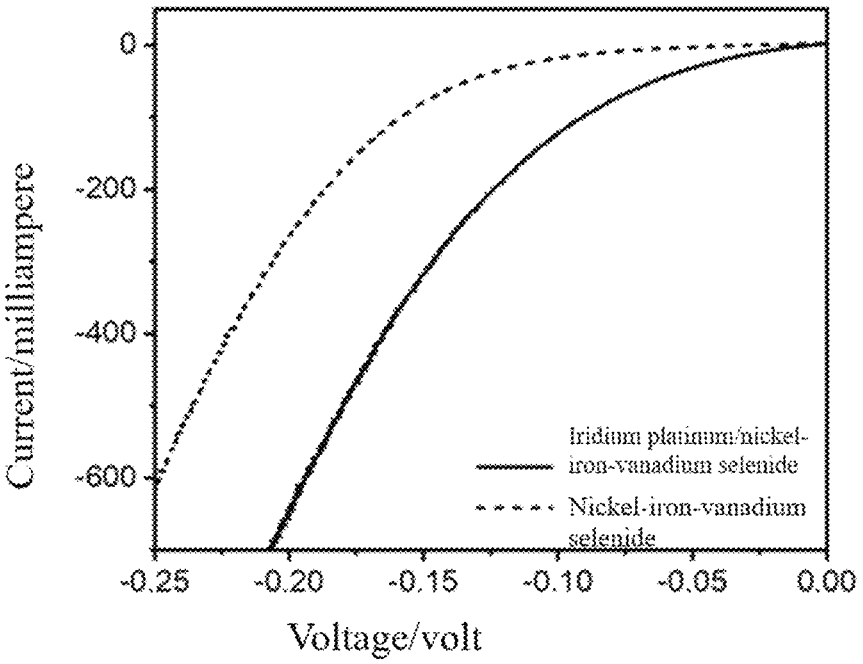
FIG. 45 is a graph of hydrogen evolution polarization curve diagrams of an iridium-platinum/nickel-iron-vanadium selenide material and a nickel-iron-vanadium selenide material in Application Example 15 in a 6 mol/L NaOH+2.8 mol/L NaCl solution.

The hydrogen evolution performance of the material obtained in Embodiment 15 was tested using a three-electrode system. The reference electrode was a saturated calomel electrode, the counter electrode was a platinum electrode, the voltage range was from −1 V to −2V (relative to saturated calomel), and the electrolyte solution was 6.0 M sodium hydroxide and 2.8 M saturated sodium chloride to characterize cathodic hydrogen evolution performance of the material. The obtained testing results were as shown in FIG. 45. It may be concluded from FIG. 45 that the iridium-platinum/nickel-iron-vanadium selenide material simultaneously has good cathodic hydrogen evolution performance, specifically manifested as a hydrogen evolution peak overpotential of about 20 mV of the iridium-platinum/nickel-iron-vanadium selenide material and a peak overpotential of about 80 mV of the nickel-iron-vanadium selenide material. Therefore, the single atom distributions of iridium and platinum (double noble metals) advances the peak potential for hydrogen evolution by about 60 mV, which is beneficial for improving the catalytic activity of hydrogen evolution.

Embodiment 16—Electrodeposition Method

Referring to the method in Embodiment 8, the metal nitrate in step (1) was changed to 0.174 g of nickel nitrate, 0.191 g of cobalt nitrate and 0.023 g of cadmium nitrate, and the soluble noble metal salt in step (3) was changed to 0.148 mg (0.001 mmol/L) of osmium chloride and 0.2 mg (0.1 mmol/L) of sodium hydroxide, so as to obtain a nano array with osmium dispersed on a surface of nickel-cobalt-cadmium selenide, namely, an osmium/nickel-cobalt-cadmium selenide material.

The nickel-cobalt-cadmium selenide material in step (2) was used for comparative experiments in Application Example 16.

Application Example 16

Figure 46:
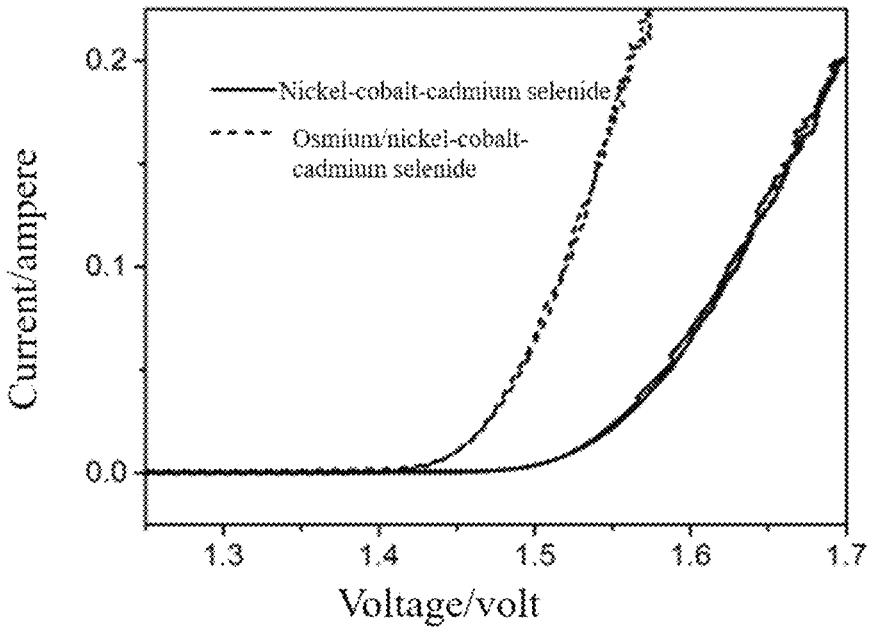
FIG. 46 is a graph of oxygen evolution polarization curve diagrams of an osmium/nickel-cobalt-cadmium selenide material and a nickel-cobalt-cadmium selenide material in Application Example 16 in a 6 mol/L NaOH+2.8 mol/L NaCl solution.

Testing was performed using a three-electrode testing system. The reference electrode was a saturated calomel electrode, the counter electrode was a platinum electrode, the working electrode was the osmium/nickel-cobalt-cadmium selenide material or the nickel-cobalt-cadmium selenide material in Embodiment 16, and the electrolyte solution was changed to 6.0 M sodium hydroxide and 2.8 M saturated sodium chloride to characterize the oxygen evolution performance of the material. It may be seen from FIG. 46 that the obtained osmium/nickel-cobalt-cadmium selenide material has good oxygen evolution performance, and its oxygen evolution performance is better than that of the nickel-cobalt-cadmium selenide material. The overpotential of the osmium/nickel-cobalt-cadmium selenide material at a current of 10 mA was only about 218 mV, which was about 86 mV smaller than that of the nickel-cobalt-cadmium selenide material.

Embodiment 17—Electrodeposition Method

Step (1): A cobalt hydroxide material was prepared. 0.6 g of urea, 0.291 g of cobalt nitrate, 0.037 g of ammonium fluoride, and water were mixed to obtain 36 mL of a solution. The solution was poured into 40 mL of a reactor, washed foam nickel was placed into the solution, and the reactor was put into an oven. The reaction temperature was 100° C., and the reaction time was 12 hours. The obtained material was washed with water and ethyl alcohol three times each, and dried in vacuum at 60° C. for 10 hours.

Step (2): The cobalt hydroxide material obtained in step (1) was placed in the center of a tube furnace and calcined at 200° C. for 4 hours to obtain a cobaltosic oxide material.

Step (3): 50 mL of an electrolyte solution was prepared from 2.0 g of sodium hydroxide, 1.8 mg of iridium chloride, and water.

Step (4): Electrodeposition was performed using a three-electrode system in the electrolyte solution obtained in (3). The array electrode obtained in step (2) was the working electrode, a saturated calomel electrode was the reference electrode, a carbon rod was the counter electrode, linear voltammetry was used, and parameters included a voltage range from −0.7 V to −0.5 V, a reverse scanning direction, a scanning speed of 0.005 V/s, and the number of cycles was 10. The obtained material was washed with water and ethyl alcohol three times each, and dried in vacuum at 60° C. for 10 hours to obtain an iridium/cobaltosic oxide material.

Figure 47:
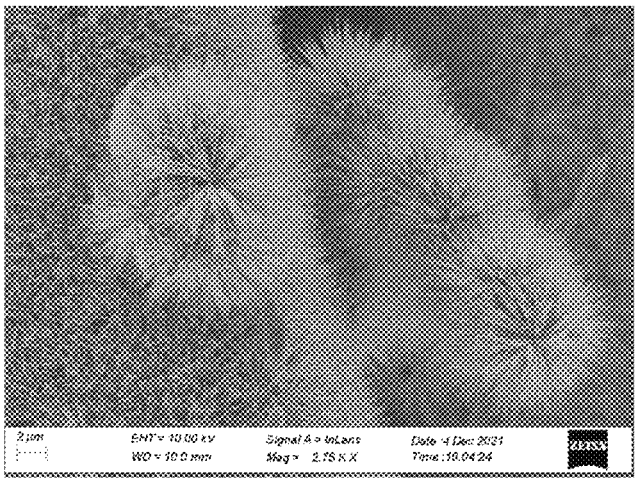
FIG. 47 is a scanning electron microscopy (SEM) image of an iridium/cobaltosic oxide material in Embodiment 17.
Figure 48:
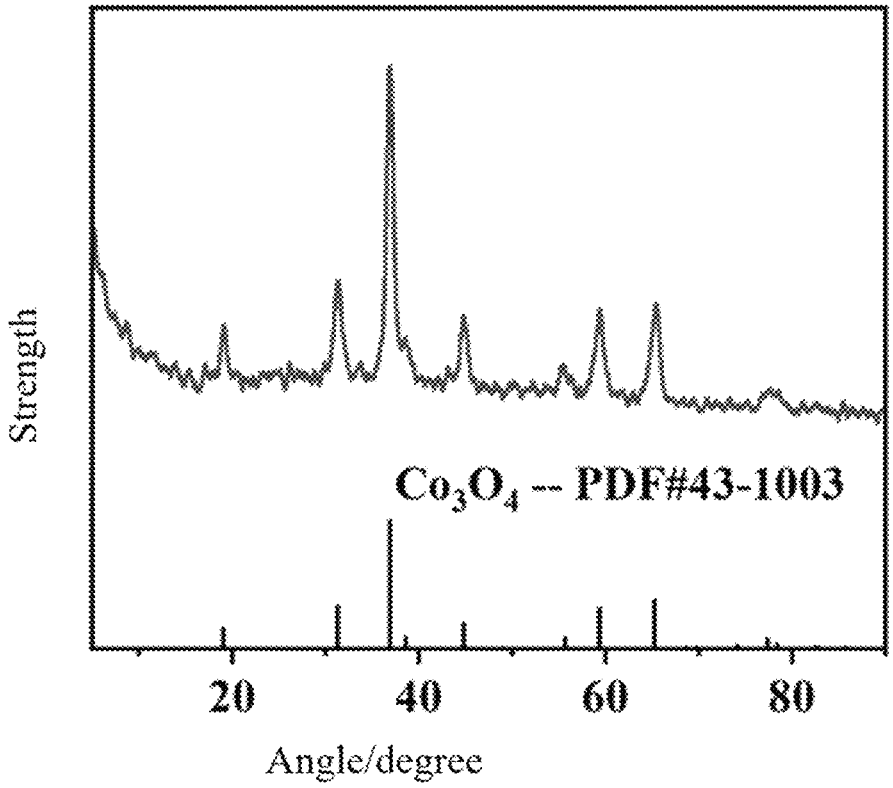
FIG. 48 is an X-ray diffraction diagram of an iridium/cobaltosic oxide material in Embodiment 17.

Reference is made to FIG. 47 for a scanning electron microscopy image of the obtained material, and it may be concluded from FIG. 47 that a surface of the material is smooth and free of particles of the noble metal. Reference is made to FIG. 48 for an XRD spectrum of the obtained material, which is consistent with a diffraction peak of cobaltosic oxide, indicating that iridium was not crystallized separately into a metal or a metal oxide.

The cobaltosic oxide material in step (2) was used for comparative experiments in Application Example 17.

Application Example 17

Figure 49:
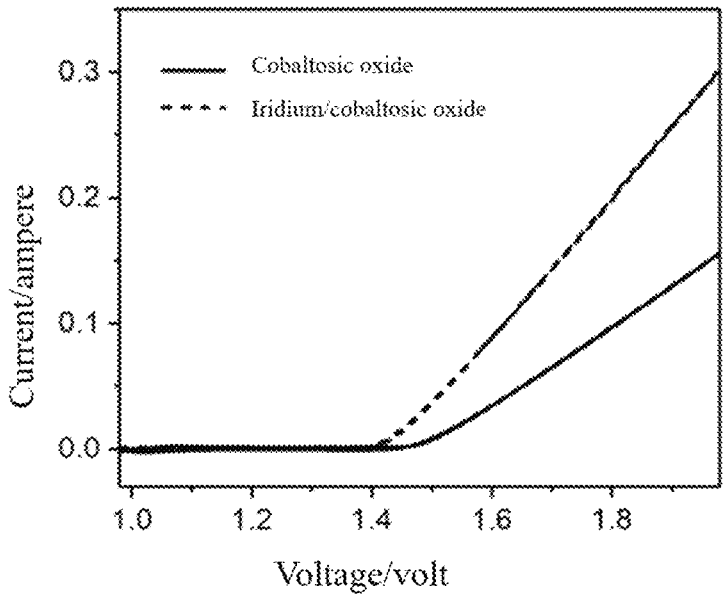
FIG. 49 is a graph of oxygen evolution polarization curve diagrams of an iridium/cobaltosic oxide material and a cobaltosic oxide material in Application Example 17 in a 6 mol/L NaOH+2.8 mol/L NaCl solution.

The oxygen evolution performance of the iridium/cobaltosic oxide material and the cobaltosic oxide material in Embodiment 17 was tested during seawater electrolysis using a three-electrode system in a mixed solution of 6.0 M sodium hydroxide and 2.8 M sodium chloride, so as to obtain polarization curves as shown in FIG. 49. It may be seen from FIG. 49 that the obtained iridium/cobaltosic oxide material has good oxygen evolution performance (the dashed line in FIG. 49), and its oxygen evolution performance is better than that of the cobaltosic oxide material (the solid line in FIG. 49). The potential of the iridium/cobaltosic oxide material at a current density of 200 mA/square centimeter was 1.49 V, which was 90 mV smaller than that of the cobaltosic oxide electrode.

Embodiment 18—Double Noble Metal Loading—Electrodeposition Method

Referring to the method in Embodiment 17, the metal nitrate in step (1) was changed to 271 g of nickel nitrate, 0.404 g of ferric nitrate, 0.050 g of copper nitrate, and 0.050 g of strontium nitrate, and the iridium chloride in step (3) was changed to 3 mg of ruthenium chloride and 2 mg of palladium chloride, so as to obtain a ruthenium-palladium/nickel-iron-copper-strontium oxide material.

The nickel-iron-copper-strontium oxide material in step (2) was used for comparative experiments in Application Example 18.

Application Example 18

Figure 50:
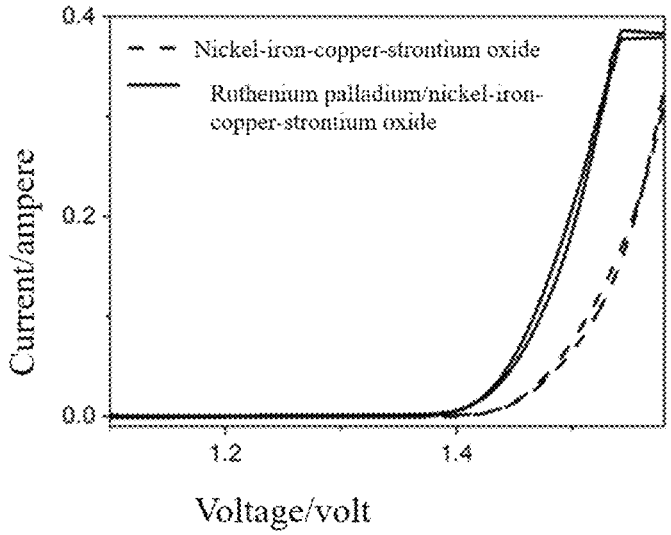
FIG. 50 is a graph of oxygen evolution polarization curve diagrams of a ruthenium palladium/nickel-iron-copper-strontium oxide material and a nickel-iron-copper-strontium oxide material in Application Example 18 in a 6 mol/L NaOH+2.8 mol/L NaCl solution.

The oxygen evolution performance of the material obtained in Embodiment 18 was tested using a three-electrode testing system. The reference electrode was a saturated calomel electrode, the counter electrode was a platinum electrode, the working electrode was the ruthenium-palladium/nickel-iron-copper-strontium oxide material or the nickel-iron-copper-strontium oxide material prepared in Embodiment 18, the voltage range was from 0 V to 1 V, and the electrolyte solution was 6.0 M sodium hydroxide and 2.8 M sodium chloride to characterize the oxygen evolution performance of the material during seawater electrolysis. It may be seen from FIG. 50 that the obtained ruthenium-palladium/nickel-iron-copper-strontium oxide material has good oxygen evolution performance (with a peak potential of 1.393 V), and its oxygen evolution performance is better than that of the nickel-iron-copper-strontium oxide material (with a peak potential of 1.425 V).

Figure 51:
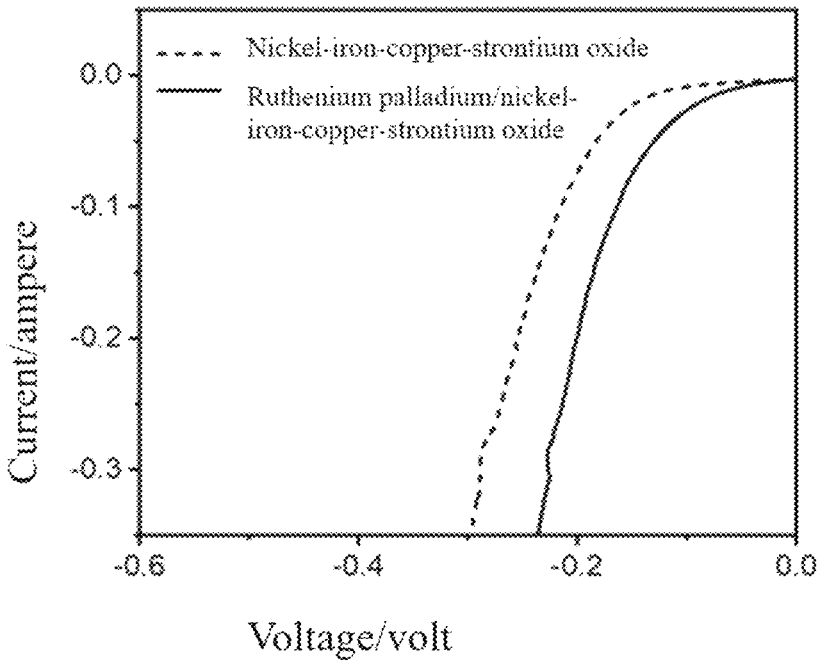
FIG. 51 is a graph of hydrogen evolution polarization curve diagrams of a ruthenium palladium/nickel-iron-copper-strontium oxide material and a nickel-iron-copper-strontium oxide material in Application Example 18 in a 6 mol/L NaOH+2.8 mol/L NaCl solution.

The hydrogen evolution performance of the material obtained in Embodiment 18 was tested during seawater electrolysis using a three-electrode testing system. The reference electrode was a saturated calomel electrode, the counter electrode was a platinum electrode, the working electrode was the ruthenium-palladium/nickel-iron-copper-strontium oxide or the nickel-iron-copper-strontium oxide material prepared in Embodiment 18, the voltage range was from −1 V to −2V and the electrolyte solution was 6.0 M sodium hydroxide and 2.8 M sodium chloride to characterize the cathodic hydrogen evolution performance of the of the material. The obtained testing results were as shown in FIG. 51. It may be concluded from FIG. 51 that the ruthenium-palladium/nickel-iron-copper-strontium oxide material simultaneously has good cathodic hydrogen evolution performance, specifically manifested as a hydrogen evolution peak potential of about 17 mV of the ruthenium-palladium/nickel-iron-copper-strontium oxide material and a peak potential of about 88 mV of the nickel-iron-copper-strontium oxide material. The single atom distribution of ruthenium and palladium atoms (double noble metals) advances the peak potential for hydrogen evolution by about 60 mV, and thus is proven to be beneficial for improving the catalytic activity of hydrogen evolution.

Embodiment 19—Electrodeposition Method

A preparation method of a nanomaterial with noble metal single atoms dispersed on a surface of a non-noble metal substrate adopts an electrodeposition method described in the third aspect of the present invention, which is specifically as follows.

Step (1): A nickel cobalt iron hydroxide array was prepared. 0.6 g of urea, 0.291 g of nickel nitrate, 0.291 g of cobalt nitrate, 0.266 g of ferric nitrate, 0.037 g of ammonium fluoride and deionized water were mixed to form 36 mL of a solution. The solution was poured into 40 mL of a reactor, washed foam nickel iron with a size of 3*4 $cm^2$ was placed into the solution, and the reactor was put into an oven. The reaction temperature was 100° C., the hydrothermal reaction time was 12 hours, and crystallization was performed. The obtained material was washed with water and ethyl alcohol three times each, and dried in vacuum at 60° C. for 10 hours to obtain foam nickel iron loaded with nickel cobalt iron hydroxide (the nickel cobalt iron hydroxide array).

Step (2): The obtained nickel cobalt iron hydroxide array was placed in a thiourea benzyl alcohol solution (13.7 mg of thiourea, 36 mL) and reacted at 120° C. for 5 hours for sulfuration. The obtained material was a nickel-cobalt-iron sulfide material, which is used for electrodeposition of single atoms.

Step (3): 50 mL of an electrolyte solution was prepared by mixing 2.0 g of sodium hydroxide and 1.8 mg of chloroauric acid with an appropriate amount of water.

Step (4): Electrodeposition was performed using a three-electrode system in the electrolyte solution obtained in step (3). The nickel-cobalt-iron sulfide material obtained in step (2) was the working electrode, a saturated calomel electrode was the reference electrode, a carbon rod was the counter electrode, linear voltammetry was used, and parameters included a voltage range from 0 V to 1.2 V, a reverse scanning direction, a scanning speed of 0.005 V/s, and the number of cycles was 10. The obtained material was washed with water and ethyl alcohol three times each, and dried in vacuum at 60° C. for 10 hours to obtain a gold/nickel-cobalt-iron sulfide material.

Application Example 19

1. Seawater Electrolysis Performance

The oxygen evolution performance of the material obtained in the present invention during seawater electrolysis was also tested using a three-electrode system. The reference electrode was a saturated calomel electrode, the counter electrode was a platinum electrode, and the working electrode was the gold/nickel-cobalt-iron sulfide material obtained in Embodiment 19, or the nickel-cobalt-iron sulfide material obtained from step (2) in Embodiment 19. The electrolyte solution was a 6.0 M sodium hydroxide solution, and polarization curves obtained were as shown in FIG. 52.

Figure 53:
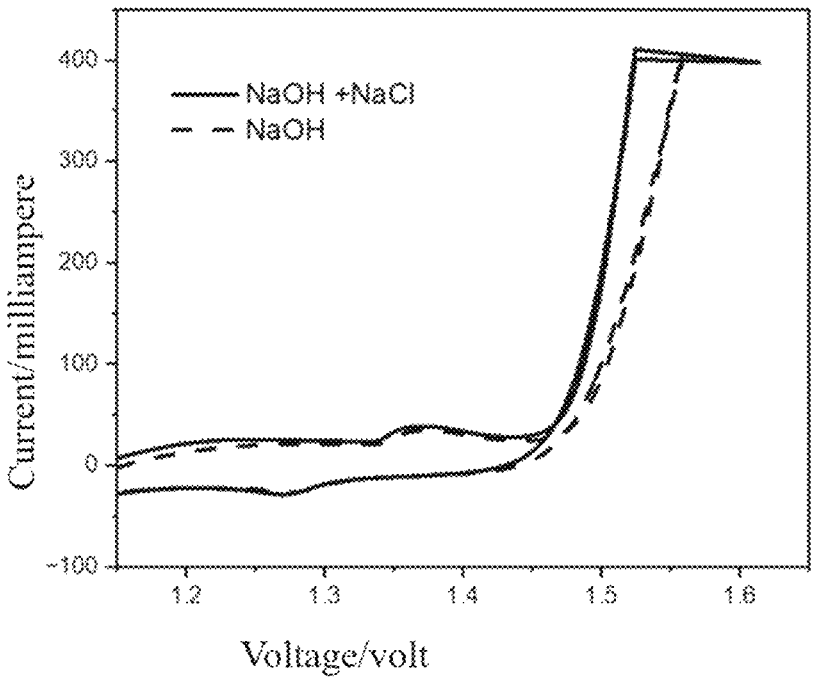
FIG. 53 is a graph of oxygen evolution polarization curve diagrams of a gold/nickel-cobalt-iron sulfide material in Application Example 19 in a 6 mol/L NaOH solution and a 6 mol/L NaOH+2.8 mol/L NaCl solution.

The gold/nickel-cobalt-iron sulfide working electrode obtained in Embodiment 19 was also used to electrolyze a mixed electrolyte solution of 6.0 M sodium hydroxide and 2.8 M sodium chloride, so as to obtain polarization curves as shown in FIG. 53.

Figure 52:
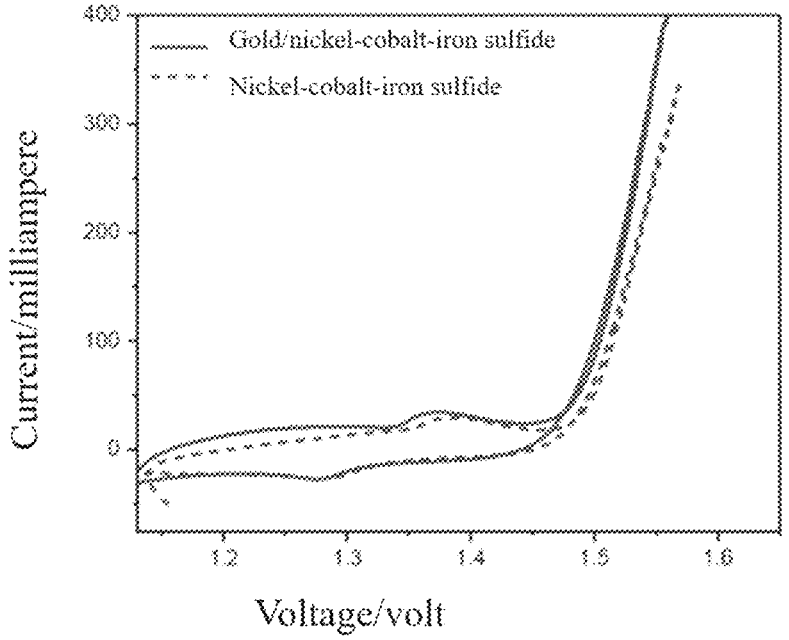
FIG. 52 is a graph of oxygen evolution polarization curve diagrams of a gold/nickel-cobalt-iron sulfide material and a nickel-cobalt-iron sulfide material in Application Example 19 in a 6 mol/L NaOH solution.

It may be seen from FIG. 52 that the obtained gold/nickel-cobalt-iron sulfide material has good oxygen evolution performance when electrolyzing alkaline water. Its oxygen evolution performance when electrolyzing alkaline water is better than that of the nickel-cobalt-iron sulfide material, and its potential at a current density of 100 mA/square centimeter was 1.50 V, which is 19 mV smaller than that of a nickel-cobalt-iron sulfide electrode.

It may be seen from FIG. 53 that the obtained gold/nickel-cobalt-iron sulfide material has good oxygen evolution performance when electrolyzing alkaline seawater. In seawater, the required overpotential to reach 100 mA/square centimeter was 1.485 V, which is 15 mV smaller than that in alkaline water alone, and thus the gold/nickel-cobalt-iron sulfide material has better catalytic activity.

2. Influence of Bromide Ions on Seawater Electrolysis Performance

Referring to the first aspect of Application Example 19, using the same three-electrode testing system, sodium bromide was added to the electrolyte solution. That is, the electrolyte solution was changed to a 6.0 M sodium hydroxide solution, or a mixed solution of 6.0 M sodium hydroxide and 2.0 M sodium bromide, and the working electrode was the gold/nickel-cobalt-iron sulfide material obtained in Embodiment 19. The polarization curves obtained were as shown in FIG. 54.

Figure 54:
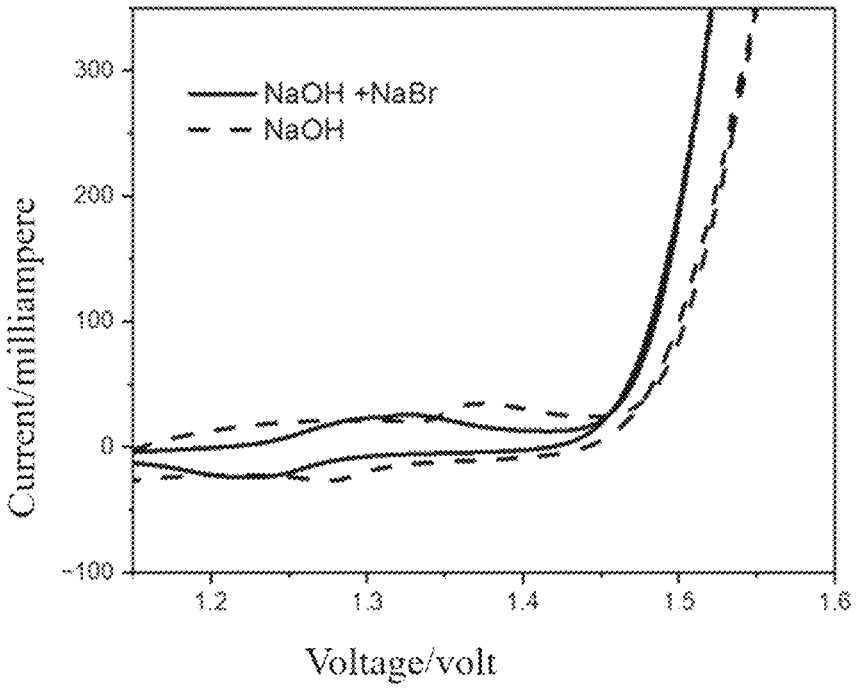
FIG. 54 is a graph of oxygen evolution polarization curve diagrams of a gold/nickel-cobalt-iron sulfide material in Application Example 19 in a 6 mol/L NaOH solution and a 6 mol/L NaOH+2.0 mol/L NaBr solution.

It may be concluded from FIG. 54 that adding bromide ions to the electrolysis solution may advance the peak potential (1.50 V) of gold/nickel-cobalt-iron sulfide to 1.482 V, which is beneficial for the material to catalyze hydrolysis and oxygen evolution.

Figure 55:
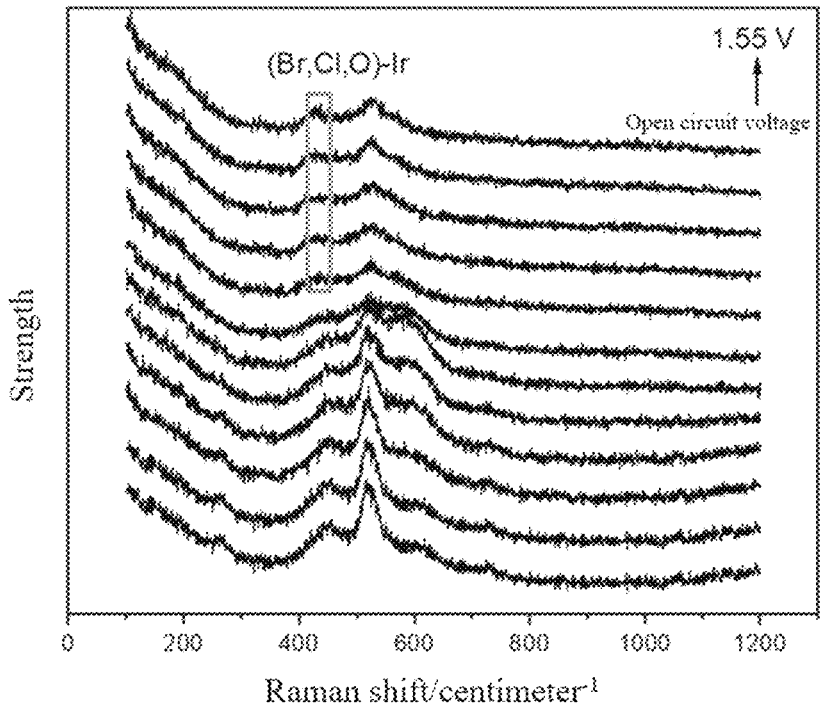
FIG. 55 is an in-situ Raman characterization diagram of a gold/nickel-cobalt-iron sulfide material in Application Example 19 in a 6 mol/L NaOH+2.0 mol/L NaBr solution.

During electrolysis, real-time characterization was performed using in situ Raman spectroscopy (FIG. 55), and bromide ions in the electrolyte solution can coordinate to noble metal atoms. In the material in the electrolysis process, gold atoms simultaneously coordinate oxygen, chlorine and bromine.

3. Influence of Fluoride Ions on Seawater Electrolysis Performance

Referring to the first aspect of Application Example 19, using the same three-electrode testing system, sodium fluoride was added to the electrolyte solution. That is, the electrolyte solution was changed to 6.0 M sodium hydroxide, or 6.0 M sodium hydroxide and 2.0 M sodium fluoride, and the working electrode was the gold/nickel-cobalt-iron sulfide material obtained in Embodiment 19. The polarization curves obtained were as shown in FIG. 56.

Figure 56:
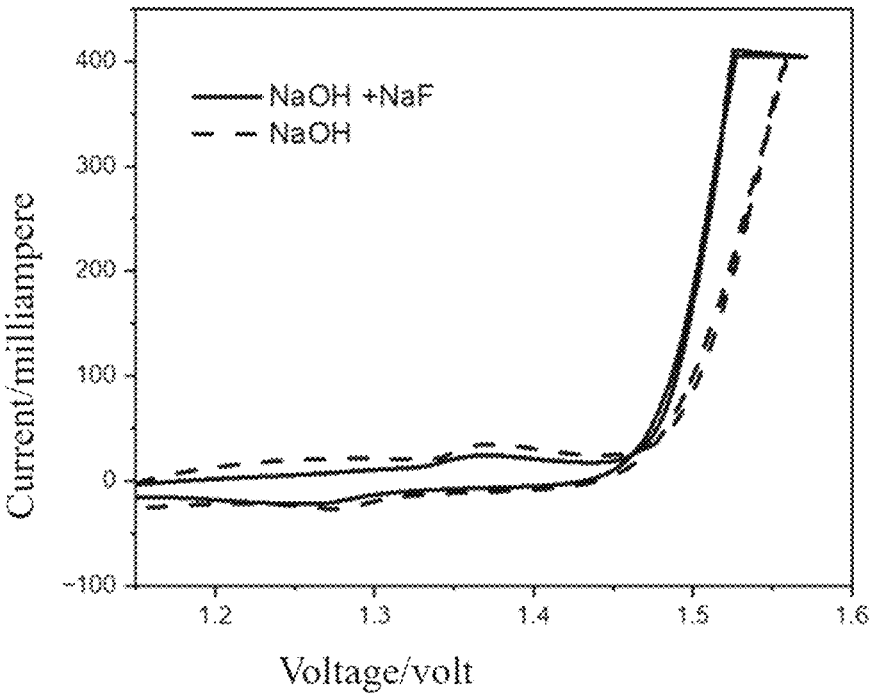
FIG. 56 is a graph of oxygen evolution polarization curve diagrams of a gold/nickel-cobalt-iron sulfide material in Application Example 19 in a 6 mol/L NaOH solution and a 6 mol/L NaOH+2.0 mol/L NaF solution.

It may be concluded from FIG. 56 that adding fluoride ions to the electrolysis solution may advance the peak potential (1.50 V) of the gold/nickel-cobalt-iron sulfide to 1.475 V, which is beneficial for the material to catalyze hydrolysis and oxygen evolution. In the electrolysis process, gold atoms simultaneously coordinate oxygen, chlorine and fluorine.

Embodiment 20—Double Noble Metal Loading—Electrodeposition Method

Referring to the method in Embodiment 19, the metal nitrate in step (1) was changed to 0.810 g of nickel nitrate and 0.404 g of ferric nitrate; and the iridium chloride in step (3) was changed to 3 mg of iridium chloride and 2 mg of ruthenium chloride, so as to finally obtain an iridium-ruthenium/nickel-iron sulfide material.

Referring to the method in Embodiment 19, a nickel-iron sulfide material was obtained in step (2) of Embodiment 20.

Figure 57:
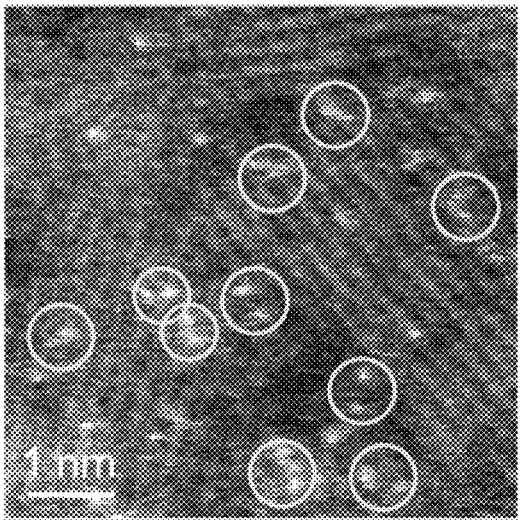
FIG. 57 is a scanning transmission electron microscopy image of an iridium-ruthenium/nickel-iron sulfide material in Embodiment 20.
Figure 58:
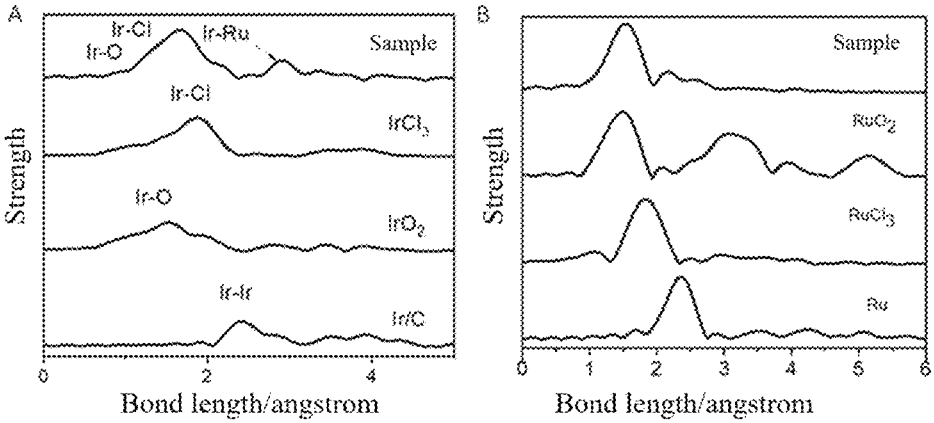
FIG. 58 is a synchrotron radiation characterization spectrum of an iridium-ruthenium/nickel-iron sulfide material in Embodiment 20.

Scanning transmission electron microscopy was used to characterize the distribution condition of Ru and Ir, as shown in FIG. 57, to indicate that Ru and Ir were uniformly distributed on a surface of nickel-iron sulfide in a single atom form respectively. Synchrotron radiation was used to characterize a local coordination environment of Ru and Ir, and the results are as shown in FIG. 58. It may be concluded from FIG. 58A that Ir simultaneously coordinates oxygen and chlorine, while it may be concluded from FIG. 58B that Ru coordinates oxygen. In combination with the analysis of FIGS. 58A-B, it may be concluded that Ru and Ir have a strong interaction, which is different from a simple combination of Ir and Ru.

Application Example 20

1. Oxygen Evolution Performance

The oxygen evolution performance of the material obtained in Embodiment 20 during electrolysis of simulated seawater was tested using a three-electrode testing system. The reference electrode was a saturated calomel electrode, the counter electrode was a platinum electrode, the working electrode was the iridium-ruthenium/nickel-iron sulfide material prepared in Embodiment 20 or the nickel-iron sulfide material obtained from step (2) in Embodiment 20, the voltage range was from 0 V to 1 V, and the electrolyte solution was a mixed solution of 6.0 M sodium hydroxide and 2.8 M sodium chloride to characterize oxygen evolution performance of the material.

Figure 59:
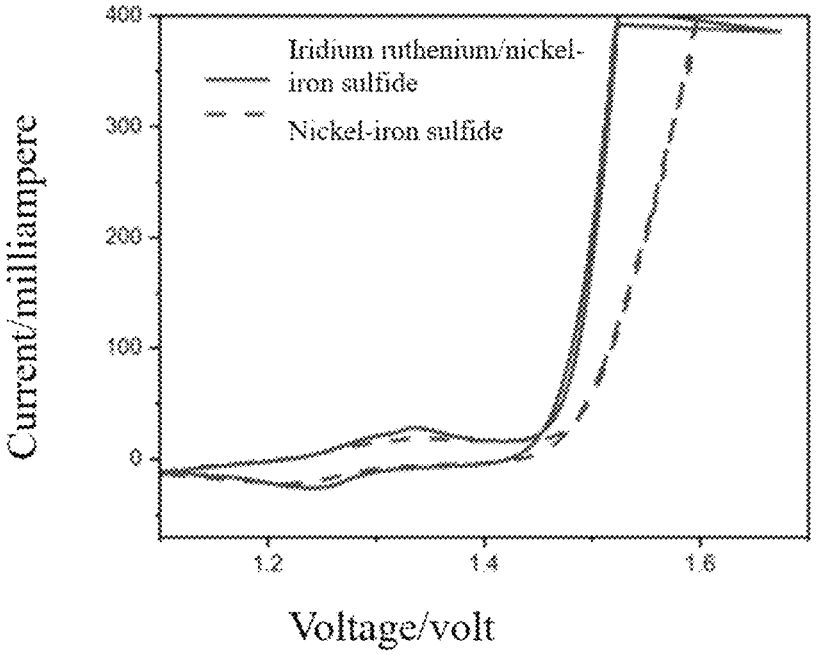
FIG. 59 is a graph of hydrogen evolution polarization curve diagrams of iridium-ruthenium/nickel-iron sulfide and nickel-iron sulfide materials in Application Example 20 in a 6 mol/L NaOH+2.8 mol/L NaCl solution.

FIG. 59 includes oxygen evolution polarization curve diagrams of the iridium-ruthenium/nickel-iron sulfide and nickel-iron sulfide materials in Application Example 20 in the 6 mol/L NaOH+2.8 mol/L NaCl solution.

It may be seen from FIG. 59 that the obtained iridium-ruthenium/nickel-iron sulfide material has good oxygen evolution performance (with a peak potential of 1.475 V), and its oxygen evolution performance is better than that of the nickel-iron sulfide material (with a peak potential of 1.512 V).

2. Hydrogen Evolution Performance

The hydrogen evolution performance of the material obtained in Embodiment 20 was tested using a three-electrode testing system. The reference electrode was a saturated calomel electrode, the counter electrode was a platinum electrode, the working electrode was the iridium-ruthenium/nickel-iron sulfide material prepared in Embodiment 20 or the nickel-iron sulfide material obtained from step (2) in Embodiment 20, the voltage range was from −1 V to −2 V, and the electrolyte solution was 6.0 M sodium hydroxide and 2.8 M sodium chloride to characterize cathodic hydrogen evolution performance of the material. The obtained testing results are as shown in FIG. 60.

Figure 60:
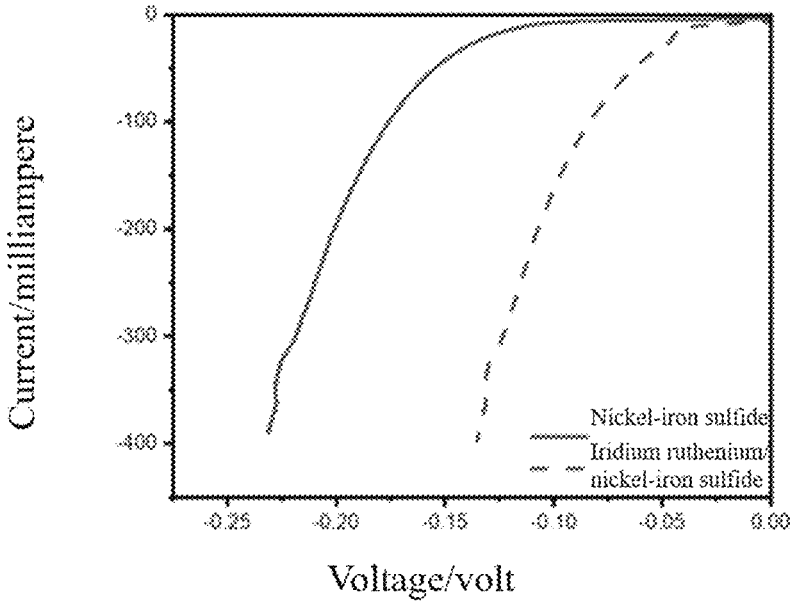
FIG. 60 is a graph of hydrogen evolution polarization curve diagrams of iridium-ruthenium/nickel-iron sulfide and nickel-iron sulfide materials in Application Example 20 in a 6 mol/L NaOH+2.8 mol/L NaCl solution.

It may be concluded from FIG. 60 that the iridium-ruthenium/nickel-iron sulfide material has good cathodic hydrogen evolution performance, specifically manifested as a hydrogen evolution peak potential of about 32.6 mV of the iridium-ruthenium/nickel-iron sulfide material and a peak potential of about 116 mV of the nickel-iron sulfide material. The single atom distributions of iridium and ruthenium (double noble metals) advances the peak potential for hydrogen evolution by about 84 mV, and thus is proven to be beneficial for improving the catalytic activity of hydrogen evolution.

Embodiment 21—Double Noble Metal Loading—Chemical Deposition Method

A preparation method of a nanomaterial (iridium-platinum/nickel-iron-vanadium phosphide) with noble metal single atoms dispersed on a surface of a non-noble metal substrate adopts a chemical deposition method described in the second aspect of the present invention, which is specifically as follows.

Step (1): A non-noble metal substrate-nickel-iron-vanadium bimetallic hydroxide nanosheet was prepared.

Preparation of 40 mL of an alkali liquor A was prepared by mixing 0.48 g of sodium hydroxide and 0.106 g of sodium carbonate with an appropriate amount of deionized water.

Preparation of 40 mL of a salt solution B was prepared by mixing 0.291 g of nickel nitrate, 0.096 g of vanadium chloride, and 0.202 g of ferric nitrate with an appropriate amount of deionized water.

The solution A and the solution B were simultaneously added dropwise to 40 ml of water under high-speed stirring, and the pH was maintained at about 8.5 until the dropwise addition of the salt solution B was completed. Stirring was continued for 12 hours, then centrifuging was performed to obtain precipitates, and the precipitates were washed with deionized water and ethyl alcohol three times each, and dried in vacuum at 60° C. to obtain a nickel-iron-vanadium hydroxide nanosheet.

Step (2): A phosphide (or phosphate) nanomaterial was prepared:

The nickel iron vanadium hydroxide obtained in step (1) and 300 mg of sodium hypophosphite were placed together in a tube furnace and heated to 300° C. for 1 hour to obtain a nickel-iron-vanadium phosphide (or phosphate) material. The obtained material was used for depositing single atoms in next step.

Step (3): A double noble metal single atom material was prepared.

1 g of the nickel-iron-vanadium phosphide nanosheet obtained in step (2) was weighed, 30 mL of deionized water was added, and ultrasound was performed for 2-3 hours until the nanosheet was evenly distributed in the water. 20 mL of an alkaline dilute solution of iridium chloride and chloroplatinic acid was prepared by mixing 5 mg of iridium chloride, 2 mg of chloroplatinic acid, 0.4 mg (0.5 mmol/L) of sodium hydroxide, and deionized water. Then, under high-speed stirring (500 rev/min), the above alkaline dilute solution was added dropwise into the uniformly dispersed nickel-iron-vanadium phosphide, at a drop rate of 5 drops/minute. After dropwise adding, stirring was continued with heating at 95° C. for 4 hours. Centrifugation was performed to obtain precipitates, and the precipitates were washed with water and ethyl alcohol three times each, and dried in vacuum at 60° C. to obtain a nanomaterial (iridium-platinum/nickel-iron-vanadium phosphide or phosphate) with single atoms of iridium and platinum loaded on the nickel-iron-vanadium phosphide (or phosphate).

Application Example 21

1. Oxygen Evolution Performance During Seawater Electrolysis

The oxygen evolution performance of the material obtained in Embodiment 21 while electrolyzing simulated seawater was tested using a three-electrode testing system. The reference electrode was a saturated calomel electrode, the counter electrode was a platinum electrode, the working electrode was the iridium-platinum/nickel-iron-vanadium phosphide material prepared in Embodiment 21 or the nickel-iron-vanadium phosphide material obtained from step (2) in Embodiment 21, the voltage range was from 0 V to 1 V, and the electrolyte solution was 6.0 M sodium hydroxide and 2.8 M sodium chloride to characterize oxygen evolution performance of the material during seawater electrolysis.

Figure 61:
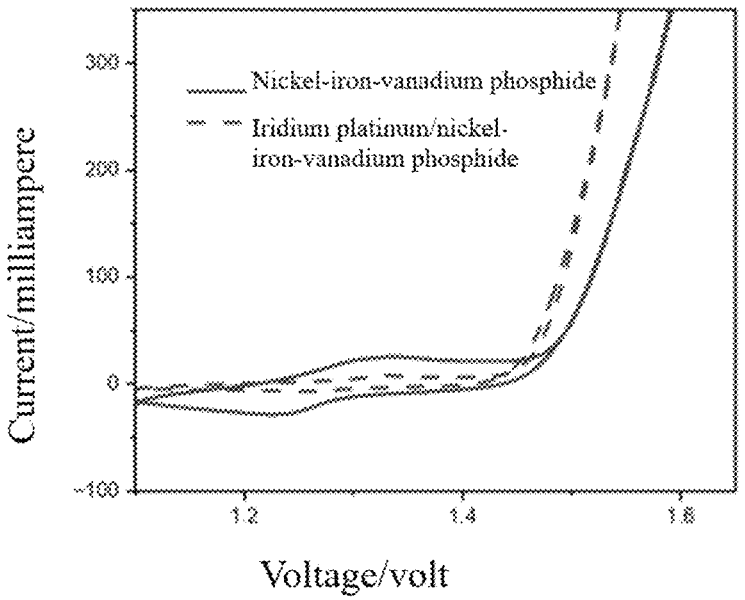
FIG. 61 is a graph of oxygen evolution polarization curve diagrams of an iridium-platinum/nickel-iron-vanadium phosphide material and a nickel-iron-vanadium phosphide material in Application Example 21 in a 6 mol/L NaOH+2.8 mol/L NaCl solution.

FIG. 61 is a graph showing oxygen evolution polarization curve diagrams of the iridium-platinum/nickel-iron-vanadium phosphide material and the nickel-iron-vanadium phosphide material in Application Example 21 in the 6 mol/L NaOH+2.8 mol/L NaCl solution.

It may be seen from FIG. 61 that the obtained iridium-platinum/nickel-iron-vanadium phosphide (or phosphate) material has good oxygen evolution performance (with a peak potential of 1.488 V), and its oxygen evolution performance is better than that of the nickel-iron-vanadium phosphide (or phosphate) material (with a peak potential of 1.528 V).

2. Hydrogen Evolution Performance During Seawater Electrolysis

The hydrogen evolution performance of the material obtained in Embodiment 21 while electrolyzing simulated seawater was tested using a three-electrode testing system.

The reference electrode was a saturated calomel electrode, the counter electrode was a platinum electrode, the working electrode was the iridium-platinum/nickel-iron-vanadium phosphide material prepared in Embodiment 21 or the nickel-iron-vanadium phosphide material obtained from step (2) in Embodiment 21, the voltage range was from −1 V to −2 V, and the electrolyte solution was 6.0 M sodium hydroxide and 2.8 M sodium chloride to characterize cathodic hydrogen evolution performance of the material. The obtained testing results are as shown in FIG. 62.

Figure 62:
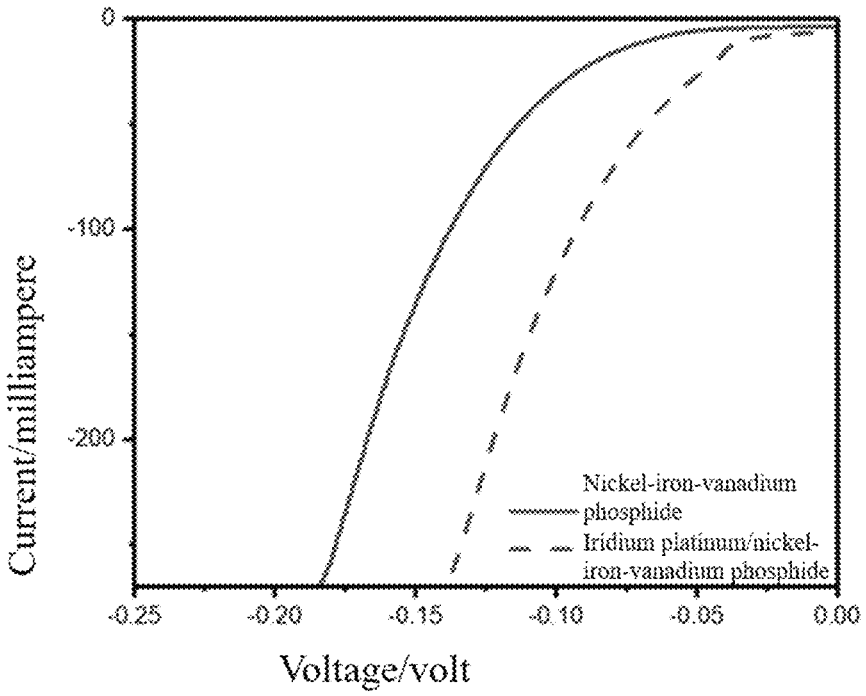
FIG. 62 is a graph of hydrogen evolution polarization curve diagrams of an iridium-platinum/nickel-iron-vanadium phosphide material and a nickel-iron-vanadium phosphide material in Application Example 21 in a 6 mol/L NaOH+2.8 mol/L NaCl solution.

It may be concluded from FIG. 62 that the iridium-platinum/nickel-iron-vanadium phosphide (or phosphate) material has good cathodic hydrogen evolution performance, specifically manifested as that a potential required for hydrogen evolution of the iridium-platinum/nickel-iron-vanadium phosphide (or phosphate) material to reach a current density of 10 mA/square centimeter is about 33.4 mV, and a potential required for hydrogen evolution of the nickel-iron-vanadium phosphide (or phosphate) material to reach a current density of 10 mA/square centimeter is about 66.7 mV. The single atom distributions of iridium and platinum (double noble metals) advances the peak potential for hydrogen evolution by about 33 mV, and thus is proven to be beneficial for improving the catalytic activity of hydrogen evolution.

Figure 63:
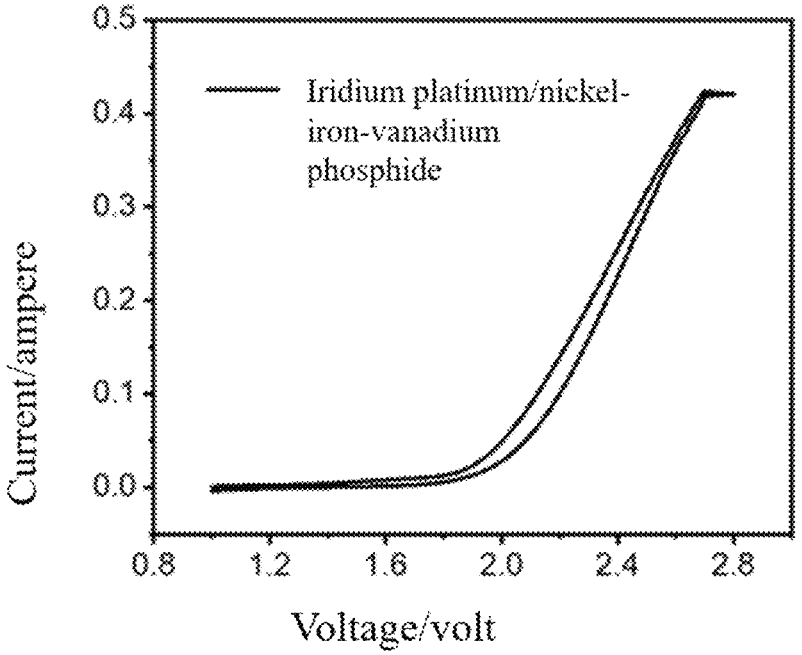
FIG. 63 is a graph of polarization curves during two-electrode electrolysis of water using an iridium-platinum/nickel-iron-vanadium phosphide material in Application Example 21 as a cathode and an anode in a 6 mol/L NaOH+2.8 mol/L NaCl solution.

FIG. 63 shows polarization curves of dual-function water electrolysis using the iridium-platinum/nickel-iron-vanadium phosphide (or phosphate) material prepared in Embodiment 21 as both a cathode and an anode. A voltage required to reach a current density of 400 mA/square centimeter is only about 2.55 V, indicating excellent performance. This proves that the material of the present invention may be used as both the cathode and the anode simultaneously.

Embodiment 22—Chemical Deposition Method

A preparation method of a nanomaterial (ruthenium/nickel iron (2+) iron hydrotalcite) with ruthenium single atoms dispersed on a surface of divalent iron doped nickel iron hydrotalcite is specifically as follows:

Step (1): A divalent iron-doped nickel iron hydrotalcite nanomaterial (a nickel iron (2+) iron hydrotalcite nanosheet) was prepared. Nitrogen was introduced into (e.g., bubbled through) water for 30 minutes to remove dissolved oxygen in the water. The nitrogen flow rate was 200 mL/min, and a mixture was supplied to the following steps after saturation.

40 mL of an alkali liquor A was prepared by mixing 0.40 g of sodium hydroxide (10 mmol) and 0.106 g of sodium carbonate (1 mmol) with an appropriate amount of deionized water.

40 mL of a salt solution B was prepared by mixing 0.162 g (1 mmol) of ferric chloride, 0.126 g (1 mmol) of ferrous chloride, and 0.129 g (1 mmol) of nickel chloride with an appropriate amount of deionized water.

Under nitrogen protection, the solution A and the solution B were simultaneously added dropwise to 40 ml of water under high-speed stirring, and the pH was maintained at about 8.5 until the dropwise addition of the salt solution B was completed. Stirring was continued for 12 hours, then centrifuging was performed to obtain precipitates, and the precipitates were washed with deionized water (obtained after the dissolved oxygen was removed) and ethyl alcohol three times each, and dried in vacuum at 60° C. to obtain the nickel iron (2+) iron hydrotalcite nanosheet.

Step (2): A nanomaterial was prepared. After the dissolved oxygen in the water was removed, 1 g of the nickel iron (2+) iron hydrotalcite nanosheet obtained in step (1) was weighed, 30 mL of deionized water was added, and ultrasound was performed for 2-3 hours until the nanosheet was evenly distributed in the water. 10 mL of a dilute solution of ruthenium chloride was prepared by mixing 5 mg (the concentration of ruthenium was 2.22 mmol/L) of ruthenium chloride and deionized water. Then, under nitrogen protection and with high-speed stirring (500 rev/min), the above ruthenium chloride solution was added dropwise into the uniformly dispersed nickel iron (2+) iron hydrotalcite. After dropwise adding, stirring was continued at 20° C. for 6 hours. Centrifugation was performed to obtain precipitates, and the precipitates were washed with water and ethyl alcohol three times each, and dried in vacuum at 60° C. to obtain the ruthenium/nickel iron (2+) iron hydrotalcite.

All of the above operations eliminate the influence of oxygen.

Figure 64:
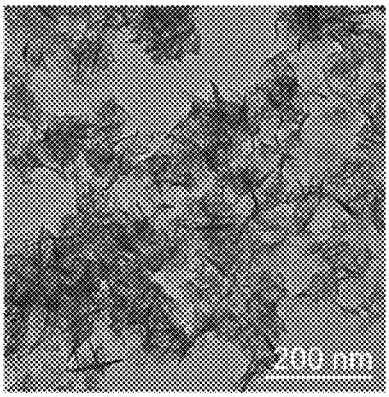
FIG. 64 is a transmission electron microscopy (TEM) image of ruthenium/nickel iron (2+) iron hydrotalcite obtained in Embodiment 22.

Reference is made to FIG. 64 for a transmission electron microscopy image of the obtained ruthenium/nickel iron (2+) iron hydrotalcite. It may be seen from FIG. 64 that the ruthenium/nickel iron (2+) iron hydrotalcite is a hexagonal plate with a diameter of 50-100 nanometers and a thickness of 5-10 nanometers, and has a smooth surface without obvious particles.

Figure 65:
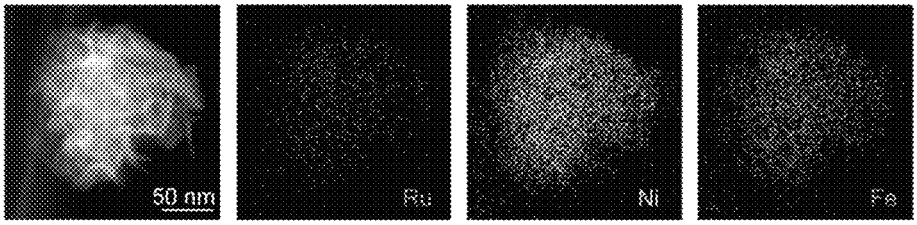
FIG. 65 is an element distribution map of ruthenium/nickel iron (2+) iron hydrotalcite obtained in Embodiment 22.
Figure 66:
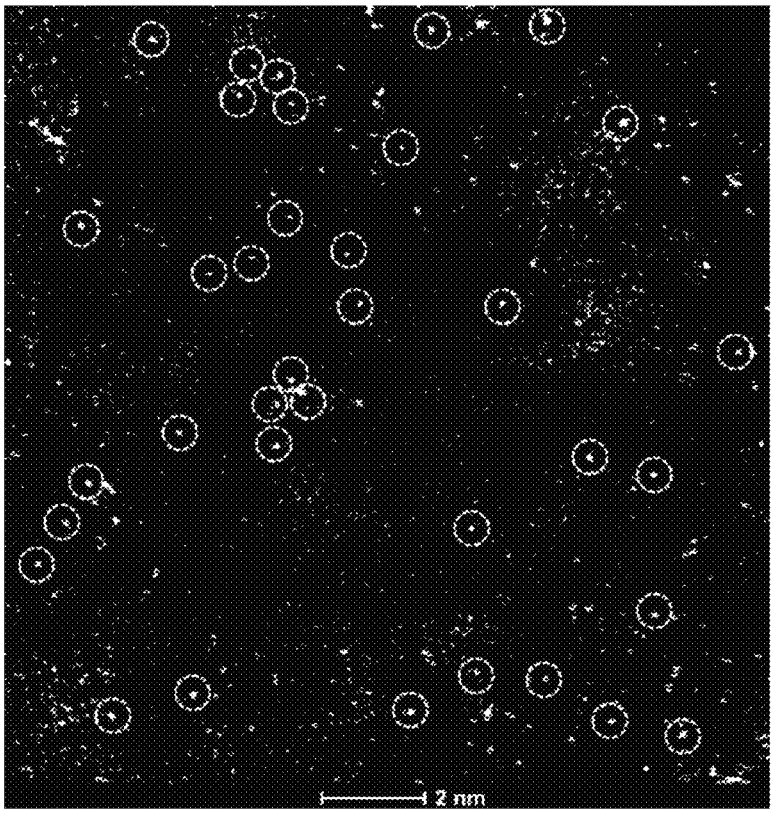
FIG. 66 is a scanning transmission electron microscopy (STEM) image of ruthenium/nickel iron (2+) iron hydrotalcite obtained in Embodiment 22.

Reference is made to FIG. 65 for elemental distributions of the obtained ruthenium/nickel iron (2+) iron hydrotalcite, and reference is made to FIG. 66 for its scanning transmission electron microscopy image. It may be seen from FIG. 65 that the elements in the material are uniformly distributed, and it may be seen in conjunction with the scanning transmission electron microscopy image in FIG. 66 that noble metal ruthenium is highly dispersed on the surface of the nickel iron (2+) iron hydrotalcite in a single atom form.

Figure 67:
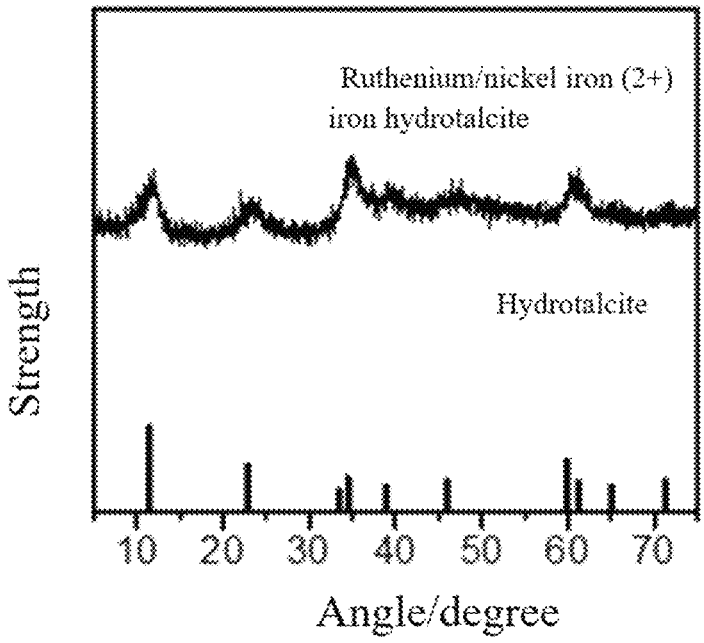
FIG. 67 is an X-ray diffraction (XRD) spectrum of ruthenium/nickel iron (2+) iron hydrotalcite obtained in Embodiment 22.

Reference is made to FIG. 67 for an XRD spectrum of the obtained ruthenium/nickel iron (2+) iron hydrotalcite. It may be seen that the diffraction peak(s) are consistent with hydrotalcite, indicating that ruthenium was not crystallized into ruthenium oxide or elemental ruthenium in the synthesis. The noble metal atoms are coordinated to chlorine and oxygen simultaneously. Moreover, the single atoms of the noble metal are selectively anchored above divalent iron ions.

Figure 68:
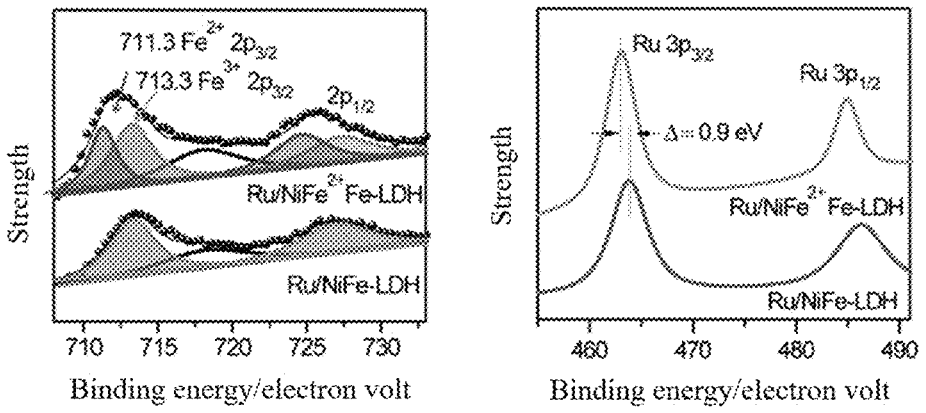
FIG. 68 are graphs obtained by X-ray photoelectron spectroscopy of ruthenium/nickel iron hydrotalcite of Application Example 22 or ruthenium/nickel iron (2+) iron hydrotalcite obtained in Embodiment 1.

Reference is made to FIG. 68 for an X-ray photoelectron spectroscopy (XPS) result of the obtained material. It may be seen from FIG. 68 that divalent iron is successfully introduced, and the valence state of the Ru atoms is reduced when the divalent iron is introduced.

Inductively coupled plasma emission spectroscopy testing was performed on the ruthenium/nickel iron (2+) iron hydrotalcite, and the results showed that the mass fraction of ruthenium in this material was 1.36%, based on the total mass of this material.

Application Example 22

Water Electrolysis Performance Testing

The oxygen evolution performance of the ruthenium/nickel iron (2+) iron hydrotalcite obtained in Embodiment 22 of the present invention was tested during water electrolysis using a three-electrode system. The reference electrode was a saturated calomel electrode, the counter electrode was a platinum electrode, and the working electrode was the ruthenium/nickel iron (2+) iron hydrotalcite obtained in Embodiment 22. Testing was performed in a 1.0 M potassium hydroxide solution, and polarization curves obtained were as shown in FIG. 69.

Figure 69:
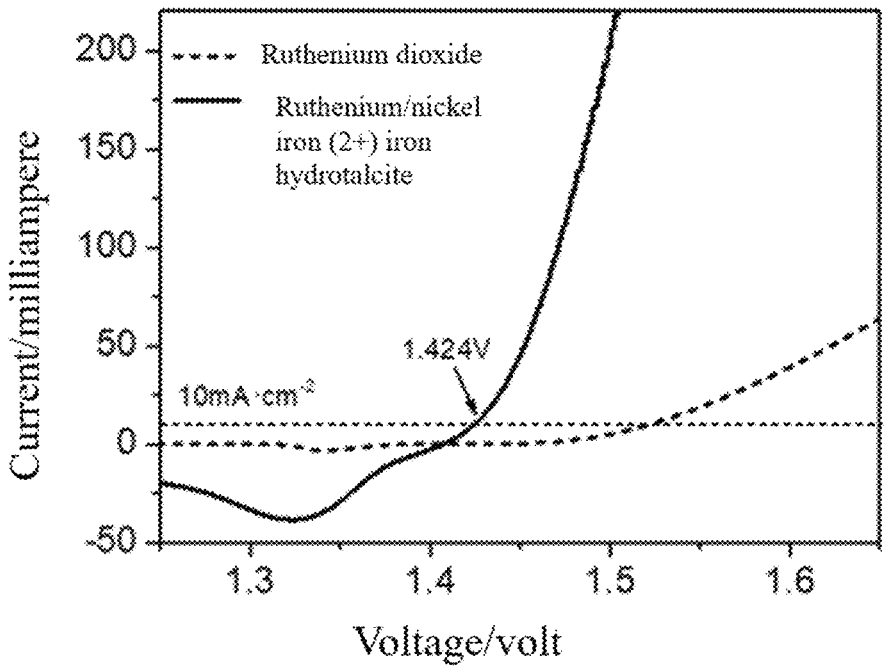
FIG. 69 is a graph of hydrogen evolution polarization curve diagrams of a ruthenium/nickel iron (2+) iron hydrotalcite material obtained in Embodiment 22 and commercially available ruthenium dioxide in a 1 mol/L NaOH solution.

It may be seen from FIG. 69 that for the ruthenium/nickel iron (2+) iron hydrotalcite, under a current density of 10 mA/square centimeter, the required potential is only 1.424 V, which is nearly 300 mV smaller than that of commercially available ruthenium dioxide.

Embodiment 23—Chemical Deposition Method

A preparation method of a nanomaterial (iridium/nickel manganese (2+) iron hydrotalcite) with iridium single atoms dispersed on a surface of divalent manganese doped nickel iron hydrotalcite is specifically as follows.

Step (1): A divalent manganese-doped nickel iron hydrotalcite nanomaterial (a nickel manganese (2+) iron hydrotalcite nanosheet) was prepared. Nitrogen was introduced into water for 30 minutes to remove dissolved oxygen in the water. The nitrogen flow rate was 200 mL/min, and a mixture was supplied to the following steps after saturation.

40 mL of an alkali liquor A was prepared by mixing 0.40 g of sodium hydroxide (10 mmol) and 0.106 g of sodium carbonate (1 mmol) with an appropriate amount of deionized water.

40 mL of a salt solution B was prepared by mixing 0.162 g (1 mmol) of ferric chloride, 0.125 g (1 mmol) of manganese dichloride, and 0.129 g (1 mmol) of nickel chloride with an appropriate amount of deionized water.

Under nitrogen protection, the solution A and the solution B were simultaneously added dropwise to 40 ml of water under high-speed stirring, and the pH was maintained at about 8.5 until the dropwise addition of the salt solution B was completed. Stirring was continued for 12 hours. Centrifuging was performed to obtain precipitates, and the precipitates were washed with deionized water (obtained after the dissolved oxygen was removed) and ethyl alcohol three times each, and dried in vacuum at 60° C. to obtain the nickel manganese (2+) iron hydrotalcite nanosheet.

Step (2): A nanomaterial was prepared. After boiling deionized water to remove the dissolved oxygen therein, 0.5 g of the nickel manganese (2+) iron hydrotalcite nanosheet obtained in step (1) was weighed, 30 mL of the deoxygenated deionized water was added, and ultrasound was applied for 2-3 hours until the nanosheet was evenly distributed in the water. 1 mL of a dilute solution of iridium chloride (the concentration of iridium was 100 mmol/L) was prepared by mixing 31.6 mg of iridium chloride and deionized water. Then, under nitrogen protection and with high-speed stirring (500 rev/min), the above iridium chloride solution was added dropwise into the uniformly dispersed nickel manganese (2+) iron hydrotalcite. After dropwise adding, stirring was continued at −4° C. for 24 hours, centrifugation was performed to obtain precipitates, and the precipitates were washed with water and ethyl alcohol three times each and dried in vacuum at 60° C. to obtain the iridium/nickel manganese (2+) iron hydrotalcite.

Application Example 23

The oxygen evolution performance of the iridium/nickel manganese (2+) iron hydrotalcite in Embodiment 23 of the present invention was tested during water electrolysis using a three-electrode system. The reference electrode was a saturated calomel electrode, the counter electrode was a platinum electrode, and the working electrode was the iridium/nickel manganese (2+) iron hydrotalcite material obtained in Embodiment 23. Testing was performed in a mixed solution of 1.0 M sodium hydroxide and 0.5 M sodium chloride, and the polarization curve(s) obtained are as shown in FIG. 70.

Figure 70:
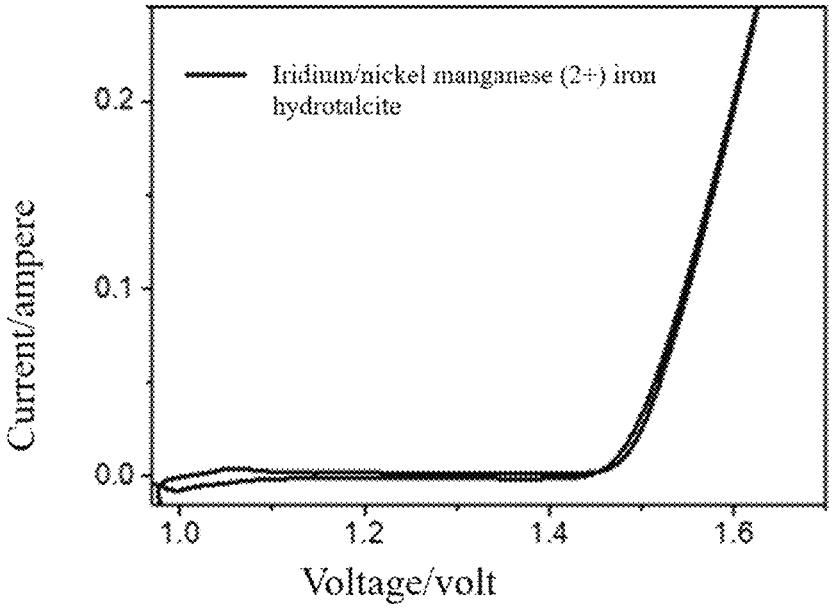
FIG. 70 is an oxygen evolution polarization curve diagram of an iridium/nickel manganese (2+) iron hydrotalcite material obtained in Embodiment 23 and Application Example 23 in a 1 mol/L NaOH+0.5 mol/L NaCl solution.

It may be seen from FIG. 70 that for the iridium/nickel manganese (2+) iron hydrotalcite material, under a current density of 10 mA/square centimeter, the required potential is only 1.447 V, indicating good performance.

Embodiment 24—Electrochemical Deposition Method

Step (1): A nickel cobalt iron hydroxide array was prepared. 0.6 g of urea, 0.291 g of nickel nitrate, 0.291 g of cobalt nitrate, 0.266 g of ferric nitrate, 0.037 g of ammonium fluoride and deionized water were mixed to form 36 mL of a solution. The solution was poured into a 40 mL reactor, washed foam nickel with a size of 3*4 $cm^2$ was placed into the solution, and the reactor was put into an oven. The reaction temperature was 100° C., and the reaction time was 12 hours. Crystallization was performed, and the obtained material was washed with water and ethyl alcohol three times each, and dried in vacuum at 60° C. for 10 hours to obtain foam nickel loaded with a nickel cobalt iron hydroxide (the nickel cobalt iron hydroxide array).

Step (2): The nickel cobalt iron hydroxide array obtained in step (1) and 600 mg of sodium hypophosphite were placed together in a tube furnace and heated to 300° C. for 2 hours to obtain a nickel-cobalt-iron phosphide (or phosphate) material. The obtained material was used for electrodeposition of single atoms.

Step (3): 50 mL of the electrolyte solution was prepared by mixing 2.0 g of sodium hydroxide and 2.6 mg of chloroplatinic acid with an appropriate amount of water.

Step (4): Electrodeposition was performed using a three-electrode system in the electrolyte solution obtained in step (3). The nickel-cobalt-iron phosphide material obtained in step (2) was the working electrode, a saturated calomel electrode was the reference electrode, a carbon rod was the counter electrode, linear voltammetry was used, and parameters included a voltage range from 0.3 V to 0.6 V, a forward scanning direction, a scanning speed of 0.005 V/s, and the number of cycles was 5. The obtained material was washed with water and ethyl alcohol three times each, and dried in vacuum at 60° C. for 10 hours to obtain a platinum/nickel-cobalt-iron phosphide (or phosphate) material.

Application Example 24

1. Hydrogen Evolution Performance During Water Electrolysis

The hydrogen evolution performance of the material obtained in Embodiment 24 during water electrolysis was tested using a three-electrode testing system. The reference electrode was a saturated calomel electrode, the counter electrode was a platinum electrode, the working electrode was the platinum/nickel-cobalt-iron phosphide (or phosphate) material prepared in Embodiment 24 or the nickel-cobalt-iron phosphide (or phosphate) material obtained from step (2) in Embodiment 24, the voltage range was from −1

V to −2 V, and the electrolyte solution was 6 M sodium hydroxide to characterize cathodic hydrogen evolution performance of the material during electrolysis of water. The obtained testing results are as shown in FIG. 71.

Figure 71:
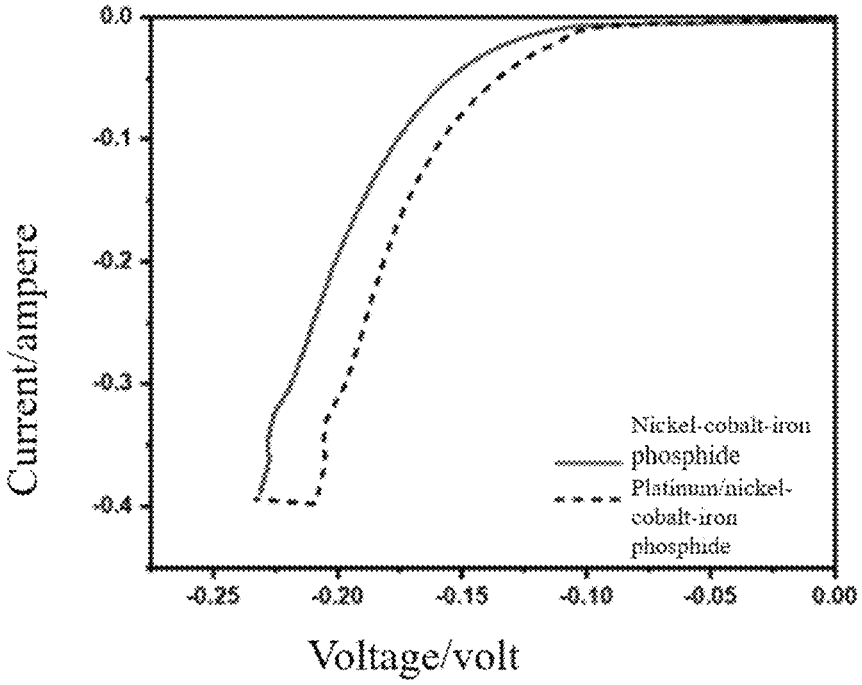
FIG. 71 is a graph of hydrogen evolution polarization curve diagrams of a platinum/nickel-cobalt-iron phosphide material and a nickel-cobalt-iron phosphide material obtained in Embodiment 24 and Application Example 24 in a 6 mol/L NaOH solution.

It may be concluded from FIG. 71 that the platinum/nickel-cobalt-iron phosphide material has good cathodic hydrogen evolution performance, specifically manifested as the potential required for hydrogen evolution of the platinum/nickel-cobalt-iron phosphide material to reach a current density of 10 mA/square centimeter is about 49.6 mV, and the potential required for hydrogen evolution of the nickel-cobalt-iron phosphide material to reach a current density of 10 mA/square centimeter is about 111.7 mV Platinum single atom loading advances the peak potential for hydrogen evolution by about 62.1 mV, indicating that a platinum single atom dispersion is beneficial for improving the catalytic activity of hydrogen evolution.

2. Hydrogen Evolution Performance During Seawater Electrolysis

Figure 72:
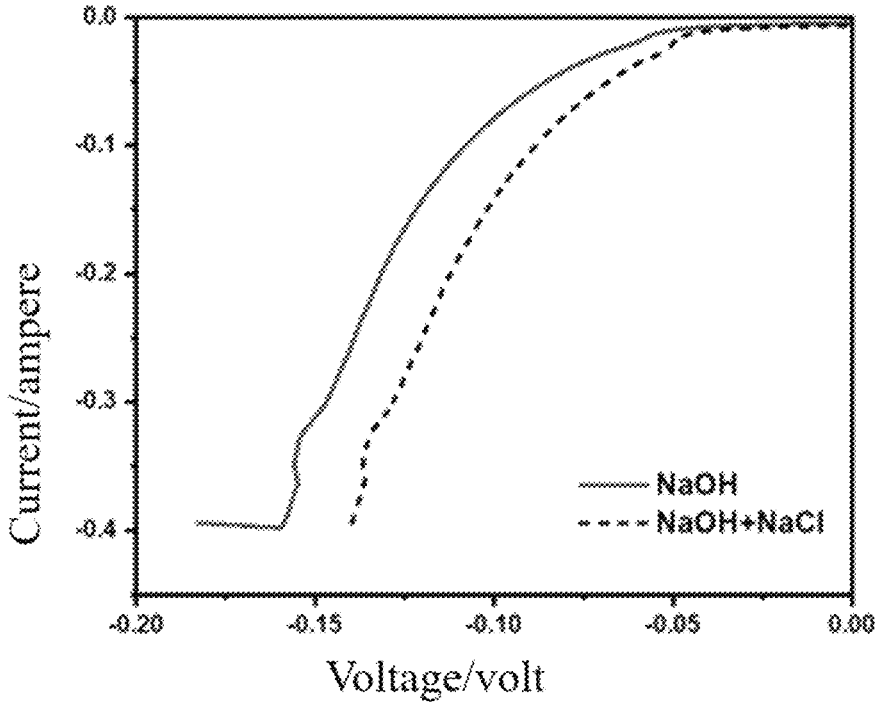
FIG. 72 is a graph of hydrogen evolution polarization curve diagrams of a platinum/nickel-cobalt-iron phosphide material obtained in Embodiment 24 and Application Example 24 in a 6 mol/L NaOH+2.8 mol/L NaCl solution and a 6 mol/L NaOH solution.

Referring to the first aspect of Application Example 24, using the same three-electrode testing system, sodium chloride was added to the electrolyte solution (that is, the electrolyte solution was changed to 6.0 M sodium hydroxide and 2.8 M sodium chloride). The working electrode was the platinum/nickel-cobalt-iron phosphide material obtained in Embodiment 24, and the polarization curves obtained were as shown in FIG. 72. It may be seen from FIG. 72 that for the platinum/nickel-cobalt-iron phosphide (or phosphate) material, the hydrogen evolution performance after adding chloride ions was better than that when testing in aqueous sodium hydroxide alone, and the potential required to reach a current density of 100 mA/square centimeter is reduced by about 20 mV (when testing in aqueous sodium hydroxide, the potential required to reach a current density of 100 mA/square centimeter is about 108.3 mV, and when testing in a mixed aqueous sodium hydroxide and sodium chloride solution, the potential required to reach a current density of 100 mA/square centimeter is about 88.1 mV).

3. Influence of Iodine on the Hydrogen Evolution Performance

Referring to the first aspect of Application Example 24, using the same three-electrode testing system, sodium iodide was added to the electrolyte solution (that is, the electrolyte solution was changed to a mixed solution of 6.0 M sodium hydroxide and 2.0 M sodium iodide). The working electrode was the platinum/nickel-cobalt-iron phosphide (or phosphate) material obtained in Embodiment 24, and the polarization curves obtained were as shown in FIG. 73.

Figure 73:
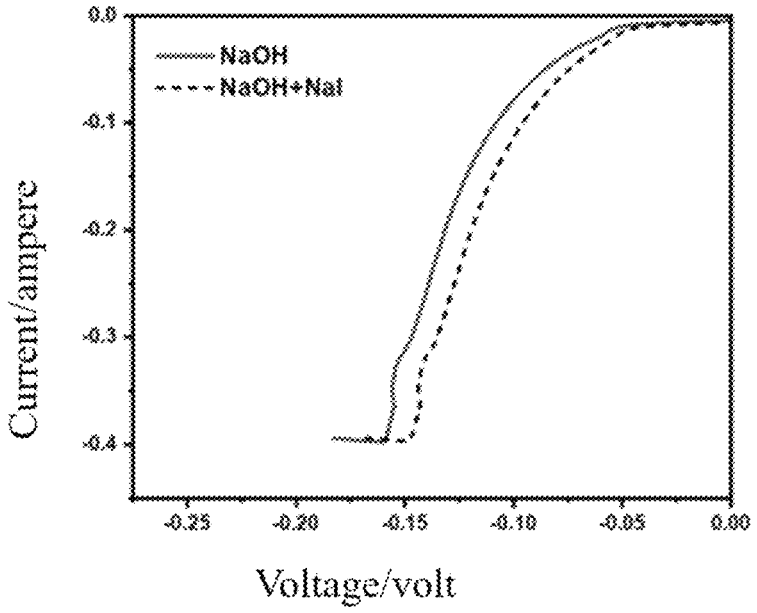
FIG. 73 is a graph of hydrogen evolution polarization curve diagrams of a platinum/nickel-cobalt-iron phosphide material obtained in Embodiment 24 and Application Example 24 in a 6 mol/L NaOH+2 mol/L NaI solution and a 6 mol/L NaOH solution.

It may be concluded from FIG. 73 that adding iodide ions to the electrolysis solution may reduce the potential of platinum/nickel-cobalt-iron phosphide (or phosphate) required to reach a current density of 100 mA/square centimeter to 96.7 mV, which is beneficial for the material to catalyze hydrolysis and oxygen evolution, and indicates that the coordination of iodide ions in the electrolysis process is beneficial for improving electrolytic performance of the material.

Embodiment 25—Electrochemical Deposition Method

Referring to the method in Embodiment 24, a nickel-cobalt-iron phosphide material was synthesized according to the method in steps (1) and (2), but step (3) was changed to prepare 50 mL of the electrolyte solution by mixing 20.0 g of sodium hydroxide, 2 g of sodium sulfate and 0.203 g (10 mmol/L) of chloroiridic acid with an appropriate amount of water. An iridium/nickel-cobalt-iron phosphide (or phosphate) material was finally obtained.

Application Example 25

1. Oxygen Evolution During Seawater Electrolysis

Figure 74:
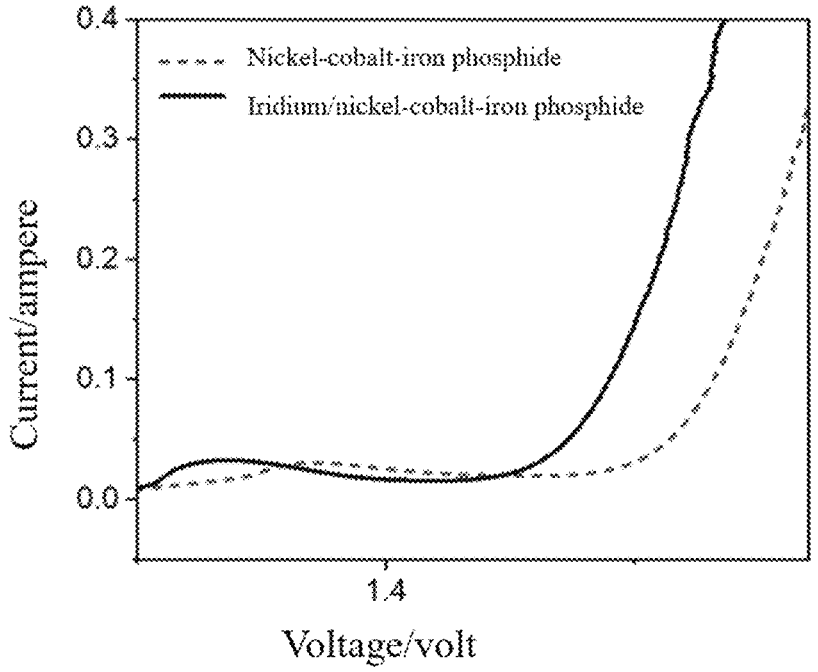
FIG. 74 is a graph of oxygen evolution polarization curve diagrams of a platinum/nickel-cobalt-iron phosphide material and a nickel-cobalt-iron phosphide material obtained in Embodiment 25 and Application Example 25 in a 6 mol/L NaOH+2.8 mol/L NaCl solution.

The oxygen evolution performance of the material obtained in Embodiment 25 during seawater electrolysis was tested using a three-electrode testing system. The reference electrode was a saturated calomel electrode, the counter electrode was a platinum electrode, the working electrode was the iridium/nickel-cobalt-iron phosphide (or phosphate) material prepared in Embodiment 25 or the nickel-cobalt-iron phosphide (or phosphate) material obtained from step (2) in Embodiment 25, the voltage range was from 0 V to −1 V, and the electrolyte solution was 6 M sodium hydroxide and 2.8 M sodium chloride to characterize cathodic oxygen evolution performance of the material during electrolysis of simulated seawater. The obtained testing results are as shown in FIG. 74. The voltage required for oxygen evolution by the iridium/nickel-cobalt-iron phosphide material to reach a current density of 100 mA/square centimeter is about 1.49 V, and the voltage required for oxygen evolution by the nickel-cobalt-iron phosphide material to reach a current density of 100 mA/square centimeter is about 1.53 V. Iridium single atom loading advances the peak potential for hydrogen evolution by about 40 mV, indicating that iridium single atoms are beneficial for improving the catalytic activity of oxygen evolution.

2. Two-Electrode Seawater Electrolysis

Figure 75:
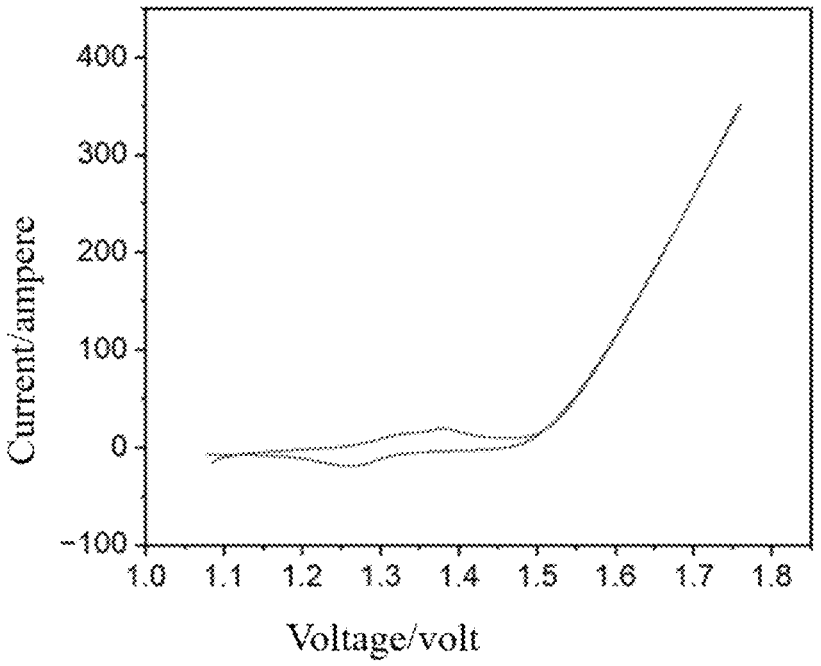
FIG. 75 is a graph of polarization curves during electrolysis of water using a two-electrode system comprising a platinum/nickel-cobalt-iron phosphide material (anode) and commercial iridium/carbon (cathode) obtained in Embodiment 25 and Application Example 25 in a 6 mol/L NaOH+2.8 mol/L NaCl solution.

The hydrogen production performance of the material obtained in Embodiment 25 during electrolysis of simulated seawater was tested using a two-electrode testing system. The anode was the iridium/nickel-cobalt-iron phosphide (or phosphate) material prepared in Embodiment 25, and the cathode was the platinum/nickel-cobalt-iron phosphide (or phosphate) material prepared in Embodiment 24. Polarization curves of hydrogen evolution of the two electrodes were as shown in FIG. 75, and the overpotential required to reach 100 mA/square centimeter was only 358 mV, indicating that the material also has ultra-high performance in a two-electrode seawater electrolysis system.

What is claimed is:

1. A nanomaterial, comprising:

a non-noble metal substrate; and single noble metal atoms dispersed on a surface of the non-noble metal substrate, wherein the non-noble metal substrate comprises one or more hydroxides, oxides, sulfides, phosphides, phosphates, or selenides of iron, cobalt, nickel, aluminum, manganese, cerium, vanadium, zinc, copper, strontium, indium, cadmium, and combinations thereof;

the single noble metal atoms are selected from iridium, ruthenium, gold, platinum, rhodium, palladium, silver, osmium and combinations thereof, and the single noble metal atoms are simultaneously coordinated with (i) a halogen selected from chlorine, bromine, fluorine, and iodine, and (ii) one or more oxygen-containing functional groups.

2. The nanomaterial according to claim 1, wherein the nanomaterial further comprises a conductive carrier, and the non-noble metal substrate is on the conductive carrier.

3. The nanomaterial according to claim 2, wherein the conductive carrier is selected from foam metal, carbon paper, and a carbon cloth.

4. The nanomaterial according to claim 3, wherein the conductive carrier is selected from foam iron and foam nickel.

5. The nanomaterial according to claim 1, wherein the non-noble metal substrate is doped with a reducing metal ion.

6. The nanomaterial according to claim 5, wherein the reducing metal ions are selected from divalent iron ions, manganese ions, and cobalt ions.

7. The nanomaterial according to claim 1, wherein the one or more oxygen-containing functional groups comprise a hydroxide ion.

8. The nanomaterial according to claim 7, wherein the halogen is chlorine.

9. The nanomaterial according to claim 1, wherein the single noble metal atoms are iridium.

10. The nanomaterial according to claim 9, wherein the single noble metal atoms further include ruthenium or platinum.

11. The nanomaterial according to claim 9, wherein the non-noble metal substrate comprises a hydroxide, a selenide, or a phosphide or phosphate of iron, cobalt, nickel, or a combination thereof.

12. The nanomaterial according to claim 11, wherein the non-noble metal substrate further comprises divalent manganese ions.

13. The nanomaterial according to claim 1, wherein the single noble metal atoms are ruthenium or platinum.

14. The nanomaterial according to claim 13, wherein the non-noble metal substrate comprises a hydroxide, a selenide, a sulfide, or a phosphide or phosphate of iron, cobalt, nickel, or a combination thereof.

15. The nanomaterial according to claim 14, wherein the non-noble metal substrate further comprises cerium or vanadium.

16. The nanomaterial according to claim 14, wherein the non-noble metal substrate is on a foam nickel or carbon paper carrier.

17. The nanomaterial according to claim 1, wherein the single noble metal atoms are selected from gold, silver, osmium and palladium.

18. The nanomaterial according to claim 17, wherein the non-noble metal substrate comprises an oxide, a selenide, a sulfide, or a phosphide or phosphate of iron, cobalt, nickel, or a combination thereof.

19. The nanomaterial according to claim 18, wherein the non-noble metal substrate further comprises indium, manganese, cadmium, zinc, aluminum, copper, strontium, or a combination thereof.

* * * * *